US012546199B1

(12) United States Patent
Upchurch

(10) Patent No.: US 12,546,199 B1
(45) Date of Patent: Feb. 10, 2026

(54) MULTI-ZONE FRACTURE STIMULATED INJECTION WELL WITH AUTONOMOUS INJECTION REGULATORS AND PROTECTIVE SLEEVES

(71) Applicant: Chevron U.S.A. Inc., San Ramon, CA (US)

(72) Inventor: Eric Roberto Upchurch, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/800,590

(22) Filed: Aug. 12, 2024

(51) Int. Cl.
*E21B 43/26* (2006.01)
*E21B 23/00* (2006.01)
*E21B 34/00* (2006.01)

(52) U.S. Cl.
CPC ..... *E21B 43/26* (2013.01); *E21B 34/00* (2013.01)

(58) Field of Classification Search
CPC ..... E21B 43/26; E21B 34/00; E21B 34/12; E21B 34/142; E21B 43/12; E21B 43/14; E21B 23/00
USPC ..... 166/308.1
See application file for complete search history.

(56) References Cited

U.S. PATENT DOCUMENTS 8,657,015 B2 * 2/2014 Patel ..... E21B 34/06 166/325
8,757,265 B1 * 6/2014 Cuffe ..... E21B 33/14 166/308.1
9,051,810 B1 * 6/2015 Cuffe ..... E21B 43/26
11,434,720 B2 * 9/2022 Johnson ..... E21B 34/142
2012/0037380 A1 * 2/2012 Arizmendi, Jr. .... E21B 23/0414 166/332.8
2014/0224504 A1 * 8/2014 McGeoch ..... E21B 43/12 166/205
2014/0238666 A1 * 8/2014 Walton ..... E21B 34/14 166/66.5
2015/0233210 A1 * 8/2015 Beck ..... E21B 34/102 166/373
2017/0058638 A1 * 3/2017 Hardesty ..... E21B 34/142
2017/0159398 A1 * 6/2017 Getzlaf ..... E21B 33/124
2018/0223626 A1 * 8/2018 Wakefield ..... E21B 34/063
2019/0136666 A1 * 5/2019 Kent ..... E21B 34/142
2023/0022332 A1 * 1/2023 Macphail ..... E21B 43/14

* cited by examiner

*Primary Examiner* — Nicole Coy
*Assistant Examiner* — Douglas S Wood
(74) *Attorney, Agent, or Firm* — Smith & Woldesenbet Law Group, PLLC

(57) ABSTRACT

A method for implementing a stimulation and injection sequence from a wellbore can include performing a stimulation operation (e.g., fracturing) on a subterranean formation from the wellbore while a protective sleeve of a sub in a liner positioned in the wellbore is in an engaged position to isolate an injection regulator of the sub from a cavity of the sub during the stimulation operation. The method can also include moving, when the stimulation operation is complete and using a protective sleeve adjustment device, the protective sleeve of the sub to a disengaged position to allow the injection regulator to be exposed to the cavity of the sub. The method can further include performing an injection operation on the wellbore, where the injection operation comprises pumping an injection fluid through the cavity of the liner, through the injection regulator, and into the subterranean formation.

16 Claims, 21 Drawing Sheets

MULTI-ZONE FRACTURE STIMULATED INJECTION WELL WITH AUTONOMOUS INJECTION REGULATORS AND PROTECTIVE SLEEVES

TECHNICAL FIELD

The present disclosure relates to a control valve that allows for a more even distribution of injected fluids along a wellbore penetrating subterranean formations or fractures of different permeabilities or conductivities, respectively. In particular, the present disclosure relates to a single-installation completion method of creating a multi-zone fracture stimulated injection well that includes autonomous injection regulators, where each regulator operates between an inactive state and an active state.

BACKGROUND

Enhanced geothermal systems (EGSs) rely on passing a fluid, usually water, through a series of man-made hydraulic fractures in a hot subterranean formation, with the intent of harvesting heat from such formations to generate electrical power or to use directly in industrial thermal processes. The hydraulic fractures provide a series of semi-parallel pathways for fluid to pass from a deviated (i.e., non-vertical) injection well to one or more deviated production wells. The system yields heat most efficiently when fluid passes through all the fractures in a substantially evenly distributed manner. Conversely, short-circuiting of the fluid system via flow through a minority of fractures severely diminishes the amount of harvested heat. It is a natural tendency for similarly created hydraulic fractures to exhibit widely varying fluid conductivities (i.e., the ease by which fluid moves through a fracture). Thus, thermal short-circuiting is a natural outcome of any EGS, unless that EGS possesses some form of fluid flow control that enforces a more even distribution of injected fluid among the fractures.

SUMMARY

In general, in one aspect, the disclosure relates to a method for implementing a stimulation and injection sequence from a wellbore. The method can include performing a stimulation operation on a subterranean formation from the wellbore while a protective sleeve of a sub in a liner positioned in the wellbore is in an engaged position, where the protective sleeve, when in the engaged position, isolates an injection regulator of the sub from a cavity of the sub during the stimulation operation. The method can also include moving, when the stimulation operation is complete and using a protective sleeve adjustment device, the protective sleeve of the sub from the engaged position to a disengaged position, where the protective sleeve, when in the disengaged position, allows the injection regulator to be exposed to the cavity of the sub. The method can further include performing an injection operation on the wellbore, where the injection operation includes pumping an injection fluid through the cavity of the liner, through the injection regulator, and into the subterranean formation.

In another aspect, the disclosure relates to a sub used for subterranean injections. The sub can include a housing having a housing wall forming a cavity, where the housing is configured to be placed in line with a liner, and where the housing wall has a first flow orifice that traverses therethrough. The sub can also include an injection regulator disposed within the cavity. The sub can further include a protective sleeve movably disposed within the cavity, where the protective sleeve has an engaged position and a disengaged position, where the protective sleeve is configured to isolate the injection regulator from the cavity when the protective sleeve is in the engaged position, and where the injection regulator is exposed to the cavity when the protective sleeve is in the disengaged position.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION

Figure 1:
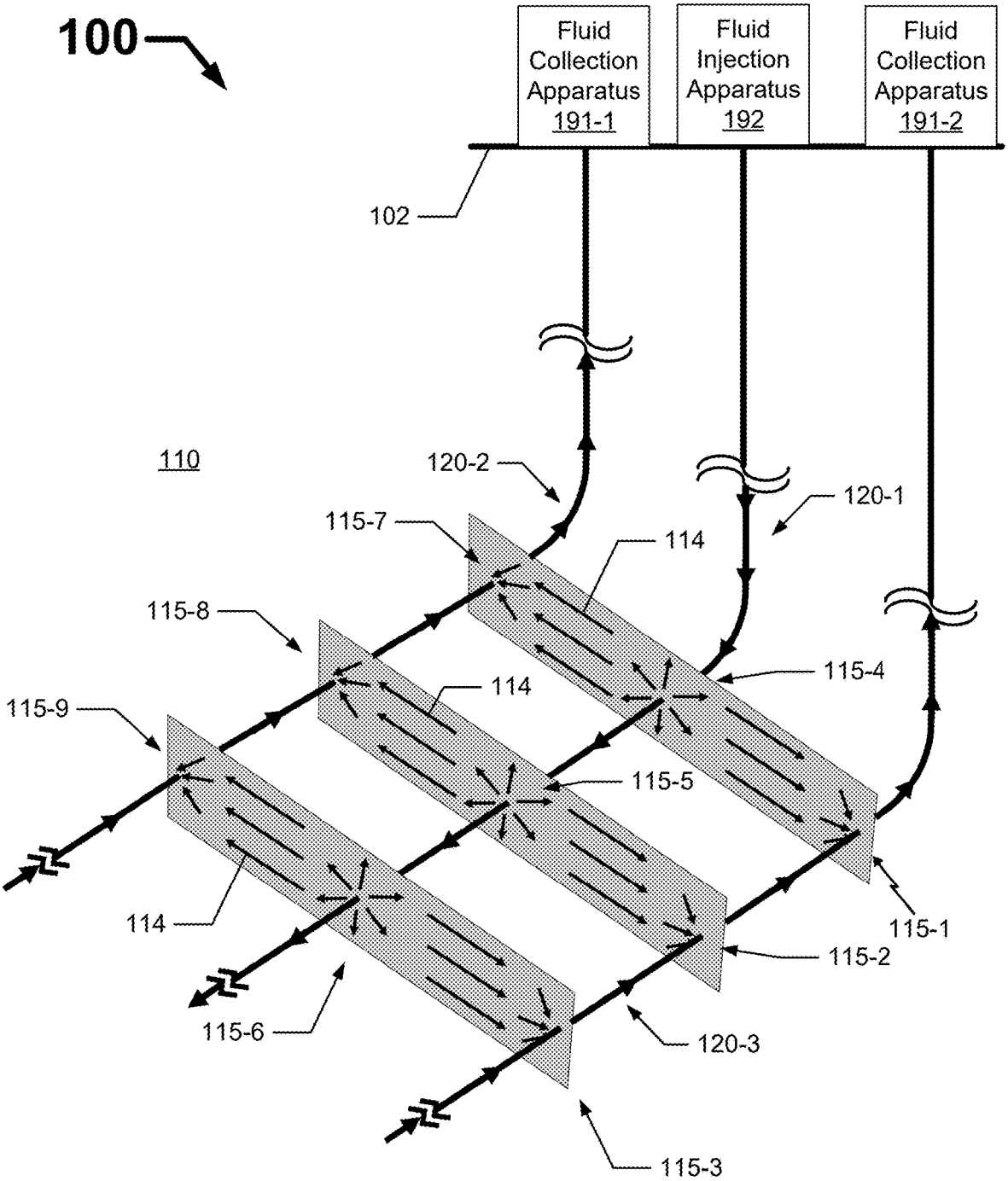
FIG. 1 shows a field system with which example embodiments can be used.

The example embodiments discussed herein are directed to systems, apparatus, methods, and devices for multi-zone fracture stimulated injection wells with autonomous injection regulators and protective sleeves. Example multi-zone fracture stimulated injection wells with autonomous injection regulators with protective sleeves can be used in any of a number of industries, including but not limited to oil and gas, geothermal, carbon sequestration, and saltwater disposal. Example multi-zone fracture stimulated injection wells with autonomous injection regulators with protective sleeves may be designed to comply with certain standards and/or requirements. Example multi-zone fracture stimulated injection wells with autonomous injection regulators with protective sleeves may be used in any of a number of different environments, including but not limited to subterranean environments (e.g., high temperature, high pressure). In some cases, such environments may be hazardous environments.

Example embodiments may be used to provide a pathway for constructing an EGS injection well using a single-installation completion system that allows the pumping of multiple hydraulic fracture stimulations and includes autonomous regulators to ensure relatively even injection fluid distribution across all conductive fractures during the energy production phase of the life of the injection well. Example embodiments include the use of one or more protective sleeves that have an active state or position (for when the injection well is being fractured) and an inactive state or position (for when fluids are pumped into the injection well with the intention of fluid passing through the created fractures to harvest subterranean heat). In alternative embodiments, one or more injection regulators protected by a protective sleeve is a valve that may be autonomous (e.g., an autonomous self-regulating injection control valve (ASRICV)) and/or is not autonomous. Example of ASRICVs that are not described herein may be found in U.S. patent application Ser. No. 18/530,416 (published as U.S. Patent Application Publication No. 2024/0191599 on Jun. 13, 2024) titled "Autonomous Self-Regulating Injection Control Valve (ASRICV)" and filed on Dec. 6, 2023.

The use of the terms "about", "approximately", and similar terms applies to all numeric values, whether or not explicitly indicated. These terms generally refer to a range of numbers that one of ordinary skill in the art would consider as a reasonable amount of deviation to the recited numeric values (i.e., having the equivalent function or result). For example, this term may be construed as including a deviation of ±10 percent of the given numeric value provided such a deviation does not alter the end function or result of the value. Therefore, a value of about 1% may be construed to be a range from 0.9% to 1.1%. Furthermore, a range may be construed to include the start and the end of the range. For example, a range of 10% to 20% (i.e., range of 10%-20%) includes 10% and also includes 20%, and includes percentages in between 10% and 20%, unless explicitly stated otherwise herein. Similarly, a range of between 10% and 20% (i.e., range between 10%-20%) includes 10% and also includes 20%, and includes percentages in between 10% and 20%, unless explicitly stated otherwise herein.

It is understood that when combinations, subsets, groups, etc. of elements are disclosed (e.g., combinations of components in a composition, or combinations of steps in a method), that while specific reference of each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components.

For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C.

In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C).

In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

A user may be any person that interacts with control valves, regardless of the environment in which the control valve is located and/or the industry in which the control valve is used. In addition, or in the alternative, a user may be a person or entity involved in a fracture stimulation operation and/or an injection operation with respect to one or more subterranean wells. Examples of a user may include, but are not limited to, an engineer, an electrician, an instrumentation and controls technician, a mechanic, an operator, an employee, a consultant, a contractor, and a manufacturer's representative.

Example embodiments utilized with multi-zone fracture stimulated injection wells with autonomous injection regulators (e.g., ASRICVs) with protective sleeves (including portions thereof) can be made of one or more of a number of suitable materials to allow the associated system or subsystem to meet certain standards and/or regulations while also maintaining durability in light of the one or more conditions under which the example embodiments utilized with multi-zone fracture stimulated injection wells with autonomous injection regulators with protective sleeves and/or other associated components of the example embodiments utilized with multi-zone fracture stimulated injection wells with autonomous injection regulators with protective sleeves can be exposed. Examples of such materials can include, but are not limited to, aluminum, stainless steel, fiberglass, glass, plastic, thermoplastic, ceramic, and rubber.

When used in certain systems (e.g., for certain subsea field operations), example embodiments (including portions thereof) can be designed to comply with certain standards and/or requirements. Examples of entities that set such standards and/or requirements can include, but are not limited to, the Society of Petroleum Engineers, the American Petroleum Institute (API), the International Standards Organization (ISO), the International Association of Classification Societies (IACS), and the Occupational Safety and Health Administration (OSHA).

Example embodiments utilized with multi-zone fracture stimulated injection wells with autonomous injection regulators with protective sleeves, or portions or components thereof, described herein can be made from a single piece (e.g., as from a mold, injection mold, casting, die cast, forging, extrusion process, or 3D printing). In addition, or in the alternative, example embodiments utilized with multi-zone fracture stimulated injection wells with autonomous injection regulators with protective sleeves (including portions or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, snap fittings, and slotted fittings. One or more pieces that are mechanically coupled to each other can be coupled to each other in one or more of a number of ways, including but not limited to fixedly, hingedly, removably, slidably, and threadably.

Components and/or features described herein can include elements that are described as coupling, fastening, securing, abutting against, in communication with, or other similar terms. Such terms are merely meant to distinguish various elements and/or features within a component or device and are not meant to limit the capability or function of that particular element and/or feature. For example, a feature described as a "coupling feature" can couple, secure, fasten, abut against, and/or perform other functions aside from merely coupling.

A coupling feature (including a complementary coupling feature) as described herein can allow one or more components and/or portions of an example embodiment utilized with multi-zone fracture stimulated injection wells with autonomous injection regulators with protective sleeves to become coupled, directly or indirectly, to one or more other components of the embodiment utilized with multi-zone fracture stimulated injection wells with autonomous injection regulators with protective sleeves and/or to some other component of a system or subsystem. A coupling feature can include, but is not limited to, a clamp, a portion of a hinge, an aperture, a recessed area, a protrusion, a hole, a slot, a tab, a detent, and mating threads. One portion of an example embodiment utilized with multi-zone fracture stimulated injection wells with autonomous injection regulators with protective sleeves can be coupled to another component of the embodiment utilized with multi-zone fracture stimulated injection wells with autonomous injection regulators with protective sleeves and/or to some other component of a system or subsystem by the direct use of one or more coupling features.

In addition, or in the alternative, a portion of an example embodiment utilized with multi-zone fracture stimulated injection wells with autonomous injection regulators with protective sleeves can be coupled to another component of the embodiment utilized with multi-zone fracture stimulated injection wells with autonomous injection regulators and with protective sleeves and/or to another component of a system or subsystem using one or more independent devices that interact with one or more coupling features disposed on a component of the example embodiment utilized with multi-zone fracture stimulated injection wells with autonomous injection regulators with protective sleeves. Examples of such devices can include, but are not limited to, a pin, a hinge, a fastening device (e.g., a bolt, a screw, a rivet), epoxy, glue, adhesive, and a spring. One coupling feature described herein can be the same as, or different than, one or more other coupling features described herein. A complementary coupling feature as described herein can be a coupling feature that mechanically couples, directly or indirectly, with another coupling feature.

If a component of a figure is described but not expressly shown or labeled in that figure, the label used for a corresponding component in another figure may be inferred to that component. Conversely, if a component in a figure is labeled but is not described, the description for such component may be substantially the same as the description for the corresponding component in another figure. The numbering scheme for the various components in the figures herein is such that each component is a three-digit number or a four-digit number, and corresponding components in other figures have the identical last two digits. For any figure shown and described herein, one or more of the components may be omitted, added, repeated, and/or substituted. Accordingly, embodiments shown in a particular figure should not be considered limited to the specific arrangements of components shown in such figure.

Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

Example embodiments utilized with multi-zone fracture stimulated injection wells with autonomous injection regulators with protective sleeves will be described more fully hereinafter with reference to the accompanying drawings, in which example embodiments utilized with multi-zone fracture stimulated injection wells with autonomous injection regulators with protective sleeves are shown. Example embodiments utilized with multi-zone fracture stimulated injection wells with autonomous injection regulators with protective sleeves may, however, be embodied in many different forms and should not be construed as limited to the example embodiments set forth herein. Rather, these example embodiments are provided so that this disclosure will be thorough and complete, and will fully convey the scope of example embodiments utilized with multi-zone fracture stimulated injection wells with autonomous injection regulators with protective sleeves to those of ordinary skill in the art. Like, but not necessarily the same, elements (also sometimes called components) in the various figures are denoted by like reference numerals for consistency.

Terms such as "first", "second", "primary," "secondary," "above", "below", "inner", "outer", "distal", "proximal", "end", "top", "bottom", "upper", "lower", "side", "width,", "height", "depth", "length", "left", "right", "front", "rear", and "within", when present, are used merely to distinguish one component (or part of a component or state of a component or orientation of a component) from another. This list of terms is not exclusive. Such terms are not meant to denote a preference or a particular orientation, and they are not meant to limit example embodiments utilized with multi-zone fracture stimulated injection wells with autonomous injection regulators with protective sleeves. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 shows a field system 100 with which example embodiments can be used. The field system 100 of FIG. 1 includes three wellbores 120 (wellbore 120-1, wellbore 120-2, and wellbore 120-3) that are substantially horizontal and substantially parallel with respect to each other within part (e.g., a layer of shale, a layer of sandstone, a layer of granite) of a subterranean formation 110. Looking at the system 100 at a high level, a relatively colder fluid (e.g., water) is injected into a series of hydraulic fractures using a horizontal wellbore 120-1, and hotter water or steam is harvested from other horizontal wellbore 120-2 and wellbore 120-3 connected to the same fractures. The system 100 is generally referred to as an EGS. Evenly distributing the injected fluid to the hydraulic fractures is key to harvesting the maximum amount of available geothermal heat. Hydraulic fractures created in identical rock with identical materials and identical processes typically do not have identical fluid conductivities. This is due to the non-linear nature of hydraulically-driven fracture propagation in subterranean rock formations. It is not uncommon for similarly generated hydraulic fractures to exhibit fluid conductivities spanning an order-of-magnitude difference.

Looking at the system 100 in more detail, each wellbore 120 has undergone a fracturing operation that has made multiple penetrations along its length in the horizontal section. The fracturing operation of wellbore 120-1 has generated three fracture zones 115 (fracture zone 115-4, fracture zone 115-5, and fracture zone 115-6) within the subterranean formation 110. The fracturing operation of wellbore 120-2 has generated three fracture zones 115 (fracture zone 115-7, fracture zone 115-8, and fracture zone 115-9) within the subterranean formation 110. The fracturing operation of wellbore 120-3 has generated three fracture zones 115 (fracture zone 115-1, fracture zone 115-2, and fracture zone 115-3) within the subterranean formation 110.

Fractures created at one wellbore may extend to contact a neighboring wellbore to provide fluid communication (in this case, flow paths 114). Fractures created at one wellbore may extend to contact fractures created at a neighboring wellbore to provide fluid communication. For example, fracture zone 115-1 of wellbore 120-3, fracture zone 115-4 of wellbore 120-1, and fracture zone 115-7 of wellbore 120-2 have flow paths 114 therebetween, with there also being the possibility of flow paths 114 connecting these three fracture zones 115 with other neighboring fracture zones 115 in the subterranean formation 110. As another example, fracture zone 115-2 of wellbore 120-3, fracture zone 115-5 of wellbore 120-1, and fracture zone 115-8 of wellbore 120-2 have flow paths 114 therebetween, with there also being the possibility of flow paths 114 connecting these three fracture zones 115 with other neighboring fracture zones 115 in the subterranean formation 110. As yet another example, fracture zone 115-3 of wellbore 120-3, fracture zone 115-6 of wellbore 120-1, and fracture zone 115-9 of wellbore 120-2 have flow paths 114 therebetween, with there also being the possibility of flow paths 114 connecting these three fracture zones 115 with other neighboring fracture zones 115 in the subterranean formation 110.

As a result of the fracture zones 115 generated by the fracturing operations of the three wellbores 120, and as a result of wellbore 120-1 being positioned between wellbore 120-2 and wellbore 120-3, there are fractures that may provide fluid communication (via flow paths 114) between wellbore 120-3 and wellbore 120-1 and between wellbore 120-2 and wellbore 120-1. Under the scenario shown in FIG. 1, wellbore 120-1 is used as an injection well, where a fluid is injected using a fluid injection apparatus 192 located at or near the surface 102. Also, wellbore 120-2 and wellbore 120-3 are used as extraction wells for a geothermal exchange, where a fluid (e.g., heated water, steam, carbon dioxide) is collected using a fluid collection apparatus 191-1 for wellbore 120-2 and using a fluid collection apparatus 191-2 for wellbore 120-3.

The fluid injection apparatus 192 may include one or more of a number of different equipment to inject fluid into the wellbore 120-1. Examples of such equipment may include, but are not limited to, a pump, a motor, a compressor, a valve, a regulator, a meter, a relay, a controller, piping, a tank, and a power source. Similarly, the fluid collection apparatus 191-1 and the fluid collection apparatus 191-2 may include one or more of a number of different equipment to collect fluid from the wellbore 120-1. Examples of such equipment may include, but are not limited to, a pump, a motor, a compressor, a valve, a regulator, a meter, a relay, a controller, piping, a tank, and a power source.

In this way, fluids (e.g., water, carbon dioxide) that are colder relative to the temperature within the subterranean formation 110 may be injected into the series of hydraulic fractures along the horizontal section of wellbore 120-1. The subterranean formation 110 acts as a heat exchanger as the fluid, flowing through the flow paths 114 in FIG. 1, is forced through the fractures toward wellbore 120-2 and wellbore 120-3. The resulting hotter water, steam, carbon dioxide, or other fluid is harvested from the horizontal sections of wellbore 120-2 by the fluid collection apparatus 191-1 and wellbore 120-3 by the fluid collection apparatus 191-2.

As discussed above, the even distribution of injected fluid to the hydraulic fractures allows for harvesting the maximum amount of available geothermal heat. Yet, it is not uncommon for similarly generated hydraulic fractures to exhibit fluid conductivities spanning an order-of-magnitude difference or some other range of fluid conductivities. As a result, the ability to individually tailor the pressure at which fluid is injected into the various fracture zones 115 (e.g., fracture zone 115-4, fracture zone 115-5, fracture zone 115-6) along the horizontal section of the wellbore 120-1, to account for these differences in fluid conductivities, would generate optimal (e.g., improved) results in harvesting the geothermal resource provided by the subterranean formation 110. As discussed below, use of example embodiments allows for such a tailored approach after fracture stimulation operations have been executed on one or more of the wellbores 120.

Figure 2:
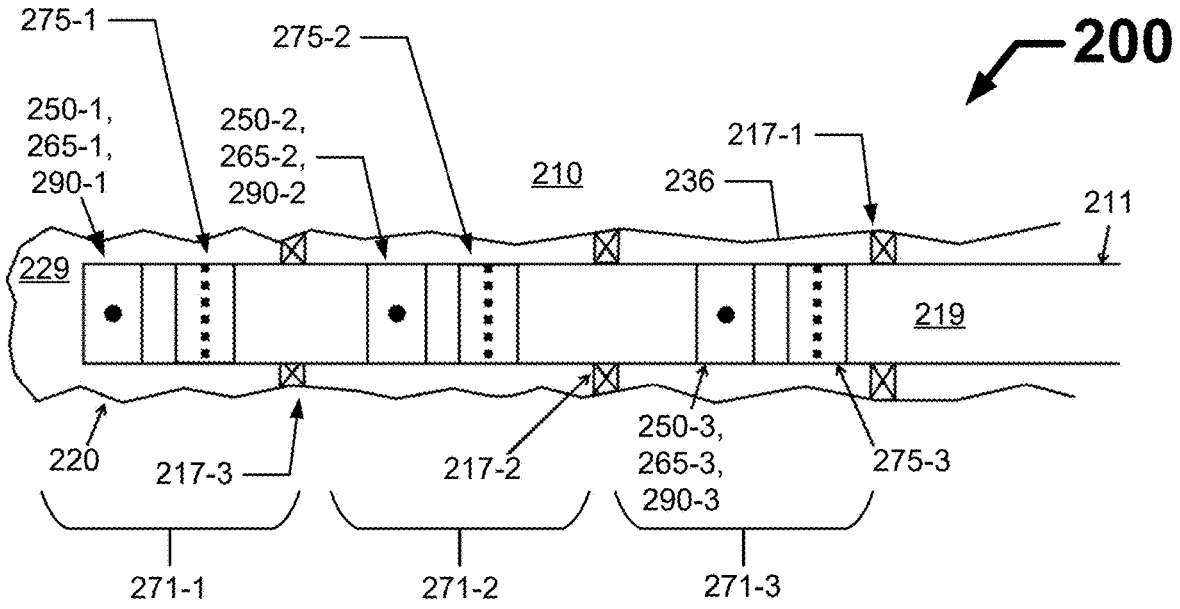
FIG. 2 shows a single installation liner in an open-hole environment according to certain example embodiments.
Figure 3:
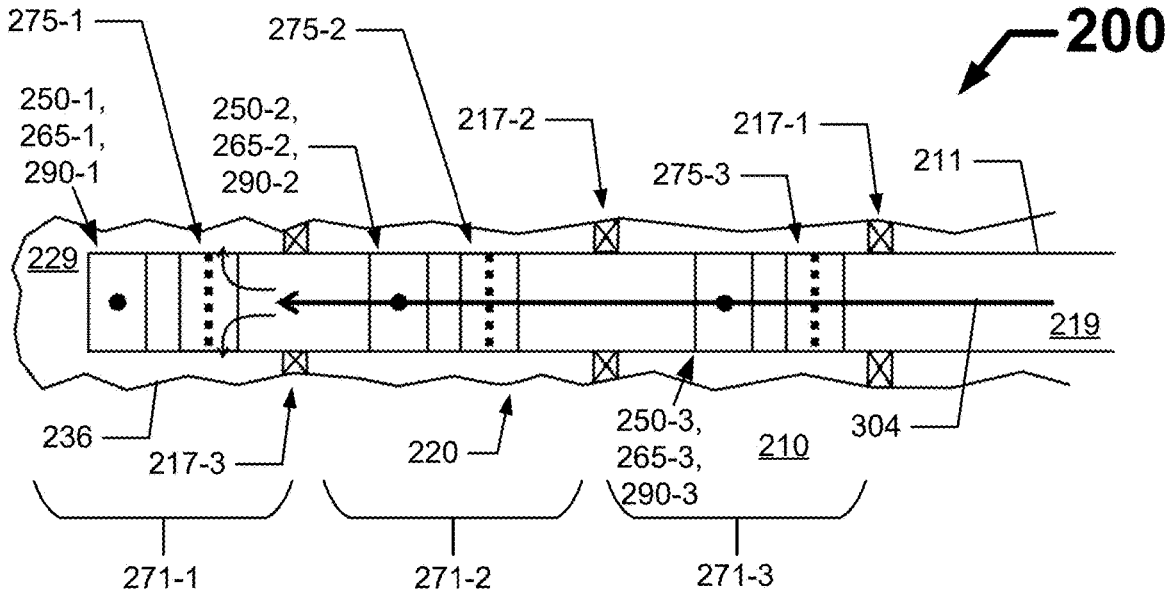
FIGS. 3 through 6 show a stimulation and injection sequence using the single installation liner in the open-hole environment of FIG. 2 according to certain example embodiments.
Figure 4:
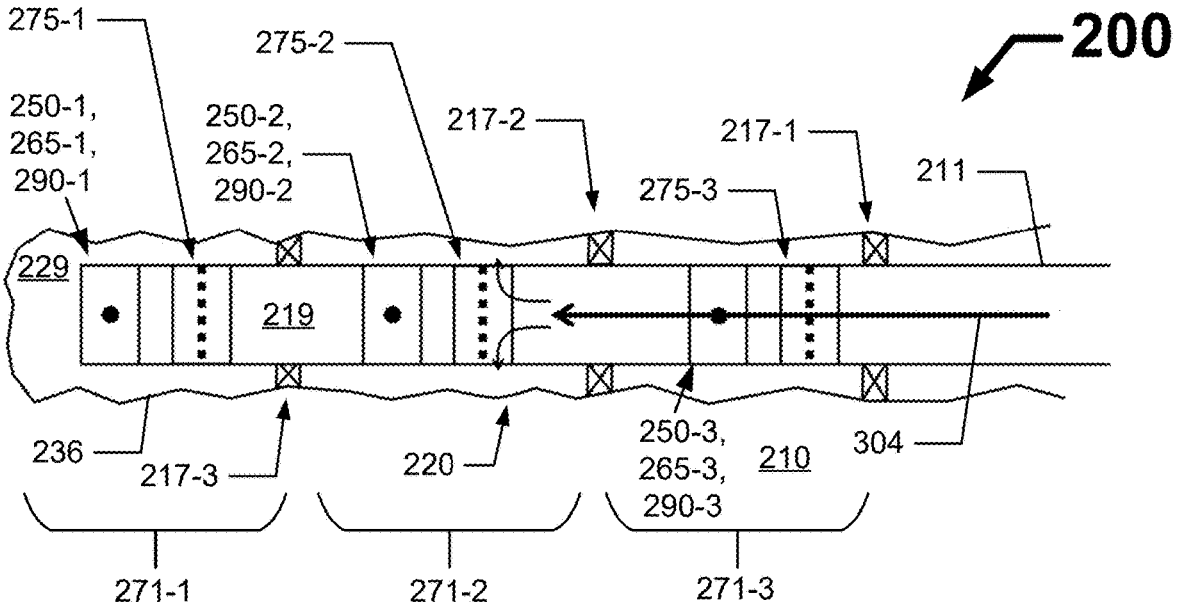
Figure 5:
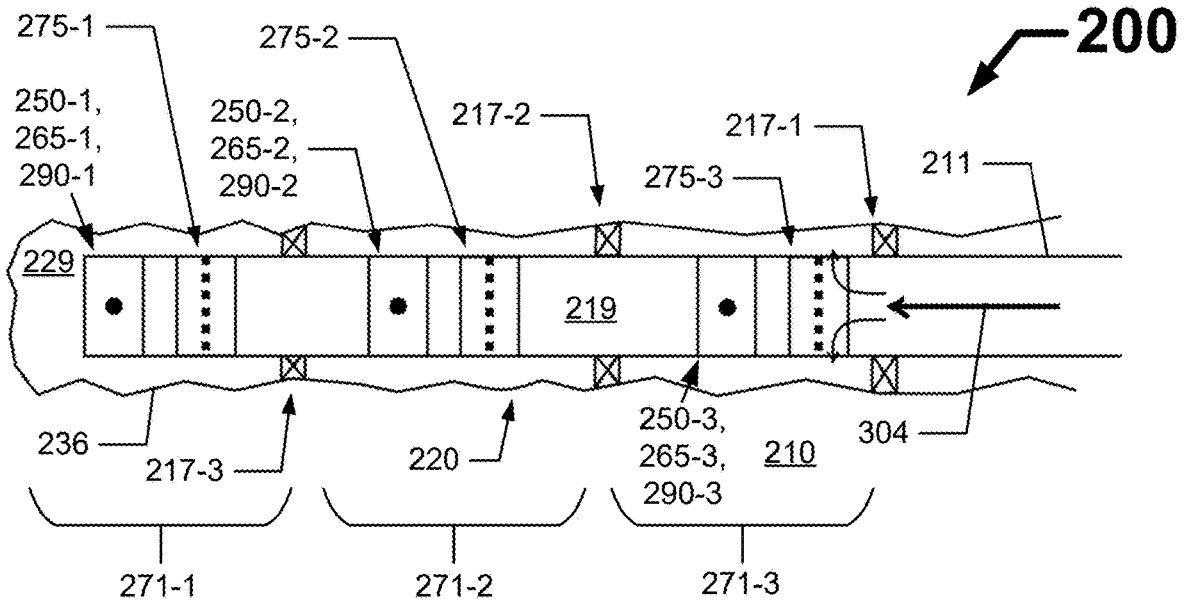
Figure 6:
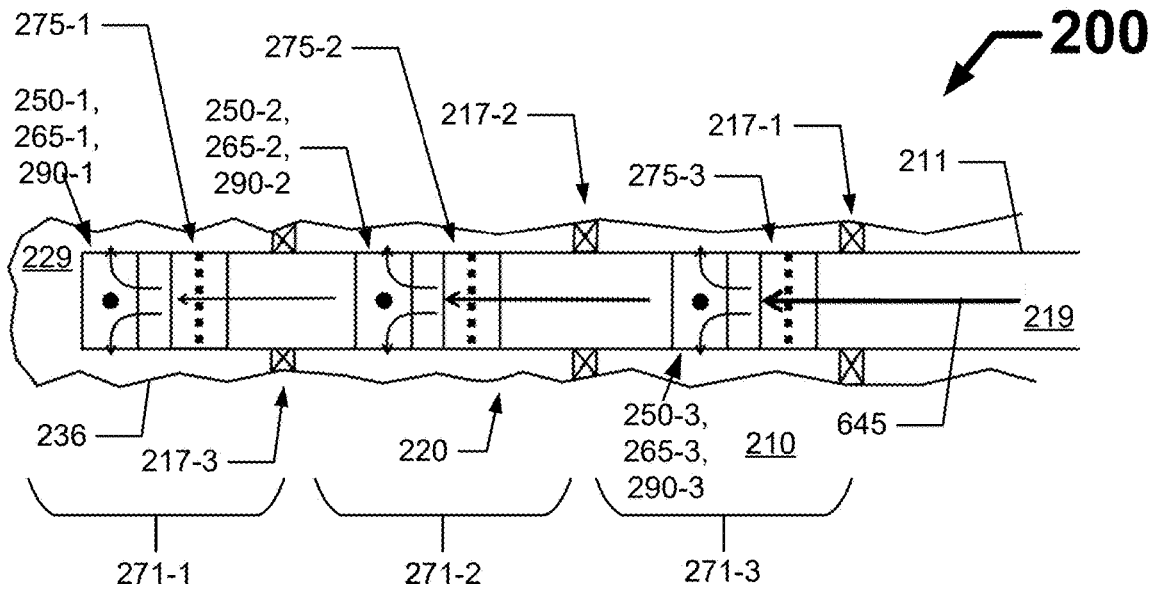

FIG. 2 shows an open-hole system 200 having a single-installation liner 211. FIGS. 3 through 6 show a stimulation and injection sequence using the single installation liner 211 in the open-hole environment according of FIG. 2 to certain example embodiments. Specifically, FIG. 3 shows the system 200 of FIG. 2 when the first stimulation sleeve 275-1 is activated. FIG. 4 shows the system 200 of FIG. 2 when the second stimulation sleeve 275-2 is activated. FIG. 5 shows the system 200 of FIG. 2 when the third stimulation sleeve 275-3 is activated. FIG. 6 shows the system 200 of FIG. 2 during the injection process.

Referring to the description above with respect to FIG. 1, the system 200 of FIGS. 2 through 6 includes an open (e.g., not cased) horizontal section of a wellbore 220 drilled into a subterranean formation 210. In alternative embodiments, the open section of the wellbore 220 may be at any angle ranging from vertical to horizontal. In this case, there is no casing string inserted into the wellbore 220. Perforations or notches cut into the subterranean formation 210 adjacent to the wellbore 220 for the purpose of reducing the pressure required to initiate a fracture may or may not exist at the point in time captured in FIG. 2. The liner 211 includes a number of standard-length liner pipes (e.g., joints) and shorter components (e.g., subs) that are coupled to each other in an end-to-end fashion.

Specifically, the liner 211 is a single-installation completion liner that includes three stimulation sleeves 275 and three subs 290 that each include one or more injection regulators 250 (e.g., ASRICVs) and one or more protective sleeves 265. One or more of the stimulation sleeves 275 may be part of a sub. Sub 290-1 (with injection regulator 250-1 and protective sleeve 265-1) is positioned at or toward the distal end of the liner 211, followed by (moving toward the proximal end of the liner 211) stimulation sleeve 275-1, followed by sub 290-2 (with injection regulator 250-2 and protective sleeve 265-2), followed by stimulation sleeve 275-2, followed by sub 290-3 (with injection regulator 250-3 and protective sleeve 265-3), followed by stimulation sleeve 275-3. One or more of these components of the liner 211 may be separated from each other by liner pipe joints and/or subs.

Each of the subs 290 (and so also the associated injection regulators 250) of the field system 200 may be totally or partially isolated from each other within the annulus 229 (which in this case is defined as the space between the liner 211 and wall 236 of the wellbore 220) by inserting one or more packers 217 into the annulus 229, where each packer 217 creates a total or partial seal between the wall 236 of the wellbore 220 and the outer perimeter of the liner 211. In this case, there are three packers 217 in the portion of the field system 200 shown in FIGS. 2 through 6. Packer 217-1 is located upstream of stimulation sleeve 275-3. Packer 217-2 is located between sub 290-3 and stimulation sleeve 275-2. Packer 217-3 is located between sub 290-2 and stimulation sleeve 275-1.

Packer 217-1 and packer 217-2 create an injection zone 271-3 within the annulus 229, where the injection zone 271-3 includes sub 290-3 (and so also injection regulator 250-3 and protective sleeve 265-3) and stimulation sleeve 275-3. Packer 217-2 and packer 217-3 create an injection zone 271-2 within the annulus 229, where the injection zone 271-2 includes sub 290-2 (and so also injection regulator 250-2 and protective sleeve 265-2) and stimulation sleeve 275-2. Packer 217-3 and the end of the wellbore 220 create an injection zone 271-1 within the annulus 229, where the injection zone 271-1 includes sub 290-1 (and so also injection regulator 250-1 and protective sleeve 265-1) and stimulation sleeve 275-1.

When stimulation operations (e.g., fracturing operations) of the wellbore 220 begin, as captured in FIG. 3, stimulation sleeve 275-1 is activated (i.e., it is opened to allow the passage of stimulation fluid 304 into the annulus 229 in order to propagate fractures in the subterranean formation 210 in the injection zone 271-1). While this is occurring, all of the injection regulators 250 are isolated from the rest of the cavity 219 by the example protective sleeves 265. For example, injection regulator 250-1 is isolated from the rest of the cavity 219 by protective sleeve 265-1, injection regulator 250-2 is isolated from the rest of the cavity 219 by protective sleeve 265-2, and injection regulator 250-3 is isolated from the rest of the cavity 219 by protective sleeve 265-3. In other words, the protective sleeves 265 protect the injection regulators 250 from erosive materials, high pressures, and/or other extreme conditions in the cavity 219 during the stimulation process.

The stimulation operations of the wellbore 220 are sequenced in this example. Specifically, when the stimulation sleeve 275-1 has completed its performance, as captured in FIG. 3, it is then deactivated (i.e., closed) and the stimulation sleeve 275-2 is activated (i.e., it is opened to allow the passage of stimulation fluid 304 into the annulus 229 in order to propagate fractures in the subterranean formation 210 in the injection zone 271-2), as captured in FIG. 4. During the time captured in FIG. 4, all of the injection regulators 250 continue to be isolated from the rest of the cavity 219 by an example protective sleeve 265. Subsequently, when the stimulation sleeve 275-2 has completed its performance, as captured in FIG. 4, it is then deactivated (i.e., closed) and the stimulation sleeve 275-3 is activated (i.e., it is opened to allow the passage of stimulation fluid 304 into the annulus 229 in order to propagate fractures in the subterranean formation 210 in the injection zone 271-3), as captured in FIG. 5.

Each stimulation sleeve 275 allows fracture stimulation fluid 304 to be pumped through it and into its dedicated injection zone 271 (also sometimes called an isolation zone 271). During the time captured in FIG. 5, all of the injection regulators 250 continue to be isolated from the rest of the cavity 219 by the example protective sleeves 265. The stimulation operation in this case is a staged fracture stimulation of each open-hole injection zone 271 (e.g., injection zone 271-1 at the distal end first, followed by the intermediate injection zone 271-2, and finishing with the injection zone 271-3 at the proximal end). For each injection zone 271, its dedicated stimulation sleeve 275 is opened immediately before pumping stimulation fluid 304 through it, and then closed immediately afterwards. The protective sleeves 265 protect the injection regulators 250 during the stimulation process.

In all cases, one or more of the stimulation sleeves 275 may be designed to be in either an open or closed position. The stimulation sleeves 275 serve no purpose in regulating the flow of injection fluid 645 that may pass through them after the stimulation is completed. If left in the open position post-stimulation, the stimulation sleeves 275 serve as simple, non-regulated pathways for fluid movement into or out of the wellbore 220. In the closed position, the stimulation sleeves 275 block all fluid movement therethrough. The injection regulators 250 serve a different purpose. Once the injection regulators 250 are activated (removed from isolation by the example protective sleeves 265) post-stimulation, the injection regulators 250 never close. Instead, the injection regulators 250 actively control the flow of injection fluid 645 passing therethrough to limit the rate that any single injection zone 271 can accept. This forces a more even distribution of injection fluid 645 amongst all the injection zones 271 (also sometimes referred to as injection intervals herein) along the length of the liner 211.

When the stimulation operations are complete, after the time captured in FIG. 5, the injection process is implemented, such as during the time captured in FIG. 6. At the start of the injection process, the protective sleeves 265 that protect each injection regulator 250 during the fracture stimulation process are retracted (i.e., moved to an inactive position within its respective sub 290) to allow the injection fluid 645 passage through the injection regulators 250. Once the protective sleeves 265 are retracted so that they no longer cover the injection regulators 250, each injection regulator 250 may autonomously and simultaneously control injection fluid 645 entry into its dedicated injection zone 271. In certain example embodiments, each injection regulator 250 is configured to operate (i.e., restrict the amount of injection fluid 645 that flows from its cavity 219 into the annulus 229 (and so into the subterranean formation 210)) when a pressure differential (i.e., a difference between the pressure in the cavity 219 within the sub 290 (and so also the associated injection regulator 250) and the pressure in the annulus 229 outside the sub 290) reaches a minimal threshold value.

By using the packers 217, the pressure in the annulus 229 within one injection zone 271 may differ from the pressure in the annulus 229 within one or more of the other injection zones 271. As a result, each injection regulator 250 (or otherwise a specific number of injection regulators 250 as a group or subset) in one injection zone 271 may perform independently of the injection regulators 250 in another injection zone 271. This operational independence of each injection regulator 250 may depend, at least in part, on the ability of one or more of the packers 217 to prevent fluidic communication therethrough within the annulus 229. The use of example subs 290 with injection regulators 250 in each injection zone 271 allows for the substantially even distribution of the injection fluid 645 among the injection zones 271 in the field system 200. In other words, the injection regulators 250 enforce the even distribution of injection fluid 645 during the energy production phase (i.e., the post-stimulation phase) of the life of the wellbore 220.

Figure 7:
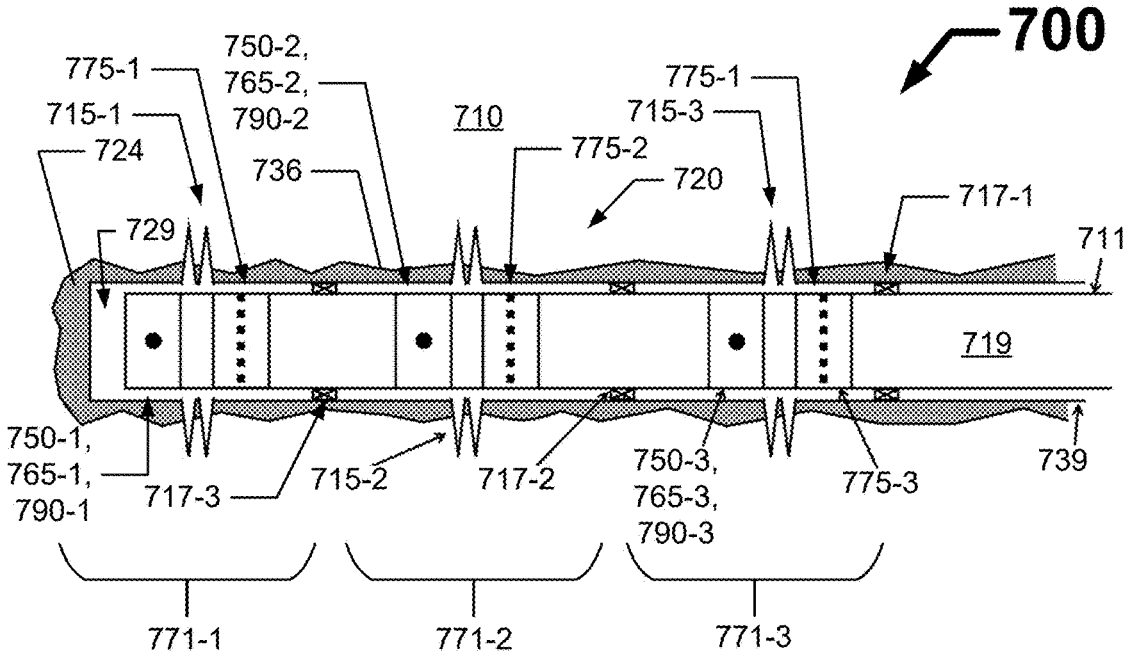
FIG. 7 shows a single installation liner in a cased-hole environment according to certain example embodiments.
Figure 8:
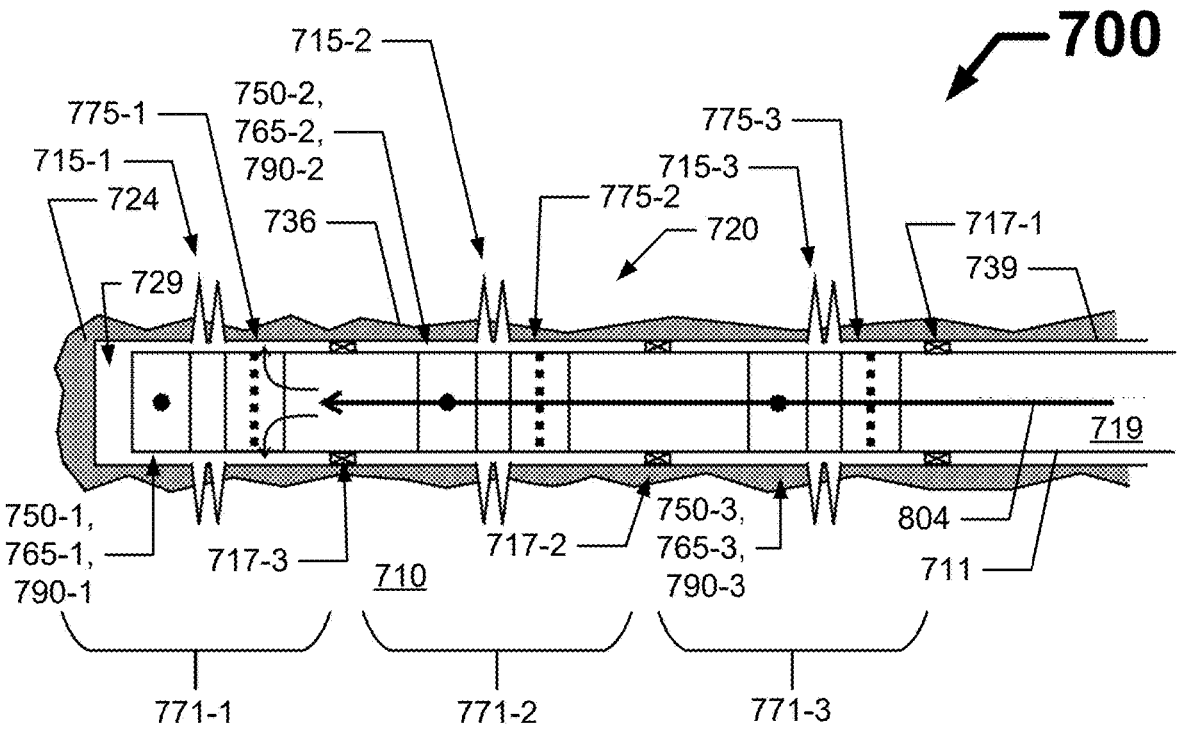
FIGS. 8 through 11 show a stimulation and injection sequence using the single installation liner in the cased-hole environment of FIG. 7 according to certain example embodiments.
Figure 9:
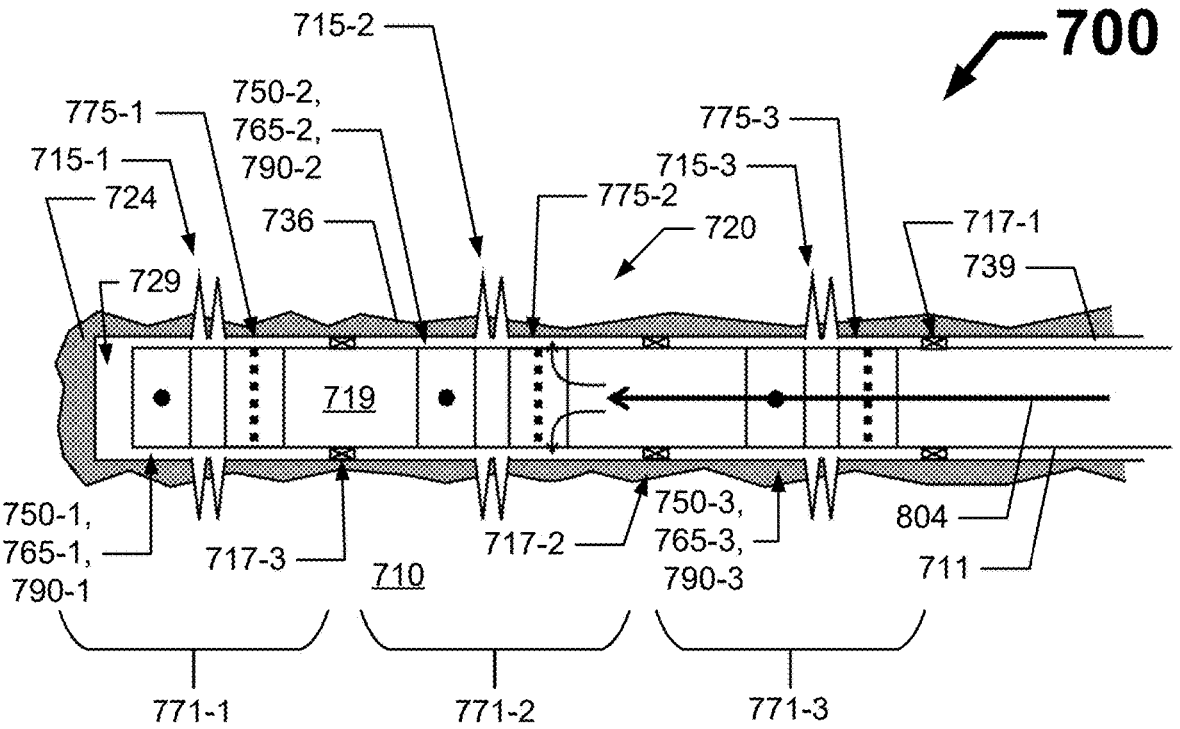
Figure 10:
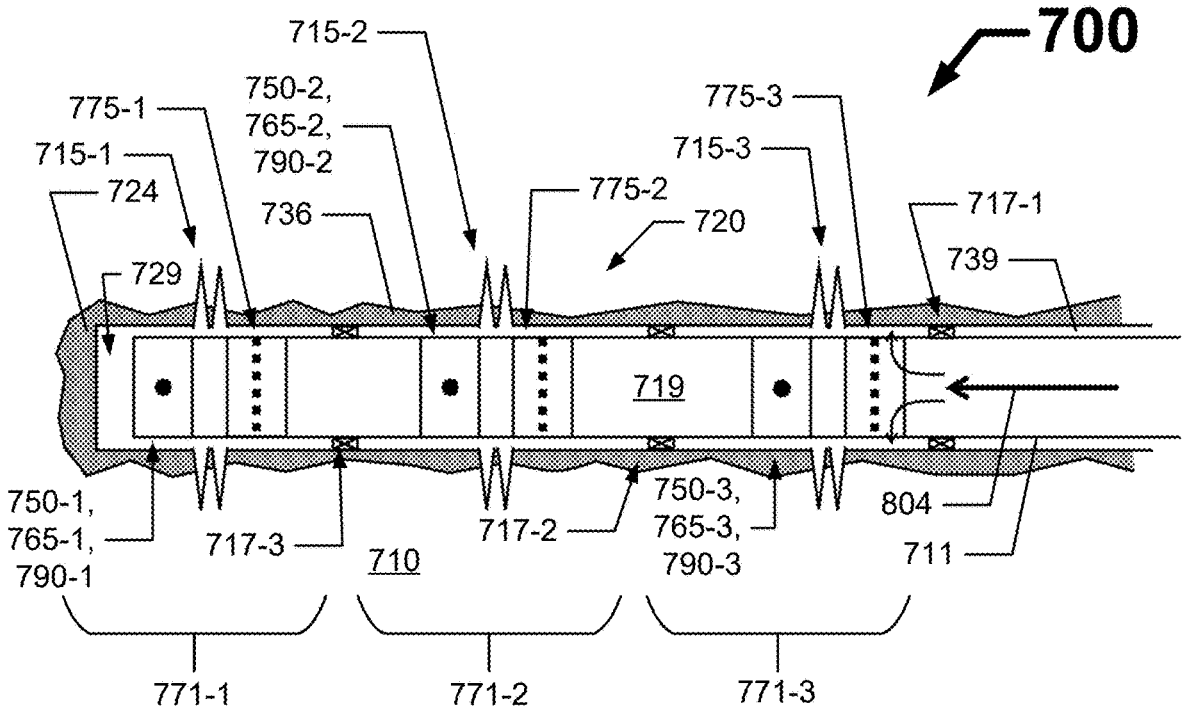
Figure 11:
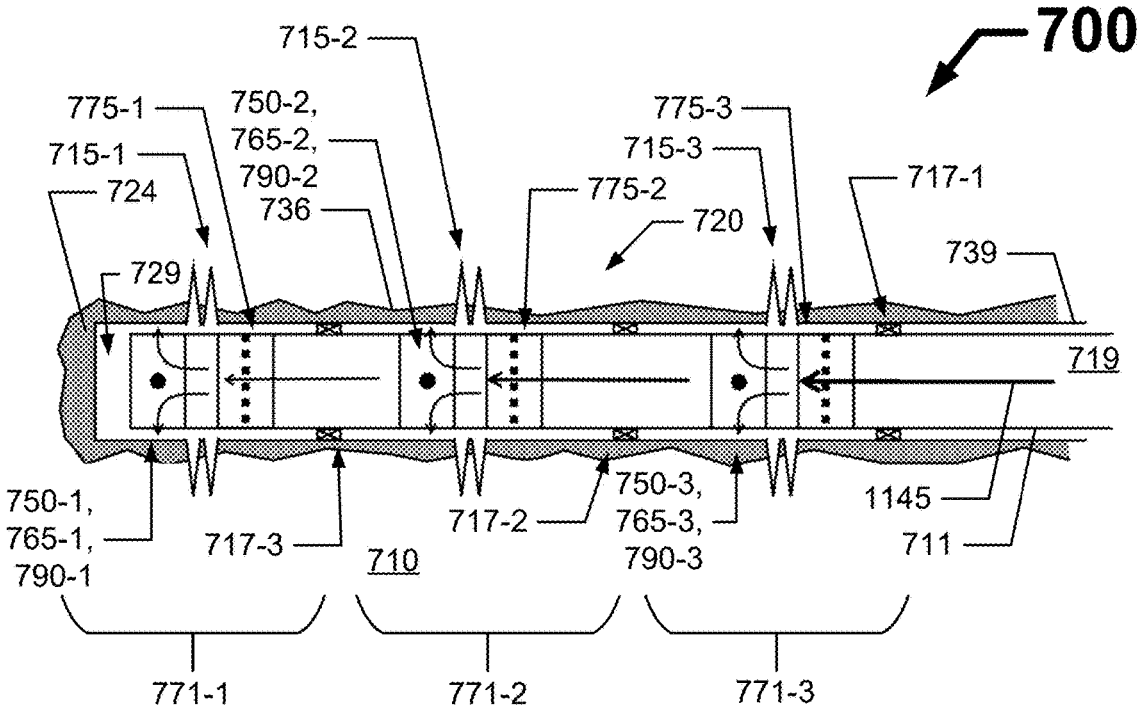

FIG. 7 shows a cased-hole system 700 having a single-installation liner 711. FIGS. 8 through 11 show a stimulation and injection sequence using the single installation liner 711 in the cased-hole environment of FIG. 7 according to certain example embodiments. Specifically, FIG. 8 shows the system 700 of FIG. 7 when the first stimulation sleeve 775-1 is activated. FIG. 9 shows the system 700 of FIG. 7 when the second stimulation sleeve 775-2 is activated. FIG. 10 shows the system 700 of FIG. 7 when the third stimulation sleeve 775-3 is activated. FIG. 11 shows the system 700 of FIG. 7 during the injection process.

Referring to the description above with respect to FIGS. 1 through 6, the system 700 of FIGS. 7 through 11 includes a cased (e.g., not open) horizontal section of a wellbore 720 drilled into a subterranean formation 710. In alternative embodiments, the open section of the wellbore 720 may be at any angle ranging from vertical to horizontal. In this case, there is a casing string 739 inserted into the wellbore 720. Perforations 715 into the subterranean formation 710 adjacent to the wellbore 720 have already been made at the point in time captured in FIG. 7. The casing string 739 includes a number of casing pipes that are coupled to each other in an end-to-end fashion. The inner diameter of the casing string 739 is larger than the outer diameter of the liner 711, forming an annulus 729 therebetween. The casing string 739 is adhered to the wall 736 of the wellbore 720 using cement 724.

The liner 711 is a single-installation completion liner that may be substantially the same as the liner 211 of FIGS. 2 through 6 discussed above. For example, the liner 711 includes a number of standard-length liner pipes and shorter components (e.g., subs 790) that are coupled to each other in an end-to-end fashion. Specifically, the liner 711 includes three stimulation sleeves 775 and three subs 790 that each include one or more injection regulators 750 (e.g., ASRICVs) and one or more protective sleeves 765. One or more of the stimulation sleeves 775 may be part of a sub. Sub 790-1 (with injection regulator 750-1 and protective sleeve 765-1) is positioned at or toward the distal end of the liner 711, followed by (moving toward the proximal end of the liner 711) stimulation sleeve 775-1, followed by sub 790-2 (with injection regulator 750-2 and protective sleeve 765-2), followed by stimulation sleeve 775-2, followed by sub 790-3 (with injection regulator 750-3 and protective sleeve 765-3), followed by stimulation sleeve 775-3. One or more of these components of the liner 711 may be separated from each other by liner pipe joints and/or subs.

Each of the subs 790 (and so also the associated injection regulators 750) of the field system 700 may be totally or partially isolated from each other within the annulus 729 (which in this case is defined as the space between the liner 711 and the casing string 739) by inserting one or more packers 717 into the annulus 729, where each packer 717 creates a total or partial seal between the inner surface of the casing string 739 and the outer perimeter of the liner 711. In this case, there are three packers 717 in the portion of the field system 700 shown in FIGS. 7 through 11. Packer 717-1 is located upstream of stimulation sleeve 775-3. Packer 717-2 is located between sub 790-3 and stimulation sleeve 775-2. Packer 717-3 is located between sub 790-2 and stimulation sleeve 775-1.

Packer 717-1 and packer 717-2 create an injection zone 771-3 within the annulus 729, where the injection zone 771-3 includes sub 790-3 (and so also injection regulator 750-3 and protective sleeve 765-3) and stimulation sleeve 775-3. Packer 717-2 and packer 717-3 create an injection zone 771-2 within the annulus 729, where the injection zone 771-2 includes sub 790-2 (and so also injection regulator 750-2 and protective sleeve 765-2) and stimulation sleeve 775-2. Packer 717-3 and the end of the casing 739 create an injection zone 771-1 within the annulus 729, where the injection zone 771-1 includes sub 790-1 (and so also injection regulator 750-1 and protective sleeve 765-1) and stimulation sleeve 775-1.

When stimulation operations (e.g., fracturing operations) of the wellbore 720 begin, as captured in FIG. 8, stimulation sleeve 775-1 is activated (i.e., it is opened to allow the passage of stimulation fluid 804 into the annulus 729 and through the perforations 715-1 in order to propagate fractures in the subterranean formation 710 in the injection zone 771-1). While this is occurring all of the injection regulators 750 are isolated from the rest of the cavity 719 by the example protective sleeves 765. For example, injection regulator 750-1 is isolated from the rest of the cavity 719 by protective sleeve 765-1, injection regulator 750-2 is isolated from the rest of the cavity 719 by protective sleeve 765-2, and injection regulator 750-3 is isolated from the rest of the cavity 719 by protective sleeve 765-3. In other words, the protective sleeves 765 protect the injection regulators 750 from erosive materials, high pressures, and/or other extreme conditions in the cavity 719 during the stimulation process.

The stimulation operations of the wellbore 720 are sequenced in this example. Specifically, when the stimulation sleeve 775-1 has completed its performance, as captured in FIG. 8, it is then deactivated (i.e., closed) and the stimulation sleeve 775-2 is activated (i.e., it is opened to allow the passage of stimulation fluid 804 into the annulus 729 and through the perforations 715-2 in order to propagate fractures in the subterranean formation 710 in the injection zone 771-2), as captured in FIG. 9. During the time captured in FIG. 9, all of the injection regulators 750 continue to be isolated from the rest of the cavity 719 by an example protective sleeve 765. Subsequently, when the stimulation sleeve 775-2 has completed its performance, as captured in FIG. 9, it is then deactivated (i.e., closed) and the stimulation sleeve 775-3 is activated (i.e., it is opened to allow the passage of stimulation fluid 804 into the annulus 729 and through the perforations 715-3 in order to propagate fractures in the subterranean formation 710 in the injection zone 771-3), as captured in FIG. 10.

Each stimulation sleeve 775 allows fracture stimulation fluid 804 to be pumped through it and into its dedicated injection zone 771 (also sometimes called an isolation zone 771). During the time captured in FIG. 10, all of the injection regulators 750 continue to be isolated from the rest of the cavity 719 by the example protective sleeves 765. The stimulation operation in this case is a staged fracture stimulation of each cased-hole injection zone 771 (e.g., injection zone 771-1 at the distal end first, followed by the intermediate injection zone 771-2, and finishing with the injection zone 771-3 at the proximal end). For each injection zone 771, its dedicated stimulation sleeve 775 is opened immediately before pumping stimulation fluid 804 through it, and then closed immediately afterwards. The protective sleeves 765 protect the injection regulators 750 during the stimulation process.

In all cases, one or more of the stimulation sleeves 775 may be designed to be in either an open or closed position. The stimulation sleeves 775 serve no purpose in regulating the flow of injection fluid 1145 that may pass through them after the stimulation is completed. If left in the open position post-stimulation, the stimulation sleeves 775 serve as simple, non-regulated pathways for fluid movement into or out of the wellbore 720. In the closed position, the stimulation sleeves 775 block all fluid movement therethrough. The injection regulators 750 serve a different purpose. Once the injection regulators 750 are activated (removed from isolation by the example protective sleeves 765) post-stimulation, the injection regulators 750 never close. Instead, the injection regulators 750 actively control the flow of injection fluid 1145 passing therethrough to limit the rate that any single injection zone 771 can accept. This forces a more even distribution of injection fluid 1145 amongst all the injection zones 771 (also sometimes referred to as injection intervals herein) along the length of the liner 711.

When the stimulation operations are complete, after the time captured in FIG. 10, the injection process is implemented, such as during the time captured in FIG. 11. At the start of the injection process, the protective sleeves 765 that protect each injection regulator 750 during the fracture stimulation process are retracted (i.e., moved to an inactive position within its respective sub 790) to allow the injection fluid 1145 passage through the injection regulators 750. Once the protective sleeves 765 are retracted so that they no longer cover the injection regulators 750, each injection regulator 750 may autonomously and simultaneously control injection fluid 1145 entry into its dedicated injection zone 771. In certain example embodiments, each injection regulator 750 is configured to operate (i.e., restrict the amount of injection fluid 1145 that flows from its cavity 719 into the annulus 729 (and so into the subterranean formation 710)) when a pressure differential (i.e., a difference between the pressure in the cavity 719 within the sub 790 (and so also the associated injection regulator 750) and the pressure in the annulus 729 outside the sub 790) reaches a minimal threshold value.

By using the packers 717, the pressure in the annulus 729 within one injection zone 771 may differ from the pressure in the annulus 729 within one or more of the other injection zones 771. As a result, each injection regulator 750 (or otherwise a specific number of injection regulators 750 as a group or subset) in one injection zone 771 may perform independently of the injection regulators 750 in another injection zone 771. This operational independence of each injection regulator 750 may depend, at least in part, on the ability of one or more of the packers 717 to prevent fluidic communication therethrough within the annulus 729. The use of example subs 790 with injection regulators 750 in each injection zone 771 allows for the substantially even distribution of the injection fluids 1145 among the injection zones 771 in the field system 700. In other words, the injection regulators 750 enforce the even distribution of injection fluid 1145 during the energy production phase (i.e., the post-stimulation phase) of the life of the wellbore 720.

Figure 12:
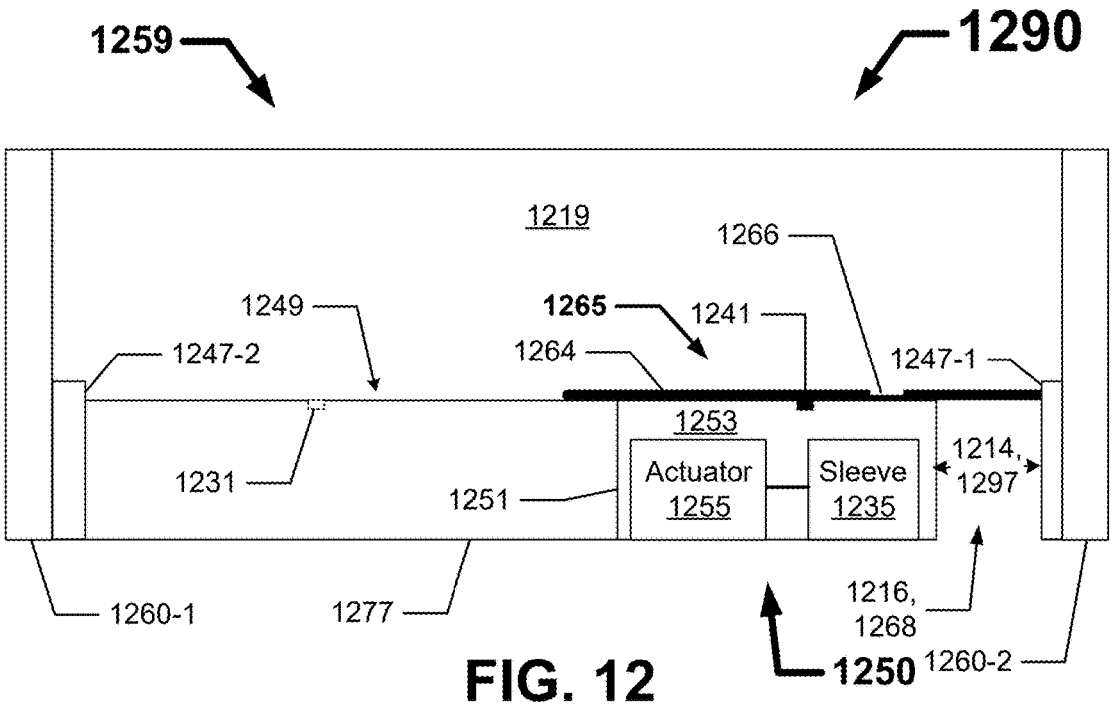
FIGS. 12 and 13 show a block diagram of a sub that includes an injection regulator and an example protective sleeve according to certain example embodiments.
Figure 13:
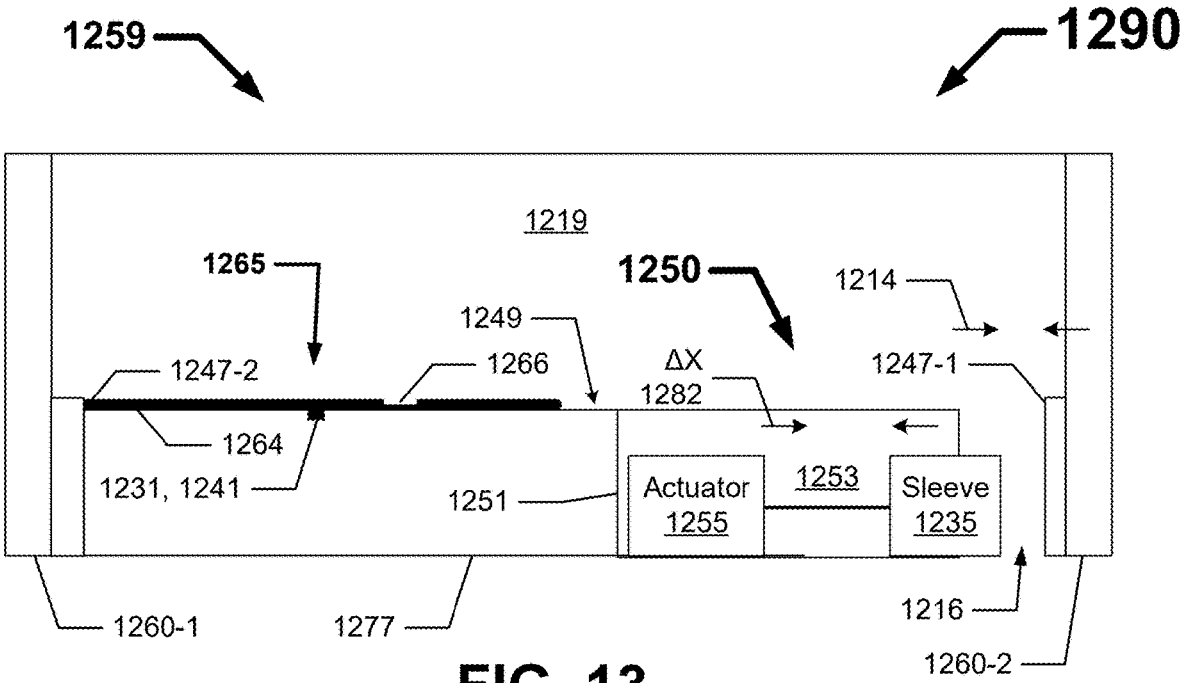

FIGS. 12 and 13 show a block diagram of a sub 1290 that includes an injection regulator 1250 and an example protective sleeve 1265 according to certain example embodiments. Specifically, FIG. 12 shows the sub 1290 with the protective sleeve 1265 in the engaged (i.e., protective) position, and FIG. 13 shows the sub 1290 with the protective sleeve 1265 in the disengaged (i.e., retracted) position. Referring to the description above with respect to FIGS. 1 through 11, the injection regulator 1250 of the sub 1290 is shown in an open position (when the protective sleeve 1265 is in the engaged position) in FIG. 12 and in a partially closed (i.e., actively controlling) position (when the protective sleeve 1265 is in a disengaged position) in FIG. 13. The sub 1290 includes a housing 1259 that includes one or more housing walls 1277, inside of which is disposed the injection regulator 1250. The injection regulator 1250 in this case includes a chamber 1251, an actuator 1255, and a sleeve 1235, where the actuator 1255 and the sleeve 1235 are located within the chamber 1251.

The protective sleeve 1265 is movably (e.g., slidably) disposed within the cavity 1219. The protective sleeve 1265 is made of a material that maintains its shape and size when exposed to extreme conditions (e.g., high pressure, high temperature, elevated amounts of fluid flow), such as the conditions that exist within the cavity 1219 during a fracture stimulation operation. In other words, the protective sleeve 1265 may be configured to withstand direct exposure to a stimulation (e.g., fracturing) operation without substantial deformation. The protective sleeve 1265 has an engaged position (as shown in FIG. 12) and a disengaged position (as shown in FIG. 13).

As defined herein, the engaged position of the protective sleeve 1265 is with respect to performing its function of isolating the injection regulator 1250 from the rest of the cavity 1219. In this way, during a stimulation (e.g., fracturing) operation or other subterranean operation within a liner (e.g., liner 211) that may cause conditions in the cavity 1219 that may damage the injection regulator 1250 at a point in time when the injection regulator 1250 is not in use, the protective sleeve 1265 is configured to isolate the injection regulator 1250 from the cavity 1219 when the protective sleeve 1265 is in the engaged position. A protective sleeve 1265 may have a single engaged position (e.g., as when the length of the protection sleeve 1265 is substantially the same as the length of the chamber 1251 of the injection regulator 1250) or multiple engaged positions (e.g., as when the length of the protection sleeve 1265 is greater than the length of the chamber 1251 of the injection regulator 1250).

As defined herein, the disengaged position of the protective sleeve 1265 is with respect to not performing its function of isolating the injection regulator 1250 from the rest of the cavity 1219. In this way, during an injection operation or other subterranean operation within a liner (e.g., liner 211) at a point in time when the injection regulator 1250 is in use, the protective sleeve 1265 is configured to expose the injection regulator 1250 to the cavity 1219 when the protective sleeve 1265 is in the disengaged position, A protective sleeve 1265 may have a single disengaged position (e.g., as when the length of the protection sleeve 1265 is substantially the same as the length of the cavity 1219 of the housing 1259 less the length of the chamber 1251 of the injection regulator 1250) or multiple disengaged positions (e.g., as when the length of the protection sleeve 1265 is less than the length of the cavity 1219 of the housing 1259 less the length of the chamber 1251 of the injection regulator 1250).

The protective sleeve 1265 includes a body 1264 that may have any characteristics (e.g., shape, size, material) suitable for moving within the housing 1259 between the engaged position and the disengaged position and suitable for protecting one or more injection regulators 1250 when in the engaged position. For example, the body 1264 of the protective sleeve 1265 may be tubular in shape and have a length that is less than half the length of the housing 1259 of the sub 1290.

The body 1264 of the protective sleeve 1265 may include one or more of a number of features. For example, as shown in FIGS. 12 and 13, the body 1264 of the protective sleeve 1265 may include an engagement feature 1266 that is configured to engage with a protective sleeve adjustment device (e.g., a wireline tool, a coiled tubing, a ball or dart pumped down the well from surface) within the cavity 1219 of the sub 1290 for moving the protective sleeve 1265 between the engaged position and the disengaged position. In such cases, the engagement feature 1266 may have any of a number of configurations. For example, in this case, the engagement feature 1266 is a recess or slot along the inner surface of the protective sleeve 1265 that may be suitable for a number of protective sleeve adjustment device configurations (e.g., wireline tools, coiled tubing). The engagement feature 1266 in the form of a slot in this example traverses some, but not all, of the thickness of the body 1264 and is located slightly toward the distal end of the body 1264. In another example, the engagement feature 1266 may be a protrusion that extends into the cavity 1219 along the inner surface of the protective sleeve 1265 that may be suitable for a number of other protective sleeve adjustment device configurations (e.g., a ball or dart pumped down the well from surface).

In some cases, the protective sleeve 1265 may have more than one engagement feature 1266. In such cases, the configuration (e.g., shape, size, relative location) of one engagement feature 1266 may be the same as, or different than, the configuration of one or more of the other engagement features 1266. Also, in some cases, a sub 1290 may have more than one protective sleeve 1265. In such a case, the configuration (e.g., material, shape, size, number of engagement features 1266, type of configuration features 1266) of one protective sleeve 1265 may be the same as, or different than, the configuration of one or more of the other protective sleeves 1265. Also, in some cases, the protective sleeve 1265 may be configured to isolate more than one injection regulator 1250 of the sub 1290 from the cavity 1219 when the protective sleeve 1265 is in the engaged position.

In some cases, the body 1264 of the protective sleeve 1265 may include one or more optional retention features 1241. Each retention feature 1241 is configured to engage with (i.e., couple to) a complementary coupling feature 1231 (discussed below) of the housing 1259 of the sub 1290. When the retention feature 1241 of the protective sleeve 1265 engages the coupling feature 1231 of the housing 1259, the position of the protective sleeve 1265 within the cavity 1219 is maintained. In this case, when the retention feature 1241 of the protective sleeve 1265 engages the coupling feature 1231 of the housing 1259, the protective sleeve 1265 is maintained in a disengaged position, allowing the injection regulator 1250 to be exposed to the cavity 1219.

A retention feature 1241 of the protective sleeve 1265 may have any of a number of configurations (e.g., shape, size, location). For example, in this case, the retention feature 1241 is a protrusion or detent that extends from the bottom surface of the body 1264 and is located approximately halfway along the length of the body 1264. When the protective sleeve 1265 includes multiple retention features 1241, the configuration of one retention feature 1241 may be the same as, or different than, the configuration of one or more of the other retention features 1241.

The housing 1259 includes one or more walls 1277 that form a cavity 1219 that is open at both ends. At least one of the walls 1277 of the housing 1259 within the cavity 1219 includes a protective sleeve receiving area 1249 within which the protective sleeve 1265 is movably disposed. The protective sleeve receiving area 1249 of the housing 1259 is configured to provide a space within which the protective sleeve 1265 may move. The protective sleeve receiving area 1249 may have any of a number of characteristics (e.g., length, width, depth, retention features 1231). In this case, the protective sleeve receiving area 1249 is a recess within an interior wall 1277 of the housing 1259 that allows the protective sleeve 1265 to slide along most of the length of the housing 1259 of the sub 1290.

To limit the range of motion of the protective sleeve 1265, the protective sleeve receiving area 1249 may include one or more stops 1247. For example, in this case, the protective sleeve receiving area 1249 includes a stop 1247-2 (e.g., a proximal stop 1247-2) located toward the proximal end of the protective sleeve receiving area 1249 and another stop 1247-1 (e.g., a distal stop 1247-1) located toward the distal end of the protective sleeve receiving area 1249 to limit the range of motion of the protective sleeve 1265. In some cases, as in this example, a stop 1247 may be part of a wall 1277 of the housing 1259 that creates a boundary for the protective sleeve receiving area 1249. In other cases, a stop 1247 may be a protrusion or other feature within the protective sleeve receiving area 1249. When the protective sleeve receiving area 1249 has multiple stops 1247, the configuration of one stop 1247 may be the same as, or different than, the configuration of one or more of the other stops 1247.

As discussed above, in some cases, the protective sleeve receiving area 1249 may include one or more retention features 1231. In such cases, each retention feature 1231 is configured to engage a retention feature 1241 of the protective sleeve 1265 so that the protective sleeve 1265 is maintained in a particular position (e.g., a disengaged position, an engaged position) within the cavity 1219. When the retention feature 1231 of the protective sleeve receiving area 1249 and the retention feature 1241 of the protective sleeve 1265 are engaged, the position of the protective sleeve 1265 is maintained within the cavity 1219 until a force (e.g., as applied by a wireline tool, a coiled tubing, or a ball or dart pumped down the well from surface to the engagement feature 1266 of the protective sleeve 1265) of sufficient strength to break the engagement of the retention feature 1231 and the retention features 1241 is applied to the body 1264 of the protective sleeve 1265 along the length of the protective sleeve receiving area 1249.

A retention feature 1231 of the protective sleeve receiving area 1249 may have any of a number of configurations (e.g., shape, size, location). For example, in this case, the retention feature 1231 is a recess (e.g., a channel) that extends into the wall 1277 that defines the length of the protective sleeve receiving area 1249. The retention feature 1231 is located along the length of the protective sleeve receiving area 1249 in such a way that, when the retention feature 1231 and the retention features 1241 are engaged with each other, the proximal end of the body 1264 of the protection sleeve 1265 abuts against the stop 1247-2 of the protective sleeve receiving area 1249. When the protective sleeve 1265 includes multiple retention features 1241, the configuration of one retention feature 1241 may be the same as, or different than, the configuration of one or more of the other retention features 1241.

One or more of the walls 1277 of the housing 1259 also has one or more flow orifices 1268 that traverse therethrough. Each flow orifice 1268 has a footprint 1297 (e.g., a width, a cross-sectional shape, a length) that is sufficient to allow for the flow of a fluid (e.g., injection fluid 1145) therethrough. Each flow orifice 1268 may also have other characteristics (e.g., length, meshing) that is sufficient to allow for the flow of a fluid (e.g., injection fluid 645) therethrough. The housing 1259 may have any shape (e.g., cylindrical) and size (e.g., inner diameter, outer diameter) to allow the sub 1290 (and so also the injection regulator 1250) to be substantially seamlessly incorporated into a tubing string or liner (e.g., liner 711) used in a field operation within a wellbore (e.g., wellbore 220).

In addition, the housing 1259 may include one or more coupling features 1260 to allow the housing 1259 to be coupled to another component (e.g., a joint of pipe, a sub) of a liner. In this case, the housing 1259 includes two coupling features 1260, where one coupling feature 1260-1 is located at one end of the housing 1259, and the other coupling feature 1260-2 is located at the opposite end of the housing 1259. The housing 1259 may be made of one or more of any of a number of materials (e.g., steel) that are designed to withstand the conditions (e.g., temperature, pressure, flow rate) that exist in a wellbore during a field operation.

The chamber 1251 of the injection regulator 1250 includes one or more walls that form a cavity 1253. In certain example embodiments, the cavity 1253 of the chamber 1251 is smaller than the cavity 1219 of the housing 1259. In certain example embodiments, the cavity 1253 of the chamber 1251 is a subset of the cavity 1219 of the housing 1259. One or more of the walls of the chamber 1251 may also serve as one or more of the walls 1277 of the housing 1259 of the sub 1290. The chamber 1251 may be configured to have disposed in the cavity 1253 the actuator 1255 and the sleeve 1235. In certain example embodiments, the sleeve 1235 (sometimes called a valve sleeve 1235 herein) is configured to move within the chamber 1251 when the actuator 1255 operates.

In some cases, the chamber 1251 has at least one opening therein. For example, the chamber 1251 may have an open distal end through which part of the sleeve 1235 may move. In such cases, the chamber 1251 does not extend into or beyond the flow orifice 1268 in the wall 1277 of the housing 1259. As another example, the chamber 1251 may have a flow orifice that traverses the thickness of one or more of the walls (e.g., the outer wall, the inner wall) of the chamber 1251. In such cases, the flow orifice in the wall of the chamber 1251 may be coincident (e.g., vertically aligned) with the flow orifice 1268 in the wall 1277 of the housing 1259 of the sub 1290.

In certain example embodiments, the chamber 1251 of the injection regulator 1250 is configured to include one or more features that allow for the sleeve 1235 to move therein consistently, reliably, and with a minimal amount of resistance. For example, the inner surface of one or more walls of the chamber 1251 and/or an inner surface of a wall 1277 of the housing 1259 that helps form the cavity 1253 of the chamber 1251 may include one or more protrusions that act as tracks along which the sleeve 1235 may slide in both directions.

The actuator 1255 of the injection regulator 1250 is configured to move the sleeve 1235 within the chamber 1251 based on conditions within the cavity 1219 of the sub 1290 and/or outside the sub 1290. For example, the actuator 1255 may operate based on a differential in pressure within the cavity 1219 of the sub 1290 and outside the sub 1290 exceeding a minimum threshold value. The actuator 1255 may include one or more of a number of components. For example, as discussed below with respect to FIGS. 14 through 17, the actuator 1255 may include a spring or other form of resilient device. In certain example embodiments, the actuator 1255 operates without any external controller and/or without any electrical components.

The actuator 1255 may be configured, when operated, to actively and/or passively move the sleeve 1235 forward and/or backward within the chamber 1251. In some cases, the distal end of the sleeve 1235 may extend beyond the distal end of the housing 1259. In certain example embodiments, the actuator 1255 may have a direct or indirect limit as to how far forward and/or backward within the chamber 1251 the sleeve 1235 may be moved when the actuator 1255 is actuated. In some cases, the actuator 1255 may directly or indirectly be limited in moving the sleeve 1235 forward within the chamber 1251 so that the flow orifice 1268 in the wall 1277 of the housing 1259 (and any flow orifice of the chamber 1251) is only partially, and not completely, obstructed. In certain example embodiments, the actuator 1255 is self-regulating, operating based on real-time conditions within a wellbore.

The sleeve 1235 of the injection regulator 1250 is configured to move within the chamber 1251 to partially obstruct the flow orifice 1268 in the wall 1277 of the housing 1259 (and/or any flow orifice of the chamber 1251) when certain conditions are met in real time within the wellbore. When the sleeve 1235 does not obstruct the flow orifice 1268 in the wall 1277 of the housing 1259 (and any flow orifice of the chamber 1251), the sleeve 1235 is in an open position. When the sleeve 1235 is in the open position, the footprint 1297 of the flow orifice 1268 in the wall 1277 of the housing 1259 (and any flow orifice of the chamber 1251) may be substantially the same as the effective footprint 1214 of the collective flow orifice 1216.

When the sleeve 1235 partially obstructs the flow orifice 1268 in the wall 1277 of the housing 1259 (and any flow orifice of the chamber 1251), the sleeve 1235 is in a closed position. In certain example embodiments, the sleeve 1235 may have one open position and a number of closed positions, where each closed position may be based on the extent to which the flow orifice 1268 in the wall 1277 of the housing 1259 (and any flow orifice of the chamber 1251) is obstructed by the sleeve 1235. The multiple closed positions of the sleeve 1235 may be discrete or continuous within the range of motion Δx 1282 of the sleeve 1235.

When the sleeve 1235 is in a closed position, the sleeve 1235 decreases the effective footprint 1214 of the collective flow orifice 1216, where the effective footprint 1214 is less than the footprint 1297 of the flow orifice 1268 in the wall 1277 of the housing 1259 (and any flow orifice of the chamber 1251). When the sleeve 1235 is in the maximally closed position, the sleeve 1235 may not further obstruct or cover the flow orifice 1268 in the wall 1277 of the housing 1259 (and any flow orifice of the chamber 1251), and so the effective footprint 1214 of the collective flow orifice 1216 at that point is the smallest possible size allowed under the configuration of the injection regulator 1250. As discussed above, in certain example embodiments, the injection regulator 1250 may be configured so that the flow orifice 1268 in the wall 1277 of the housing 1259 (and any flow orifice of the chamber 1251) is never completely obstructed or covered by the sleeve 1235, and so the effective footprint 1214 of the collective flow orifice 1216 is always greater than zero in such cases.

The configuration of the injection regulator 1250 may dictate the configuration of the sleeve 1235. For example, as discussed above, the distal end of the sleeve 1235 may be configured as a solid piece. In such case, the distal end of the sleeve 1235 may be configured to avoid obstructing or covering the flow orifice 1268 in the wall 1277 of the housing 1259 (and any flow orifice of the chamber 1251) when the sleeve 1235 is in the open position. By contrast, the distal end of the sleeve 1235 is configured to partially obstruct or cover the flow orifice 1268 in the wall 1277 of the housing 1259 (and any flow orifice of the chamber 1251) when the sleeve 1235 is in a closed position.

As another example, the sleeve 1235 may have a flow orifice that traverses the thickness of the sleeve 1235 toward its distal end. In such a case, the footprint of the flow orifice of the sleeve 1235 may fully or partially align with the footprint 1297 of the flow orifice 1268 in the wall 1277 of the housing 1259 (and the footprint of any flow orifice of the chamber 1251) when the sleeve 1235 is in the open position. By contrast, the footprint of the flow orifice of the sleeve 1235 may partially obstruct or cover the footprint 1297 of the flow orifice 1268 in the wall 1277 of the housing 1259 (and the footprint of any flow orifice of the chamber 1251) when the sleeve 1235 is in a closed position.

In certain example embodiments, each injection regulator 1250 (including components thereof, such as the actuator 1255 and the sleeve 1235) is configured to function during a field operation in a wellbore. For example, as a fluid is being pumped at a high pressure and flow rate through the cavity of the liner, the actuator 1255 may operate to move the sleeve 1235 between the open position and any of a number of closed positions in real time based on running conditions (e.g., pressure, temperature) in the wellbore.

Figure 14:
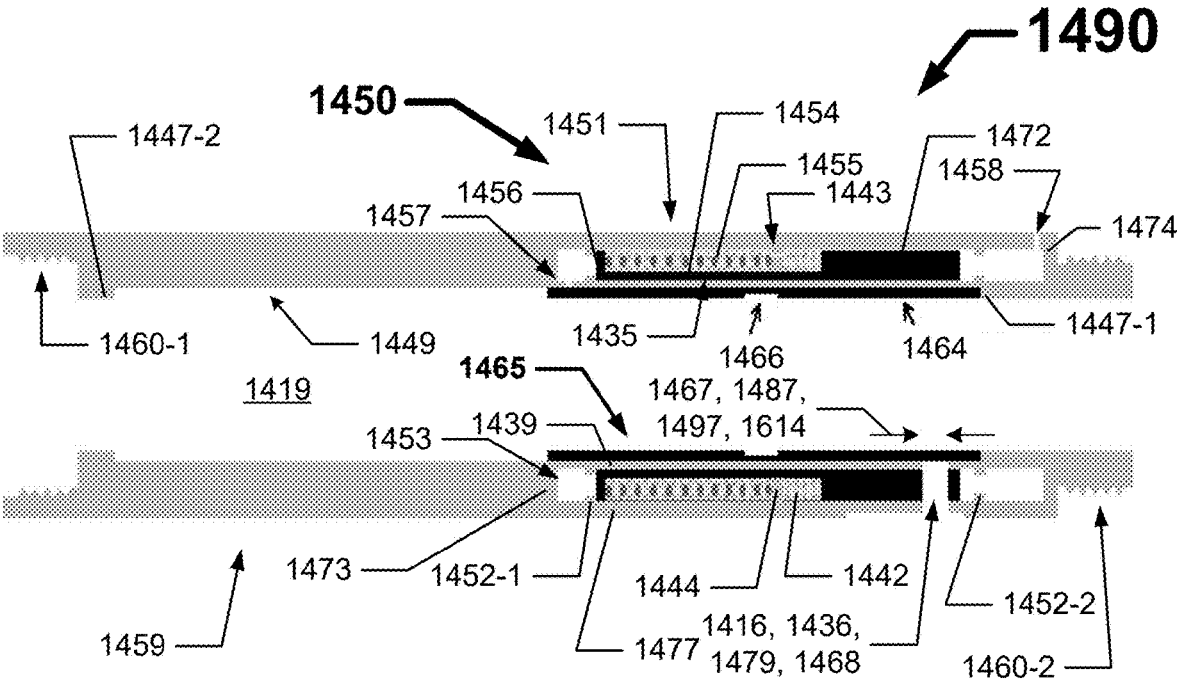
FIG. 14 shows a sectional side view of a sub that includes an injection regulator and an example protective sleeve according to certain example embodiments.
Figure 15:
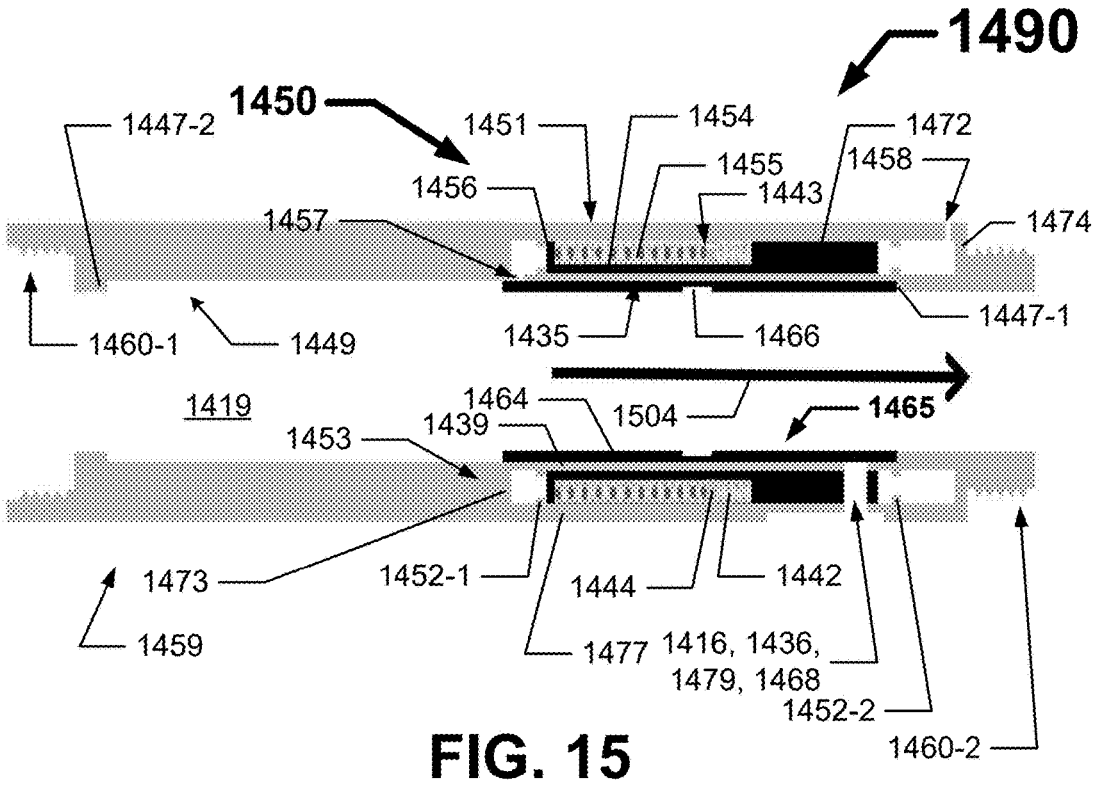
FIGS. 15 through 17 show a stimulation and injection sequence using the sub of FIG. 14 according to certain example embodiments.
Figure 16:
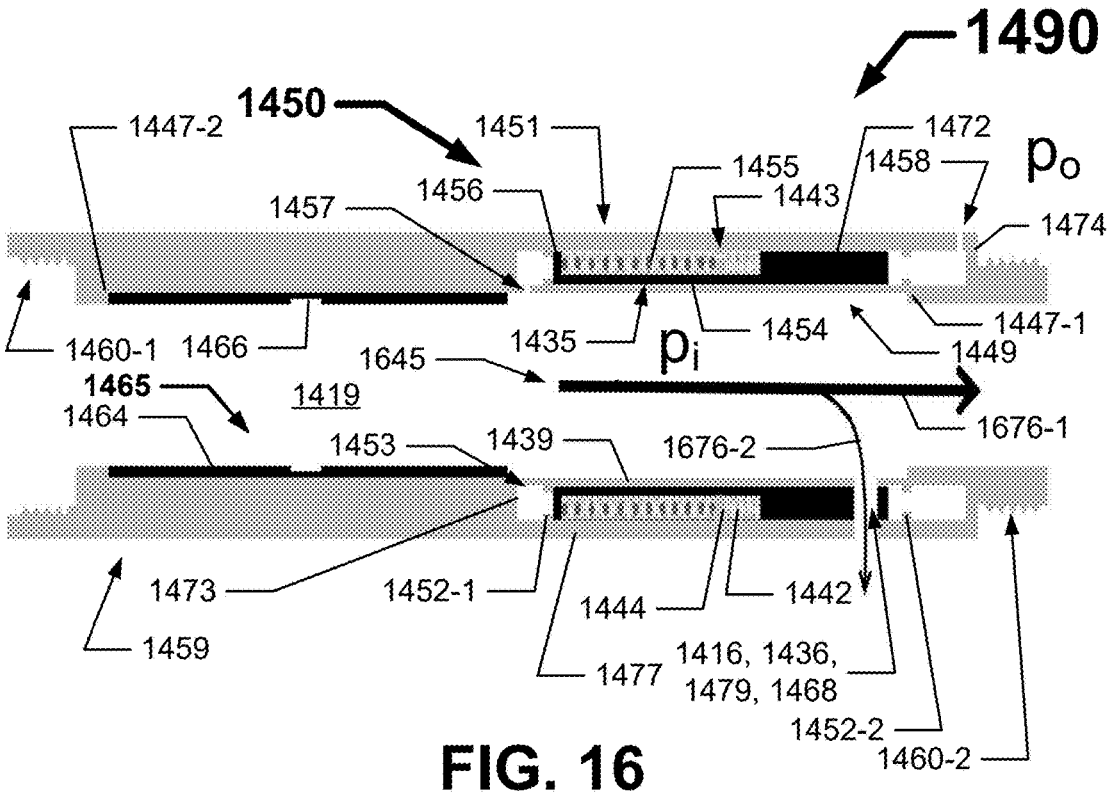
Figure 17:
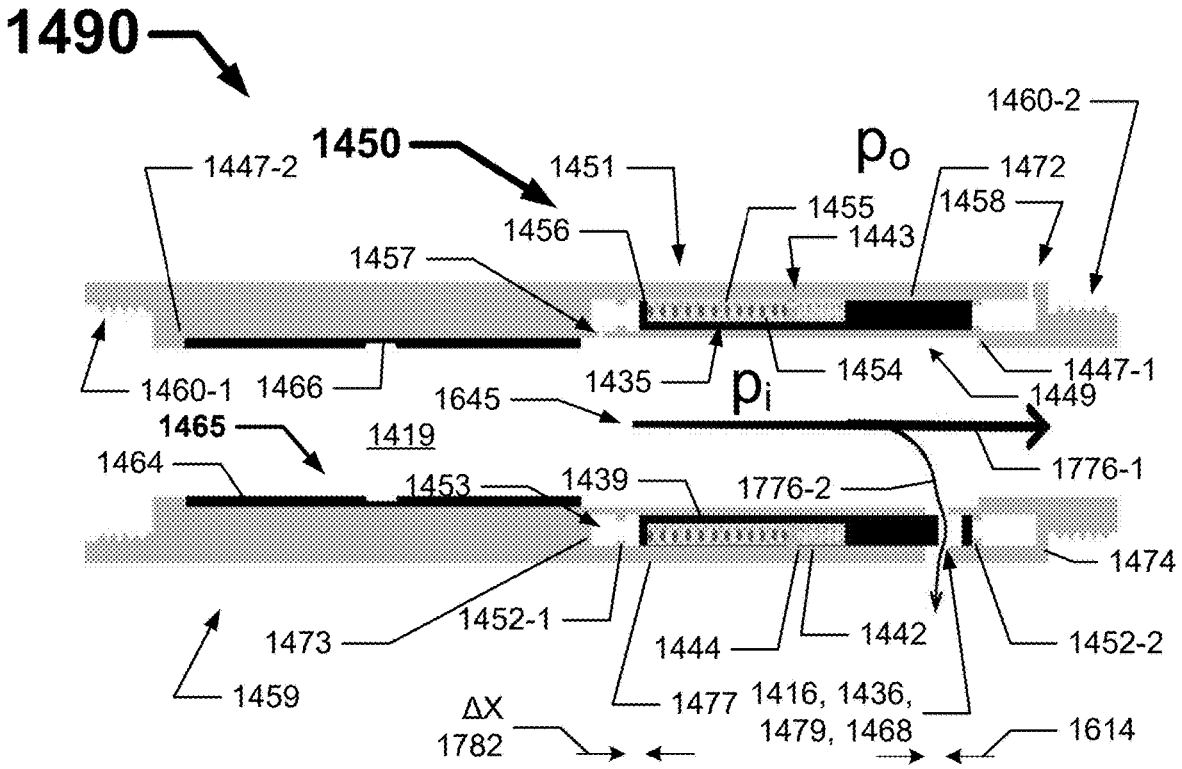

FIG. 14 shows a sectional side view of a sub 1490 that includes an injection regulator 1450 and an example protective sleeve 1465 according to certain example embodiments. FIGS. 15 through 17 show a stimulation and injection sequence using the sub 1490 of FIG. 14 according to certain example embodiments. Specifically, FIG. 15 shows the sub 1490 during a stimulation operation. FIG. 16 shows the sub 1490 at a subsequent point in time relative to the time in FIG. 15 when an injection operation is beginning with the injection regulator 1450 in an open position. FIG. 17 shows the sub 1490 at a subsequent point in time relative to the time in FIG. 16 during the injection operation with the injection regulator 1450 in a closed position. The functionality of the injection regulator 1450 and the protective sleeve 1465 is not impacted by the flow direction of the stimulation fluid 1504 and/or the flow direction of the injection fluid 1645 through the cavity 1419 of the sub 1490.

Referring to the description above with respect to FIGS. 1 through 13, the example sub 1490 of FIG. 14 includes a housing 1459, an example protective sleeve 1465, and an injection regulator 1450. The injection regulator 1450 in this case is in the form of a ASRICV that includes a chamber 1451, an actuator 1455, and a sleeve 1435 (sometimes called a valve sleeve 1435 herein), where the actuator 1455 and the sleeve 1435 are located within the chamber 1451.

The protective sleeve 1465 of the sub 1490 is substantially the same as the protective sleeve 1265 discussed above. For example, the protective sleeve 1465 of FIGS. 14 through 17 is movably (e.g., slidably) disposed within the cavity 1419 formed by the housing 1459 of the sub 1490. The protective sleeve 1465 is made of a material that maintains its shape and size when exposed to extreme conditions (e.g., high pressure, high temperature, elevated amounts of fluid flow), such as the conditions that exist within the cavity 1419 during stimulation operations (e.g., fracturing operations), as shown in FIG. 15. The protective sleeve 1465 has an engaged position (as shown in FIGS. 14 and 15) and a disengaged position (as shown in FIGS. 16 and 17).

The protective sleeve 1465 includes a body 1464 that may include one or more of a number of features. For example, as shown in FIGS. 14 through 17, the body 1464 of the protective sleeve 1465 includes an engagement feature 1466 that is configured to engage with a protective sleeve adjustment device (e.g., a wireline tool, a coiled tubing, a ball or dart pumped down the well from surface) within the cavity 1419 of the sub 1490 for moving the protective sleeve 1465 between the engaged position and the disengaged position. In this case, the engagement feature 1466 is a recess or slot along the inner surface of the protective sleeve 1465 that traverses some, but not all, of the thickness of the body 1464 and is located approximately midway along the length of the body 1464. In this example, the protective sleeve 1465 does not include a retention feature (e.g., similar to retention feature 1241).

The housing 1459 includes an outer wall 1477 that forms a cavity 1419 that is open at both ends. At least one of the walls 1477 of the housing 1459 within the cavity 1419 includes a protective sleeve receiving area 1449 within which the protective sleeve 1465 is movably disposed. The protective sleeve receiving area 1449 of the housing 1459 is configured to provide a space within which the protective sleeve 1465 may move. The protective sleeve receiving area 1449 in this case is a recess within the wall 1477 of the housing 1459 that allows the protective sleeve 1465 to slide along most of the length of the housing 1459 of the sub 1490.

To limit the range of motion of the protective sleeve 1465, the protective sleeve receiving area 1449 in this case includes a stop 1447-2 (e.g., a proximal stop 1447-2) located toward the proximal end of the protective sleeve receiving area 1449 and another stop 1447-1 (e.g., a distal stop 1447-1) located toward the distal end of the protective sleeve receiving area 1449 to limit the range of motion of the protective sleeve 1465. In this example, each stop 1447 is part of the wall 1477 of the housing 1459 that creates a boundary for the protective sleeve receiving area 1449. In this case, the protective sleeve receiving area 1449 does not include any retention features (e.g., similar to the retention feature 1231 discussed above).

While the protective sleeve 1465 is in the engaged position, as shown in FIG. 15, isolating the injection regulator 1450 from the cavity 1419, a fracture stimulation fluid 1504 may pass through the cavity 1419 of the sub 1490 without interacting with the injection regulator 1450. When the stimulation operation (e.g., fracturing operation) is complete, the protective sleeve 1465 may be moved (e.g., by a wireline tool, by a coiled tubing, by a ball or dart pumped down the well from surface) within the protective sleeve receiving area 1449 from the engaged position to the disengaged position, as shown in FIGS. 16 and 17, during an injection operation so that some of the injection fluid 1645 may be diverted from the cavity 1419 to a subterranean formation (e.g., subterranean formation 210) by the injection regulator 1450.

The wall 1477 of the housing 1459 also has a flow orifice 1468 that traverses therethrough at the bottom of the housing 1459. The flow orifice 1468 has a footprint 1497 (e.g., a width, a cross-sectional shape, a length) that is sufficient to allow for the flow of a fluid (an injection fluid 1645 as shown in FIGS. 16 and 17) therethrough. The housing 1459 in this case is cylindrical in shape and has a size (e.g., inner diameter, outer diameter) to allow the sub 1490 (and so also the injection regulator 1450 and the example protection sleeve 1465) to be substantially seamlessly incorporated into a tubing string or liner (e.g., liner 211) used in a field operation within a wellbore (e.g., wellbore 220).

In addition, the housing 1459 of the sub 1490 in this example includes one coupling feature 1460-1 in the form of mating threads located at one end (e.g., the left or upstream end) of the housing 1459, as well as another coupling feature 1460-2 in the form of mating threads located at the opposite end of the housing 1459. These coupling features 1460 allow the sub 1490 to be coupled to two other components of a tubing string or liner. The housing 1459 may be made of one or more of any of a number of materials (e.g., steel) that are designed to withstand the conditions (e.g., temperature, pressure, flow rate) that exist in a wellbore during one or more field operations (e.g., fracturing, fluid injection).

The chamber 1451 of the injection regulator 1450 includes an inner wall 1439, a proximal wall 1473, and a distal wall 1474 that form a cavity 1453. The wall 1477 of the housing 1459 also serves as the outer wall of the chamber 1451. In this case, the cavity 1453 of the chamber 1451 is smaller than the cavity 1419 of the housing 1459. Also, in this case, aside from the internal pressure port 1457 (discussed below), the cavity 1453 of the chamber 1451 is isolated from the cavity 1419 of the housing 1459, independent of the position of the protection sleeve 1465. The actuator 1455 and the sleeve 1435 are disposed in the cavity 1453 of the chamber 1451 in this case. The sleeve 1435 is configured to move within part of the cavity 1453 of the chamber 1451 when the actuator 1455 operates.

The inner wall 1439 of the chamber 1451 has a flow orifice 1479 that traverses the thickness of the wall 1439. The flow orifice 1479 in the inner wall 1439 of the chamber 1451 in this example is coincident (e.g., vertically aligned) with the flow orifice 1468 in the wall 1477 of the housing 1459 of the sub 1490. The flow orifice 1479 has a footprint 1487 (e.g., a width, a cross-sectional shape, a length) that is substantially the same as the footprint 1497 of the flow orifice 1468 in the wall 1477 of the housing 1459. In alternative embodiments, the footprint 1487 of the flow orifice 1479 may differ from one or more characteristics of the footprint 1497 of the flow orifice 1468.

When the protective sleeve 1465 is in the disengaged position, as in FIGS. 16 and 17, the actuator 1455 of the injection regulator 1450 is configured to move the sleeve 1435 within the chamber 1451 based on a differential in pressure between the cavity 1419 ($p_i$) of the sub 1490 and outside ($p_o$) the sub 1490. The actuator 1455 in this case includes a single component in the form of a resilient device (e.g., a spring). The actuator 1455 operates without any external controller and/or without any electrical components. Specifically, in this case, the actuator 1455 is positioned within a part of the cavity 1453 of the chamber 1451 in a space 1442 defined by the outer wall 1477 of the housing 1459, the proximal end of the distal wall 1472 of the sleeve 1435, part of an inner wall 1454 of the sleeve 1435, and a proximal wall 1456 of the sleeve 1435. The spring of the actuator 1455 is located within the space 1442 against an internal side wall 1444 that extends laterally inward from the outer wall 1477 of the housing 1459 and is positioned upstream from the proximal end of the distal wall 1472 of the sleeve 1435.

The space 1442 in which the actuator 1455 is positioned may be filled with air, any other fluid, and/or any other material to ensure reliable operation of the actuator 1455 over time. The side wall 1444 in this case includes one or more motion dampening orifices 1443 that traverse therethrough. Each motion dampening orifice 1443 may be configured (e.g., have a width, have a cross-sectional shape) in such a way as to ensure reliable operation of the actuator 1455 over time. If there are multiple motion dampening orifices 1443, the configuration of one motion dampening orifice 1443 may be the same as, or different than, the configuration of one or more of the other motion dampening orifices 1443. The size of the space 1442 does not vary in this example as the sleeve 1435 moves within the chamber 1451. The changing position of sleeve 1435 forces the injection fluid 1645 contained in the space 1442 to move through a motion dampening orifice 1443. Regardless of the position of the sleeve 1435 within the chamber 1451, the volume of the space 1442 that contains the motion dampening fluid remains constant.

The actuator 1455 in this example is configured, when operated, to move the sleeve 1435 forward and/or backward within the chamber 1451. In this case, the distal wall 1472 of the sleeve 1435 has a flow orifice 1436 that traverses the thickness of the distal wall 1472. When the sleeve 1435 is in the open position, the flow orifice 1436 of the sleeve 1435 is coincident (e.g., vertically aligned) with the flow orifice 1468 in the wall 1477 of the housing 1459 of the sub 1490 and with the flow orifice 1479 that traverses the thickness of the wall 1439 of the chamber 1451. The flow orifice 1436 of the sleeve 1435 has a footprint 1467 (e.g., a width, a cross-sectional shape, a length) that is substantially the same as the footprint 1497 of the flow orifice 1468 in the wall 1477 of the housing 1459 and as the footprint 1487 of the flow orifice 1479 of the inner wall 1439 of the chamber 1451. In alternative embodiments, the footprint 1467 of the flow orifice 1436 may differ from one or more characteristics of the footprint 1497 of the flow orifice 1468 and/or of the footprint 1487 of the flow orifice 1479.

If the sleeve 1435 is freely rotatable within the chamber 1451, the flow orifice 1436 may extend around some or all of the sleeve 1435. For example, in such case, the flow orifice 1436 may include a series of rectangular openings (when viewed from above) where adjacent openings have a thin portion of the distal wall 1472 of the sleeve 1435 positioned therebetween. In alternative embodiments, the sleeve 1435 and/or one or more portions (e.g., the inner wall 1439, the proximal wall 1473) of the chamber 1451 may include one or more of a number of features (e.g., protrusions, recesses, detents, slots, tabs) that prevent the sleeve 1435 from rotating within the chamber 1451. In this way, the distal wall 1472 of the sleeve 1435 may have a flow orifice 1436 in the form of a single opening that traverses the thickness of the distal wall 1472.

In any case, the characteristics (e.g., cross-sectional shape, length, width) of the footprint 1467 of the flow orifice 1436 of the sleeve 1435 may be substantially similar to the corresponding characteristics of the footprint 1487 of the flow orifice 1479 of the inner wall 1439 of the chamber 1451 and/or the corresponding characteristics of the footprint 1497 of the flow orifice 1468 in the wall 1477 of the housing 1459. In this way, when the sleeve 1435 is in the fully open position, the characteristics of the effective footprint 1614 of the collective flow orifice 1416 is substantially the same as the corresponding characteristics of the footprint 1467 of the flow orifice 1436, the footprint 1487 of the flow orifice 1479, and the footprint 1497 of the flow orifice 1468.

The overlap of the flow orifice 1479 of the inner wall 1439 of the chamber 1451, the flow orifice 1436 of the sleeve 1435, and the flow orifice 1468 in the wall 1477 of the housing 1459 results in a collective orifice 1416 having an effective footprint 1614. As a result, when the sleeve 1435 is in the open position, the effective footprint 1614 of the collective orifice 1416 is substantially the same as the footprint 1467 of the flow orifice 1436 of the sleeve 1435, the footprint 1497 of the flow orifice 1468 in the wall 1477 of the housing 1459, and the footprint 1487 of the flow orifice 1479 of the inner wall 1439 of the chamber 1451. As shown in FIG. 16, in such cases when the sleeve 1435 is in the open position, a maximum portion 1676-2 of an injection fluid 1645 flowing through the cavity 1419 of the housing 1459 is diverted through the collective orifice 1416 to a subterranean formation (e.g., subterranean formation 210) while a remaining portion 1676-1 of the injection fluid 1645 continues to flow out the opposite end of the housing 1459.

As the actuator 1455 operates to move the sleeve 1435 to a closed position from the open position, as shown in FIG. 17, the flow orifice 1436 of the sleeve 1435 is no longer coincident (e.g., is no longer vertically aligned) with the flow orifice 1468 in the wall 1477 of the housing 1459 of the sub 1490 and with the flow orifice 1479 that traverses the thickness of the wall 1439 of the chamber 1451. As a result, the effective footprint 1614 of the collective orifice 1416 is reduced, which results in a lesser portion 1776-2 (where the amount of the portion 1776-2 is less than the portion 1676-2 of FIG. 16) of the injection fluid 1645 flowing through the cavity 1419 of the housing 1459 is diverted through the collective orifice 1416 to the subterranean formation (e.g., subterranean formation 210) while a remaining portion 1776-1 (where the amount of the portion 1776-1 is greater than the amount of the portion 1676-1) of the injection fluid 1645 continues to flow out the opposite end of the housing 1459.

As discussed above, the actuator 1455 operates when the difference between the internal pressure ($p_i$) (in this case, the pressure within the cavity 1419) and the external pressure ($p_o$) [i.e., $\Delta p$] exceeds a minimum threshold value. When the actuator 1455 operates, the sleeve 1435 moves to control the effective footprint 1614 of the collective flow orifice 1416 and, ultimately, the flowrate at which a portion (e.g., 1676-2, 1776-2) of the injection fluid 1645 exits the sub 1490. In this example, the resultant forces from $\Delta p$ act axially on the sleeve 1435. The various characteristics of the actuator 1455 (specifically, the spring) in this case may be selected by a user so that the actuator 1455 operates in the manner desired. For example, the preload force imposed by the spring may be used to control the point at which $\Delta p$ is sufficiently large to operate the actuator 1455 and move the sleeve 1435. The compression stiffness of the spring may be used to control the rate at which the sleeve 1435 moves with changes in $\Delta p$.

The injection regulator 1450 in this case is configured to operate autonomously based on the $\Delta p$ that the sleeve 1435 and, in turn, the actuator 1455 of the injection regulator 1450 experiences locally. As a result, by moving the sleeve 1435 in a controlled fashion, the actuator 1455 (and so the injection regulator 1450 in general) self-regulates flow of the injection fluid 1645 in response to changes in $\Delta p$. FIGS. 16 and 17 illustrate the sleeve 1435 in its fully-open ($\Delta x$ 1782=0) and maximally-closed ($\Delta x$ 1782=max) positions, respectively, where $\Delta x$ 1782 represents the position of the sleeve 1435 relative to the fully open position. In order for the actuator 1455 to experience the pressure differential, the injection regulator 1450 may include one or more of a number of features. For example, in this case, the injection regulator 1450 includes an internal pressure port 1457 (corresponding to $p_i$) and an external pressure port 1458 (corresponding to $p_o$). In alternative embodiments, the injection regulator 1450 may include multiple internal pressure ports 1457 and/or multiple external pressure ports 1458.

The internal pressure port 1457 is located in this example in the inner wall 1439 of the chamber 1451 adjacent to the proximal wall 1473 of the chamber 1451 and upstream of the proximal wall 1456 of the sleeve 1435. The internal pressure port 1457 may have any of a number of configurations. In this case, the internal pressure port 1457 is a relatively small circular hole that traverses the thickness of the inner wall 1439 of the chamber 1451. The external pressure port 1458 is located in this example in the outer wall 1477 of the housing 1459 adjacent to the distal wall 1474 of the chamber 1451 and downstream of the distal wall 1472 of the sleeve 1435. The external pressure port 1458 may have any of a number of configurations. In this case, the external pressure port 1458 is a relatively small circular hole that traverses the thickness of the outer wall 1477 of the housing 1459.

When the pressure ($p_i$) at the internal pressure port 1457 exceeds the pressure ($p_o$) at the external pressure port 1458, the differential pressure ($\Delta p = p_i - p_o$) acting against opposite ends (i.e., the proximal wall 1456 and the distal wall 1472)

of the sleeve 1435 applies a net force directed downstream. Initially, when the differential between the pressure ($p_i$) and the pressure ($p_o$) is relatively low, the upstream force of the spring of the actuator 1455 applied to the proximal wall 1456 of the sleeve 1435 exceeds the net downstream force imposed by Δp acting against opposite ends (i.e., the proximal wall 1456 and the distal wall 1472) of the sleeve 1435. As a result, the sleeve 1435 remains stationary.

When the pressure ($p_i$) at the internal pressure port 1457 exceeds the pressure ($p_o$) at the external pressure port 1458 by a certain amount (e.g., the minimum threshold pressure amount), then the net downstream force imposed by Δp acting against opposite ends (i.e., the proximal wall 1456 and the distal wall 1472) of the sleeve 1435 exceeds the upstream force of the spring of the actuator 1455 applied to the proximal wall 1456 of the sleeve 1435. As a result, the sleeve 1435 moves downstream. The amount of downstream movement of the sleeve 1435 (in other words, the extent to which the sleeve 1435 is in a closed position) depends on the extent to which the internal pressure ($p_i$) exceeds the external pressure ($p_o$).

When the differential between the internal pressure ($p_i$) and the external pressure ($p_o$) decreases, the upstream force applied by the spring of the actuator 1455 may overcome the net downstream force imposed by Δp acting against opposite ends (i.e., the proximal wall 1456 and the distal wall 1472) of the sleeve 1435, causing the sleeve 1435 to return to the open position within the chamber 1451. Since the spring of the actuator 1455 is reacting in real time to the pressure differential experienced by the sub 1490, the position of the sleeve 1435 is being adjusted in real time by the actuator 1455. When the pressure differential is sufficiently high, the position of the sleeve 1435 reduces the amount of the portion 1776-2 of the injection fluid 1645 that flows through the collective orifice 1416 out of the sub 1490 by reducing the effective footprint 1614 of the collective orifice 1416. Conversely, when the pressure differential is relatively minimal, the position of the sleeve 1435 is such that the sleeve 1435 has little to no impact on the effective footprint 1614 of the collective orifice 1416, and so the effective footprint 1614 is substantially the same as the footprint 1467 of the flow orifice 1436 of the sleeve 1435. As a result, the amount of the portion 1676-2 of the injection fluid 1645 that flows through the collective orifice 1416 out of the sub 1490 is at a maximum.

In order to limit the range of the motion of the sleeve 1435 by the actuator 1455, the injection regulator 1450 may include one or more stops 1452. In this case, the injection regulator 1450 has two stops 1452. Stop 1452-1 in this case is in the form of one or more protrusions that extend toward the cavity 1453 of the chamber 1451 from the outer wall 1477 of the housing 1459 and/or from the inner wall 1439 of the chamber 1451 around some or all of the perimeter of the chamber 1451. The stop 1452-1 in this case is positioned slightly downstream of the internal pressure port 1457 within the cavity 1453 of the chamber 1451.

The distance between the protrusions of the stop 1452-1 may be less than the thickness of the proximal wall 1456 of the sleeve 1435. In this way, the stop 1452-1 prevents the sleeve 1435 from traveling further upstream within the cavity 1453 of the chamber 1451. The position of the stop 1452-1 within the cavity 1453 of the chamber 1451 in this case means that, when the proximal wall 1456 of the sleeve 1435 abuts against the stop 1452-1, the flow orifice 1436 that traverses the thickness of the distal wall 1472 of the sleeve 1435 is substantially aligned with (coincident with) the flow orifice 1479 and the flow orifice 1468. Also, the distance between the protrusions of the stop 1452-1 may be large enough to allow the internal pressure ($p_i$) that enters the cavity 1453 of the chamber 1451 through the internal pressure port 1457 to be communicated downstream of the stop 1452-1 to the proximal wall 1456 of the sleeve 1435.

Stop 1452-2 in this case is also in the form of one or more protrusions that extend toward the cavity 1453 of the chamber 1451 from the outer wall 1477 of the housing 1459 and/or from the inner wall 1439 of the chamber 1451 around some or all of the perimeter of the chamber 1451. The stop 1452-2 in this case is positioned slightly upstream of the external pressure port 1458 within the cavity 1453 of the chamber 1451. The distance between the protrusions of the stop 1452-2 may be less than the thickness of the distal wall 1472 of the sleeve 1435. In this way, the stop 1452-2 prevents the sleeve 1435 from traveling further downstream within the cavity 1453 of the chamber 1451.

The position of the stop 1452-2 within the cavity 1453 of the chamber 1451 in this case means that, when the distal wall 1472 of the sleeve 1435 abuts against the stop 1452-2, the flow orifice 1436 that traverses the thickness of the distal wall 1472 of the sleeve 1435 does not completely overlap or cover the flow orifice 1479 and the flow orifice 1468. In this way, when the sleeve is in the maximally closed position, the effective footprint 1614 of the collective orifice 1416 is greater than zero. Also, the distance between the protrusions of the stop 1452-2 may be large enough to allow the external pressure ($p_o$) that enters the distal end of the cavity 1453 of the chamber 1451 through the external pressure port 1458 to be communicated upstream of the stop 1452-2 to the distal wall 1472 of the sleeve 1435.

The configuration of a stop 1452 may differ from what is shown and described herein to achieve the purpose of the stop 1452 in limiting the range of travel of the sleeve 1435. For example, a stop 1452 may be or include a single protrusion rather than a pair of protrusions. As another example, a stop 1452 may be or include one or more protrusions that extend inward (downstream) from the proximal wall 1473 of the chamber. When the injection regulator 1450 of the sub 1490 has multiple stops 1452, as in this case, the configuration of one stop 1452 may be the same as, or different than, the configuration of one or more of the other stops 1452.

As discussed above, the distal wall 1472 of the sleeve 1435 of the injection regulator 1450 is configured to move within the chamber 1451 to partially obstruct the flow orifice 1468 of the housing 1459 and the flow orifice 1479 in the inner wall 1439 of the chamber 1451 when a minimum pressure differential occurs relative to the sub 1490. When the sleeve 1435 does not substantially obstruct the flow orifice 1468 of the housing 1459 and the flow orifice 1479 in the inner wall 1439 of the chamber 1451, the sleeve 1435 is in the open position. When the sleeve 1435 is in the open position, the effective footprint 1614 of the collective flow orifice 1416 is substantially the same as the corresponding characteristics of the footprint 1467 of the flow orifice 1436, the footprint 1487 of the flow orifice 1479, and the footprint 1497 of the flow orifice 1468.

When the sleeve 1435 partially obstructs the flow orifice 1468 of the housing 1459 and the flow orifice 1479 of the inner wall 1439 of the chamber 1451, the sleeve 1435 is in a closed position. In certain example embodiments, the sleeve 1435 may have a number of closed positions, where each closed position is based on the extent to which the flow orifice 1468 of the housing 1459 and the flow orifice 1479 of the inner wall 1439 of the chamber 1451 is obstructed by the sleeve 1435, which in turn is based on the amount of differential pressure relative to the sub 1490.

When the sleeve 1435 is in a closed position, the sleeve 1435 decreases the effective footprint 1614 of the collective flow orifice 1416. When the sleeve 1435 is in the maximally closed position, the sleeve 1435 may not further obstruct or cover the flow orifice 1468 of the housing 1459 and the flow orifice 1479 of the inner wall 1439 of the chamber 1451, and so the effective footprint 1614 of the collective flow orifice 1416 at that point is the smallest possible footprint allowed under the configuration of the injection regulator 1450. As discussed above, in certain example embodiments, the injection regulator 1450 may be configured so that the collective flow orifice 1416 is never completely closed, regardless of the position of the sleeve 1435 within the chamber 1451, and so the effective footprint 1614 of the collective flow orifice 1416 is always greater than zero in this example. This allows for continuous pressure communication between the interior and exterior of the sub 1490.

With no flow (Q) of the portion 1676-2 of the injection fluid 1645 through the collective flow orifice 1416, $\Delta p=0$, resulting in the sleeve 1435 of the injection regulator 1450 being its full-open position. However, as Q increases, so does $\Delta p$. Depending on the configuration (e.g., the footprints) of the flow orifice 1468, the flow orifice 1479, and the flow orifice 1436, there is a value of Q that generates a sufficiently large $\Delta p$ to cause the actuator 1455 to operate and move the sleeve 1435 (i.e., $\Delta x$ 1782>0). At this point, the movement of the sleeve 1435 starts to reduce the effective footprint 1614 of the collective flow orifice 1416, which acts to restrict further increases in Q. The rate that the effective footprint 1614 of the collective flow orifice 1416 changes with the position of the sleeve 1435 depends on the overlapping profiles of the flow orifices cut out in the body of housing 1459, the chamber 1451, and the sleeve 1435. While FIGS. 14 through 17 show an example of a sub 1490 having a sliding sleeve 1465 and a concentric spring-controlled injection regulator 1450 with a single variable-area orifice, alternative embodiments of a sub 1490 may include multiple variable-area orifices that may be incorporated into a single injection regulator as necessary to accommodate different magnitudes of throughput of the portion 1676-2 of the injection fluid 1645.

Figure 18:
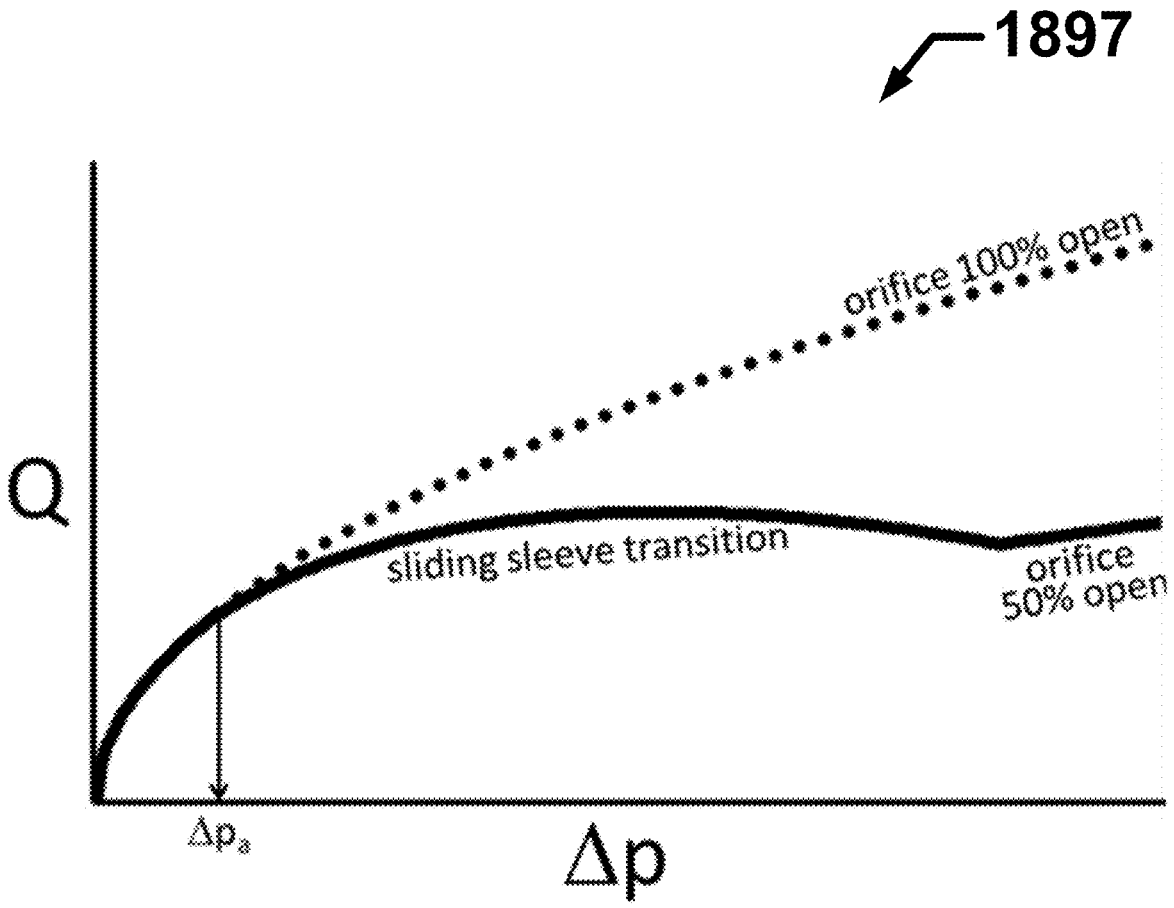
FIG. 18 shows a graph of a flow performance curve for the injection regulator of the sub of FIG. 14 during the injection sequence of FIGS. 16 and 17 according to certain example embodiments.

FIG. 18 shows a graph 1897 of a flow performance curve for the injection regulator 1450 of the sub 1490 of FIGS. 16 and 17 according to certain example embodiments. Referring to the description above with respect to FIGS. 1 through 17, the graph 1897 of FIG. 18 shows a flow performance curve (solid line) for the spring-controlled injection regulator 1450. In this case, $\Delta p$ is plotted along the horizontal axis against Q (e.g., regulator injection fluid throughput shown by the portion 1676-2 and the portion 1776-2 of the injection fluid 1645) along the vertical axis. The plot in the graph 1897 shows $\Delta p_a$ as the point at which the sliding sleeve 1435 of the injection regulator 1450 activates during the injection process. In other words, the plot left of $\Delta p_a$ represents the point in time shown in FIG. 16 when the portion 1676-2 of the injection fluid 1645 moving through the injection regulator 1450 is below the differential activation pressure of the injection regulator 1450, and the plot right of $\Delta p_a$ represents the point in time shown in FIG. 17 when the portion 1776-2 of the injection fluid 1645 moving through the injection regulator 1450 is above the differential activation pressure of the injection regulator 1450.

The generalized performance of an example ASRICV and its self-regulating nature can be determined using equations describing orifice flow and force balancing on the sliding sleeve. Flow through an orifice is described using the following equation:

$$Q=CA\sqrt{\Delta p}, \tag{1}$$

where C is a constant that includes unit conversions and the orifice's discharge coefficient and A is the orifice flow area. At a small $\Delta p$, A is maximized, resulting in flow performance following the "orifice 100% open" curve in FIG. 18. However, as $\Delta p$ increases with Q, $\Delta p$ will eventually rise to where $\Delta p=\Delta p_a$ (the differential pressure at which the sliding sleeve is activated). Beyond this point, incremental increases in $\Delta p$ serve to incrementally shift the sliding sleeve and reduce the size of the variable-area orifice, thereby actively controlling to restrict the throughput of the portion 1776-2 of the injection fluid 1645. If $\Delta p$ continues to increase, the sliding sleeve will ultimately reach its terminal position—in this case restricting the variable-area orifice to approximately 50% of its full aperture.

The rendition of the concentric spring-controlled injection regulator 1450 with the protective sleeve 1465 shown in FIGS. 14 through 17 displays the basic mechanisms that govern its self-regulating nature. Because of the protective sleeve 1465, the sub 1490 is suitable for use in the single-installation completion liners of FIGS. 2 through 11 since the example protective sleeve 1465 offers a means of shielding, protecting, and isolating the injection regulator 1450 from the erosive solids-bearing fluid (e.g., fluid 304, fluid 804) used during fracture stimulations. The engagement feature 1466 of the protective sleeve 1465 allows a shifting tool (e.g., a wireline tool, a coiled tubing, a ball or dart pumped down the well from surface) to engage the engagement feature 1466 and retract (e.g., move from one position (e.g., the engaged position) to another position (e.g., the disengaged position)) the protective sleeve 1465 within the cavity 1419 of the sub 1490 as required to expose the injection regulator 1450 to an injection fluid (e.g., injection fluid 645, injection fluid 1145) after all fracture stimulation work is completed.

In general, an injection regulator 1450 in the form of an ASRICV relies on the difference between internal pressure ($p_i$) and external pressure ($p_o$) [i.e., $\Delta p$] as the driving force for moving a sliding sleeve 1435 that controls the size of one or more variable-area collective flow orifices 1416 and, ultimately, the flowrate at which the injection fluid 1645 exits the injection regulator 1450 in the form of the portion 1676-2 or the portion 1776-2 of the injection fluid 1645. The resultant forces from $\Delta p$ act axially on the sliding sleeve 1435. An actuator 1455 (in this case, a spring) governs how the sliding sleeve 1435 reacts to forces from $\Delta p$. The preload force imposed by the spring controls the point at which a sufficiently large $\Delta p$ is able to move the sliding sleeve 1435. The compression stiffness of the spring controls the rate at which the sliding sleeve 1435 moves with changes in $\Delta p$. If no fluid is flowing through the collective flow orifice 1416 of the injection regulator 1450, then $\Delta p=0$, resulting in the injection regulator 1450 being in its full-open position.

As flow through the collective flow orifice 1416 of the injection regulator 1450 increases, so does $\Delta p$. Depending on the area of the collective variable-area orifice 1416 in its full-open position, there is a flow rate at which $\Delta p$ is sufficiently large to start shifting the sliding sleeve 1435. This $\Delta p$ is designated as $\Delta p_a$, the differential pressure at which the sliding sleeve 1435 activates. At any $\Delta p$ greater than $\Delta p_a$, the sliding sleeve 1435 shifts to reduce the area of the collective orifice 1416, which acts to restrict further increases in flow of the injection fluid 1645 through the collective orifice 1416. In this way, the injection regulator 1450 acts autonomously. The injection regulator 1450 possesses a motion stop 1452-2 that prevents the sliding sleeve 1435 from completely blocking the variable-area collective flow orifice 1416, thus maintaining pressure communication between the inside and outside of the injection regulator 1450. The maximum amount of orifice blockage is set by the position of the motion stop 1452-2.

Figure 19A:
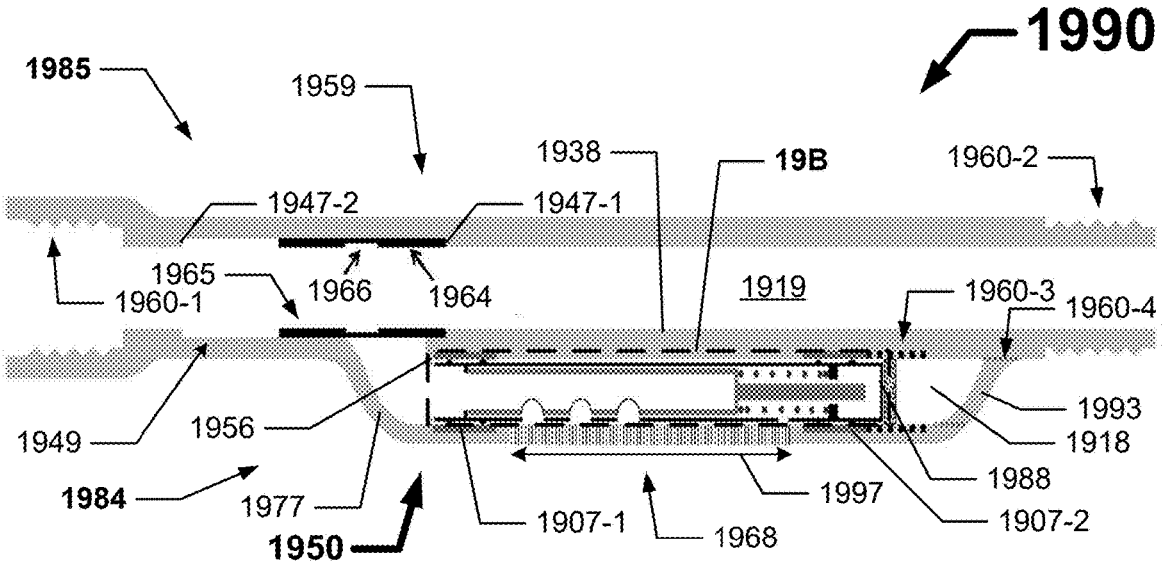
FIGS. 19A and 19B show a sectional side view of another sub that includes an injection regulator and an example protective sleeve according to certain example embodiments.
Figure 19B:
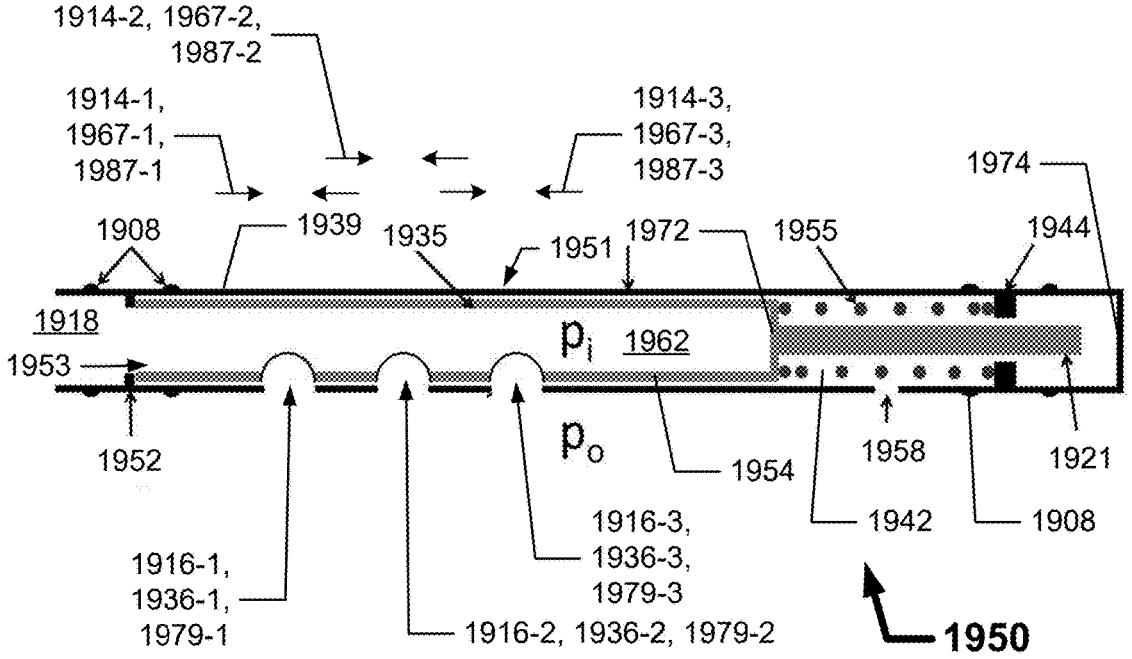

FIGS. 19A and 19B show a sectional side view of another sub 1990 that includes an injection regulator 1950 and an example protective sleeve 1965 according to certain example embodiments. Specifically, FIG. 19A shows a sectional side view of the sub 1990 with the protective sleeve 1965 in the engaged position and the injection regulator 1950 in the open position, and FIG. 19B shows a detailed view of the injection regulator 1950 of FIG. 19A. FIGS. 19A and 19B show the sub 1990 at a point in time before a stimulation (e.g., fracturing) operation begins.

Figure 20A:
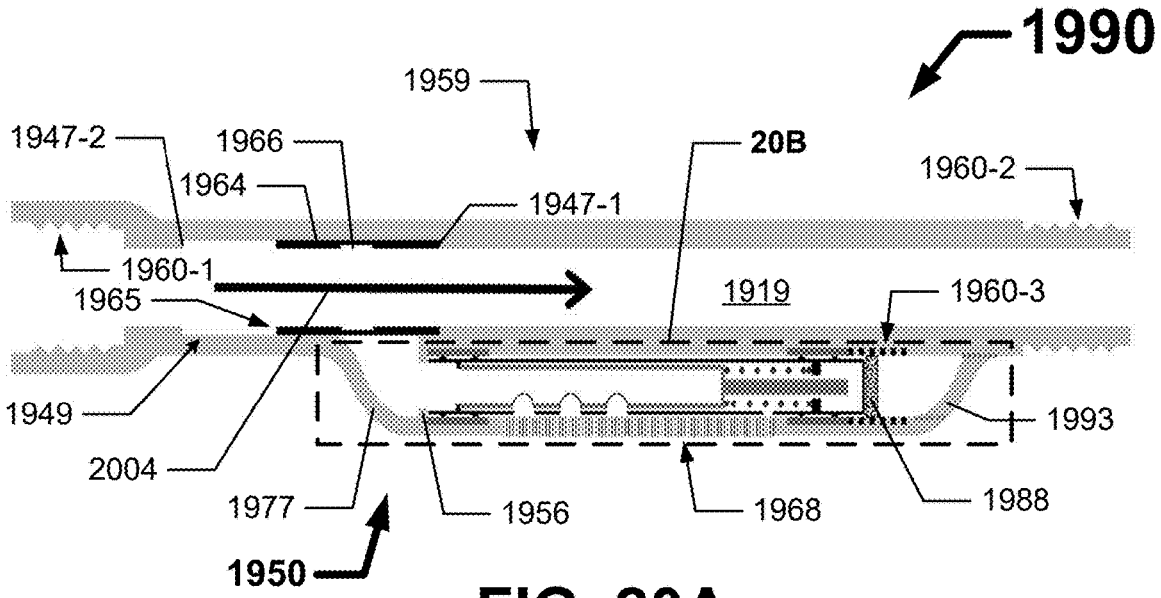
FIGS. 20A through 22B show a stimulation and injection sequence using the sub of FIGS. 19A and 19B according to certain example embodiments.
Figure 20B:
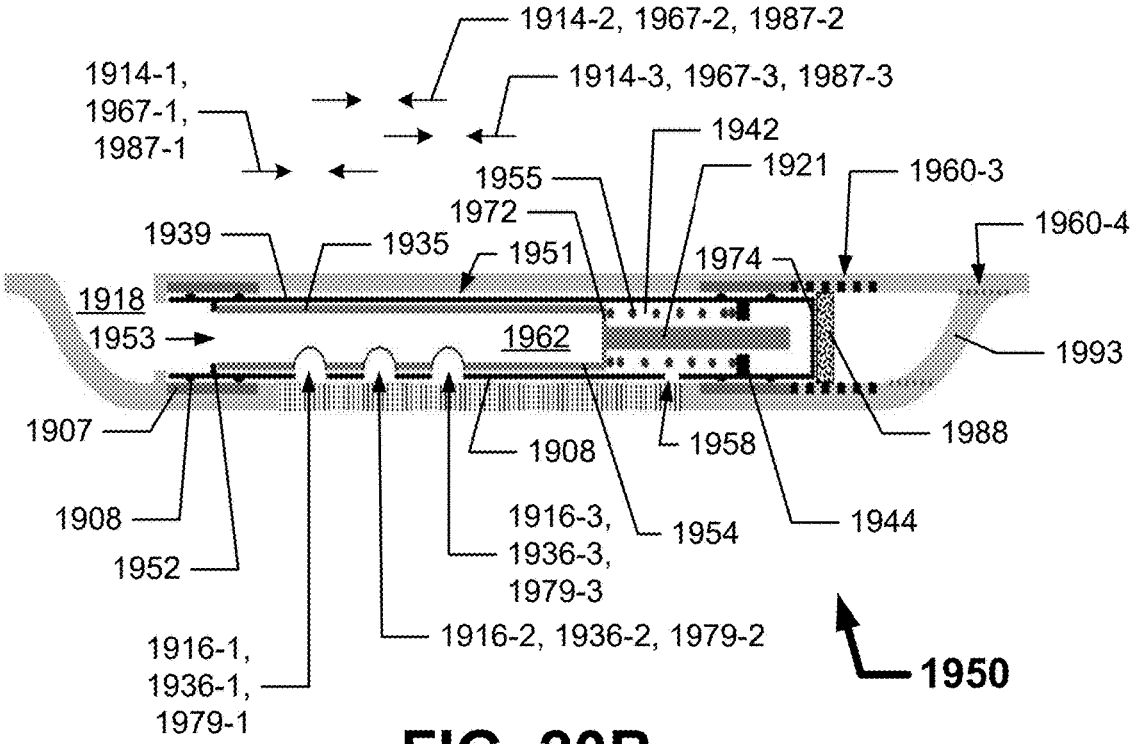
Figure 21A:
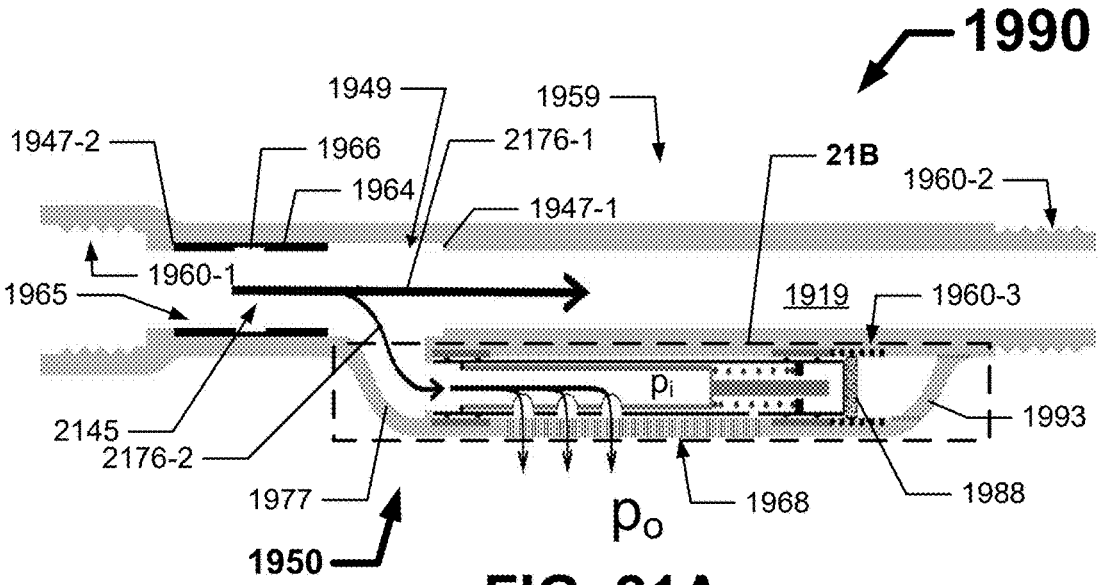
Figure 21B:
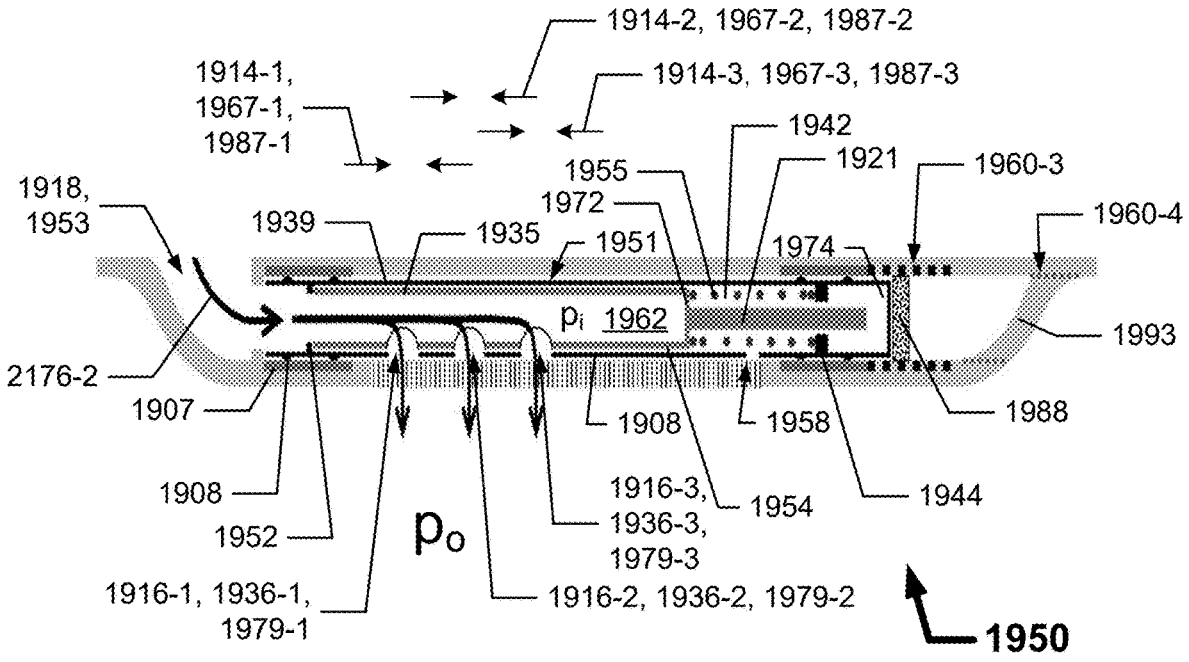
Figure 22A:
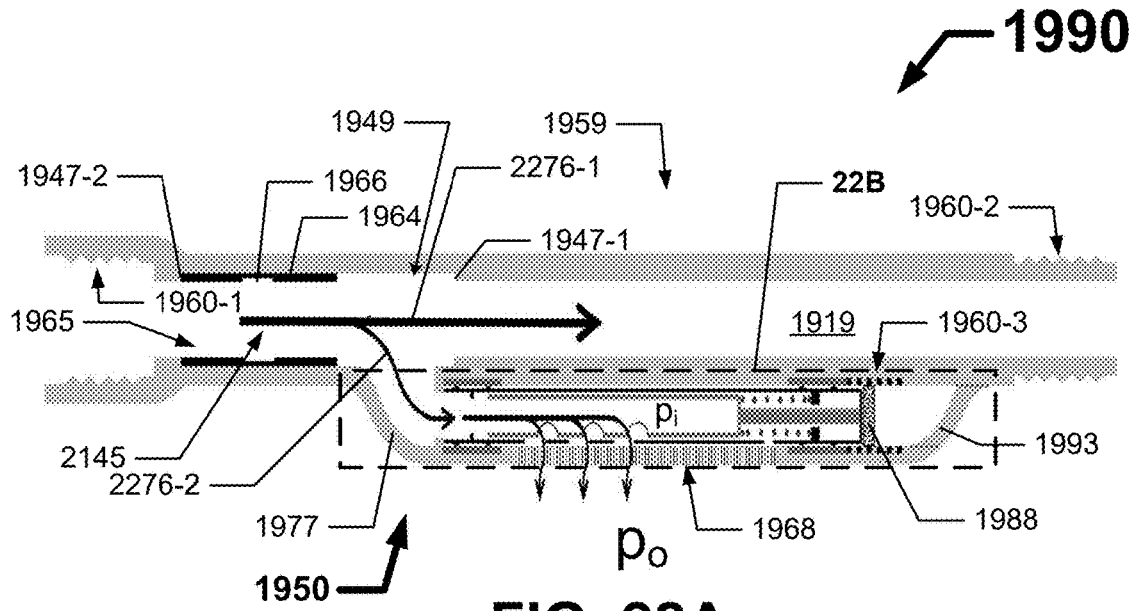
Figure 22B:
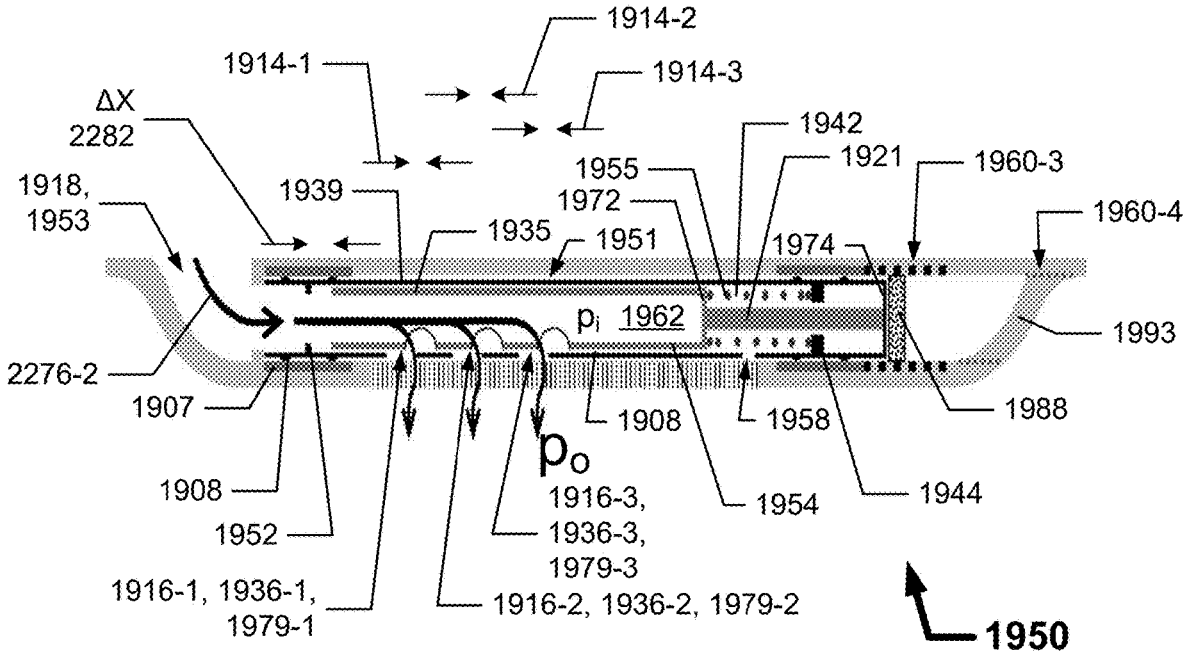

FIGS. 20A through 22B show a stimulation and injection sequence using the sub 1990 of FIGS. 19A and 19B according to certain example embodiments. Specifically, FIGS. 20A and 20B show a sectional side view of the sub 1990 and a detailed view of the injection regulator 1950, respectively, during a fracture stimulation operation. FIGS. 21A and 21B show a sectional side view of the sub 1990 and a detailed view of the injection regulator 1950, respectively, after the fracturing operation has concluded and at the start of an injection operation. FIGS. 22A and 22B show a sectional side view of the sub 1990 and a detailed view of the injection regulator 1950, respectively, during the injection operation. The sub 1990 may be called non-concentric because the injection regulator 1950 is not within the main cavity 1919 of the housing 1959, but rather is within a cavity 1918 that branches from the main cavity 1919. The functionality of the injection regulator 1950 and the protective sleeve 1965 is not impacted by the flow direction of the stimulation fluid 2004 and/or the flow direction of the injection fluid 2145 through the cavity 1919 of the sub 1990.

Referring to the description above with respect to FIGS. 1 through 18, the housing 1959 of the sub 1990 is in the form of a side-pocket carrying mandrel that is used to host the injection regulator 1950. The injection regulator 1950 in this case is in the form of a ASRICV that includes a chamber 1951, an actuator 1955, and a sleeve 1935 (sometimes called a valve sleeve 1935 herein), where the actuator 1955 and the sleeve 1935 are located within the chamber 1951.

The protective sleeve 1965 of the sub 1990 is substantially the same as the protective sleeve 1265 discussed above. For example, the protective sleeve 1965 of FIGS. 19A through 22B is movably (e.g., slidably) disposed within the cavity 1919 formed by the housing 1959 of the sub 1990. The protective sleeve 1965 is made of a material that maintains its shape and size when exposed to extreme conditions (e.g., high pressure, high temperature, elevated amounts of fluid flow), such as the conditions that exist within the cavity 1919 during a fracture stimulation operation, as shown in FIGS. 20A and 20B. The protective sleeve 1965 has an engaged position (as shown in FIGS. 19A through 20B) in which the branch to the cavity 1918 from the cavity 1919 is covered and a disengaged position (as shown in FIGS. 21A through 22B) in which the branch to the cavity 1918 from the cavity 1919 is uncovered.

The protective sleeve 1965 includes a body 1964 that may include one or more of a number of features. For example, as shown in FIGS. 19A through 22B, the body 1964 of the protective sleeve 1965 includes an engagement feature 1966 that is configured to engage with a protective sleeve adjustment device (e.g., a wireline tool, a coiled tubing, a ball or dart pumped down the well from surface) within the cavity 1919 of the sub 1990 for moving the protective sleeve 1965 between the engaged position and the disengaged position. In this case, the engagement feature 1966 is a recess or slot along the inner surface of the protective sleeve 1965 that traverses some, but not all, of the thickness of the body 1964 and is located approximately midway along the length of the body 1964. In this example, the protective sleeve 1965 does not include a retention feature (e.g., similar to retention feature 1241).

The housing 1959 includes an outer wall 1977 that forms a cavity 1919 that is open at both ends. At least one of the walls 1977 of the housing 1959 within the cavity 1919 includes a protective sleeve receiving area 1949 within which the protective sleeve 1965 is movably disposed. The protective sleeve receiving area 1949 of the housing 1959 is configured to provide a space within which the protective sleeve 1965 may move. The protective sleeve receiving area 1949 in this case is a recess within the wall 1977 of the housing 1959 that allows the protective sleeve 1965 to slide along most of the length of the housing 1959 of the sub 1990.

To limit the range of motion of the protective sleeve 1965, the protective sleeve receiving area 1949 in this case includes a stop 1947-2 (e.g., a proximal stop 1947-2) located toward the proximal end of the protective sleeve receiving area 1949 and another stop 1947-1 (e.g., a distal stop 1947-1) located toward the distal end of the protective sleeve receiving area 1949 to limit the range of motion of the protective sleeve 1965. In this example, each stop 1947 is part of the wall 1977 of the housing 1959 that creates a boundary for the protective sleeve receiving area 1949. In this case, the protective sleeve receiving area 1949 does not include any retention features (e.g., similar to the retention feature 1231 discussed above).

While the protective sleeve 1965 is in the engaged position, as shown in FIGS. 19A through 20B, isolating the injection regulator 1950 from the cavity 1919, a stimulation (e.g., fracturing) fluid 2004 may pass through the cavity 1919 of the sub 1990 without interacting with the injection regulator 1950. When the fracture stimulation operation is complete, the protective sleeve 1965 may be moved (e.g., by a wireline tool, by a coiled tubing, by a ball or dart pumped down the well from surface) within the protective sleeve receiving area 1949 from the engaged position to the disengaged position, as shown in FIGS. 21A through 22B, during an injection operation so that some of the injection fluid 2145 may be diverted from the cavity 1919, through the cavity 1918, and to a subterranean formation (e.g., subterranean formation 210) by the injection regulator 1950.

The housing 1959 of the sub 1990 includes one or more outer walls 1977 that form a main bore 1985 having a cavity 1919 that is open at both ends. The walls 1977 of the housing 1959 also form a side pocket 1984 having a secondary cavity 1918. The secondary cavity 1918 of the side pocket 1984 branches off from the cavity 1919 of the main bore 1985 in a downward direction, becomes parallel with the cavity 1919, and has a distal end that is closed with a removable retention cap 1988. When the retention cap 1988 is removed, the injection regulator 1950 can be inserted or removed from the cavity 1918 of the side pocket 1984 through the side-pocket access opening 1993. When the removable retention cap 1988 is coupled to the rest of the housing 1959, an environmental seal may be created.

The wall 1977 of the housing 1959 at the bottom of the side pocket 1984 has a flow orifice 1968 that traverses therethrough. The flow orifice 1968 has a footprint 1997 (e.g., a width, a cross-sectional shape, a length) that is sufficient to allow for the flow of a fluid (e.g., an injection fluid 2145 as shown in FIGS. 21A through 22B) therethrough. The main bore 1985 and the side pocket 1984 of the housing 1959 in this case are each cylindrical in shape, and the main bore 1985 has a size (e.g., inner diameter, outer diameter) to allow the housing 1959 of the sub 1990 to be substantially seamlessly incorporated into a tubing string or liner (e.g., liner 211) used in a field operation within a wellbore (e.g., wellbore 220). Also, the side pocket 1984 is configured to be large enough to receive the injection regulator 1950.

In addition, the housing 1959 in this example includes one coupling feature 1960-1 in the form of mating threads located at one end (e.g., the left or upstream end) of the main bore 1985 of the housing 1959, as well as another coupling feature 1960-2 in the form of mating threads located at the opposite end of the main bore 1985 of the housing 1959. These coupling features 1960 allow the housing 1959 to be coupled to two other components of a tubing string or liner. The housing 1959 may be made of one or more of any of a number of materials (e.g., steel) that are designed to withstand the conditions (e.g., temperature, pressure, flow rate) that exist in a wellbore during a field operation.

The cross-sectional shape of the cavity 1919 of the main bore 1985 and the cavity 1918 of the side pocket 1984 is circular, where the size of the cross-section of the cavity 1919 is slightly larger than the cross-section of the cavity 1918. The side pocket 1984 may include one or more features for accommodating the injection regulator 1950. For example, in this case, there are two sealing surfaces 1907 disposed along the inner surface of the wall 1977 that provide a pressure seal (via gaskets or O-rings-like the sealing O-rings 1908) when the injection regulator 1950 is inserted in the side pocket 1984. Sealing surface 1907-1 is located at the proximal end of the side pocket 1984, upstream of the flow orifice 1968. Sealing surface 1907-2 is located toward the distal end of the side pocket 1984, downstream of the flow orifice 1968.

In this case, there is a coupling feature 1960-3 in the form of mating threads disposed along the inner surface of the wall 1977 that forms the side pocket 1984 adjacent to and downstream of the sealing surface 1907-2. The coupling feature 1960-3 may be configured to receive a removable retention cap 1988. The side pocket 1984 may include a regulator position stop 1956. The stop 1956 may be in the form of one or more protrusions that extend toward the cavity 1918 of the side pocket 1984 from the outer wall 1977 and/or from the inner wall 1938 around some or all of the inner perimeter of the side pocket 1984. The regulator position stop 1956 in this case is positioned adjacent to and upstream of the sealing surface 1907-1 and is configured to retain the side wall 1939 of the chamber 1951 of the injection regulator 1950 within the cavity 1918 of the side pocket 1984.

The chamber 1951 of the injection regulator 1950 is cylindrical in shape (to match the shape of the cavity 1918 of the side pocket 1984) with a side wall 1939 and a distal wall 1974 that form a cavity 1953. In this case, the cavity 1953 of the chamber 1951 is smaller than the cavity 1918 of the side pocket 1984 of the housing 1959. Also, in this case, the cavity 1953 of the chamber 1951 is open-ended at its proximal (upstream) end. The actuator 1955 and the sleeve 1935 are disposed in the cavity 1953 of the chamber 1951 in this case. The sleeve 1935 is configured to move within part of the cavity 1953 of the chamber 1951 when the actuator 1955 operates.

The side wall 1939 of the chamber 1951 has three variable-area flow orifices 1979 (flow orifice 1979-1, flow orifice 1979-2, and flow orifice 1979-3) that traverse the thickness of the wall 1939. The number of variable-area orifices incorporated into a single injection regulator (e.g., injection regulator 1950) may be adjusted to accommodate different magnitudes of injection fluid 2145 (i.e., injection fluid portion 2176-2 and portion 2276-2) flowing therethrough. The flow orifices 1979 in the side wall 1939 of the chamber 1951 in this example are coincident (e.g., vertically aligned) with the flow orifice 1968 in the wall 1977 of the housing 1959 of the sub 1990. The flow orifices 1979 of the chamber 1951 have a footprint 1987 (e.g., a width, a cross-sectional shape, a length) that is substantially identical to each other in this example. Collectively, the three footprints 1987 (footprint 1987-1, footprint 1987-2, and footprint 1987-3) are less than the footprint 1997 of the flow orifice 1968 in the wall 1977 of the housing 1959.

The actuator 1955 of the injection regulator 1950 is configured to move the sleeve 1935 within the chamber 1951 based on a differential in pressure between the cavity 1918 and/or the cavity 1962 ($p_i$) within the sub 1990 and outside ($p_o$) the sub 1990. The actuator 1955 in this case includes a single component in the form of a resilient device (e.g., a spring). The actuator 1955 operates without any external controller and/or without any electrical components. Specifically, in this case, the actuator 1955 is positioned within a part of the cavity 1953 of the chamber 1951 in a space 1942 defined by the side wall 1939 of the chamber 1951, the distal end of the distal wall 1972 of the sleeve 1935, and the distal wall 1974 of the chamber 1951.

The spring of the actuator 1955 is located within the space 1942 against an internal side wall 1944 that extends laterally inward from the side wall 1939 of the chamber 1951 and is positioned downstream from the distal wall 1972 of the sleeve 1935. The internal side wall 1944 has an aperture that traverses its thickness sufficient to allow for the extension 1921 (discussed below) of the sleeve 1935 to pass therethrough and move back and forth therein. Additionally, the gap between the internal side wall 1944 and the sleeve extension 1921 is sufficiently large to allow unhindered transmission of pressure throughout the space 1942. In some cases, the position of the internal side wall 1944 may be adjustable within the space 1942 based on the characteristics of the spring and different target flow rates of the portions 2176-2 and 2276-2 of the fluid 2145 for various pressure differential conditions. The space 1942 in which the actuator 1955 is positioned may be filled with air, any other fluid, and/or any other material to ensure reliable operation of the actuator 1955 over time. The side wall 1939 in this case includes an external pressure port 1958 that is in communication with the space 1942 adjacent to the spring.

The actuator 1955 in this example is configured, when operated, to move the sleeve 1935 forward and/or backward within the chamber 1951. In this case, the side wall 1954 of the sleeve 1935 has three flow orifices 1936 (flow orifice 1936-1, flow orifice 1936-2, and flow orifice 1936-3) that traverse the thickness of the side wall 1954. When the sleeve 1935 is in the open position, the flow orifices 1936 of the sleeve 1935 are coincident (e.g., vertically aligned) with the flow orifices 1979 in the wall 1939 of the chamber 1951. The flow orifices 1936 of the sleeve 1935 have a footprint 1967 (e.g., a width, a cross-sectional shape, a length) that is substantially identical to each other in this example.

Collectively for the three footprints 1967 (footprint 1967-1, footprint 1967-2, and footprint 1967-3) are less than the footprint 1997 of the flow orifice 1968 in the wall 1977 of the housing 1959. In this example, the three footprints 1967 of the flow orifices 1936 are substantially the same as the three footprints 1987 of the flow orifices 1979. In this way, when the sleeve 1935 is in the open position, the characteristics of the effective footprints 1914 of the collective flow orifices 1916 are substantially the same as the corresponding characteristics of the footprints 1967 of the flow orifices 1936 and the footprints 1987 of the flow orifices 1979, as shown in FIG. 19B. In such cases when the sleeve 1935 is in the open position, a maximum portion 2176-2 of a fluid 2145 flowing through the cavity 1919 of the housing 1959 is diverted to the cavity 1918 of the side pocket 1984 and through the collective orifices 1916 to a subterranean formation (e.g., subterranean formation 210) while a remaining portion 2176-1 of the injection fluid 2145 (as during an injection operation as shown in FIGS. 21A through 22B) continues to flow out the opposite end of the housing 1959 of the sub 1990.

As the actuator 1955 operates to move the sleeve 1935 to a closed position (shown in FIGS. 22A and 22B) from the open position (shown in FIGS. 21A and 21B), the flow orifices 1936 of the sleeve 1935 are no longer coincident (e.g., is no longer vertically aligned) with the flow orifices 1979 that traverse the thickness of the wall 1939 of the chamber 1951. As a result, the effective footprints 1914 of the collective orifices 1916 are reduced, which results in a lesser portion 2276-2 (where the amount of the portion 2276-2 is less than the portion 2176-2 of FIGS. 21A and 21B) of the injection fluid 2145 flowing through the cavity 1919 being diverted to the cavity 1918 of the side pocket 1984 and through the collective orifices 1916 to the subterranean formation (e.g., subterranean formation 210) while a remaining portion 2276-1 (where the amount of the portion 2276-1 is greater than the amount of the portion 2176-1) of the fluid 2145 continues to flow out the opposite end of the housing 1959. Because of the relatively large footprint 1997 of the flow orifice 1968, the flow orifice 1968 does not limit the effective footprints 1914 of the collective orifices 1916, regardless of the position of the sleeve 1935.

As discussed above, the actuator 1955 operates when the difference between the internal pressure ($p_i$) (in this case, the pressure within the cavity 1918) and the external pressure ($p_o$) [i.e., $\Delta p$] exceeds a minimum threshold value. When the actuator 1955 operates, the sleeve 1935 moves to control the effective footprints 1914 of the collective flow orifices 1916 and, ultimately, the flowrate at which a portion (e.g., 2176-2, 2276-2) of the injection fluid 2145 exits the sub 1990. In this example, the resultant forces from $\Delta p$ act axially on the distal wall 1972 and the distal end of extension 1921 of the sleeve 1935 (which equates to $p_i$ and $p_o$ acting on similar cross-sectional areas). The various characteristics of the actuator 1955 (specifically, the spring) in this case may be selected by a user so that the actuator 1955 operates in the manner desired. For example, the preload force imposed by the spring may be used to control the point at which $\Delta p$ is sufficiently large to operate the actuator 1955 and move the sleeve 1935. The compression stiffness of the spring may be used to control the rate at which the sleeve 1935 moves with changes in $\Delta p$.

The injection regulator 1950 in this case is configured to operate autonomously based on the $\Delta p$ that the actuator 1955 of the injection regulator 1950 experiences locally. As a result, by moving the sleeve 1935 in a controlled fashion, the actuator 1955 (and so the injection regulator 1950 in general) self-regulates fluid flow in response to changes in $\Delta p$. FIGS. 21B and 22B illustrate detailed views of the sleeve 1935 in its fully-open ($\Delta x$ 2282=0) and maximally-closed ($\Delta x$ 2282=max) positions, respectively, where $\Delta x$ 2282 represents the position of the sleeve 1935 relative to the fully open position. In this case, there is no internal pressure port because part (e.g., portion 2176-2, portion 2276-2) of the injection fluid 2145 flows directly into the sleeve 1935, thereby exposing the distal wall 1972 of the sleeve 1935 to $p_i$.

When the internal pressure ($p_i$) exceeds the pressure ($p_o$) at the external pressure port 1958, the differential pressure ($\Delta p = p_i - p_o$) acting on the distal wall 1972 and distal end of extension 1921 of the sleeve 1935 imposes a net force directed downstream, which in turn applies a force against the spring of the actuator 1955. In order to limit the range of the motion of the sleeve 1935, the injection regulator 1950 may include one or more stops 1952 to limit motion in the upstream (i.e., proximal) direction and the extension 1921 to limit motion in the downstream (i.e., distal) direction. In this case, the injection regulator 1950 has one stop 1952 in the form of a protrusion that extends inward toward the cavity 1953 from the side wall 1939 of the chamber 1951 around some or all of the perimeter of the cavity 1953. The stop 1952 in this case is positioned slightly downstream of the start of the straightaway for the side pocket 1984. Referring to the graph 1897 of FIG. 18 and applying a similar principal to the sub 1990, the point in time shown in FIGS. 21A and 21B represents when the injection fluid 2145 moving through the injection regulator 1950 is below the differential activation pressure $\Delta p_a$ of the injection regulator 1950, and the point in time shown in FIGS. 22A and 22B represents when the injection fluid 2145 moving through the injection regulator 1950 is above the differential activation pressure $\Delta p_a$ of the injection regulator 1950.

The sleeve 1935 in this case includes the side wall 1954, the distal wall 1972, and the extension 1921 that extends away from the distal wall 1972. The length of the extension 1921 is designed in such a way that the distal end of the extension 1921 is approximately a distance $\Delta x$ 2282=max away from the distal wall 1974 of the chamber 1951 when the sleeve 1935 is in the open position. In this way, when the sleeve 1935 is in the maximally closed position, the distal end of the extension 1921 abuts against the distal wall 1974 of the chamber 1951, preventing the sleeve 1935 from moving further downstream.

Figure 23A:
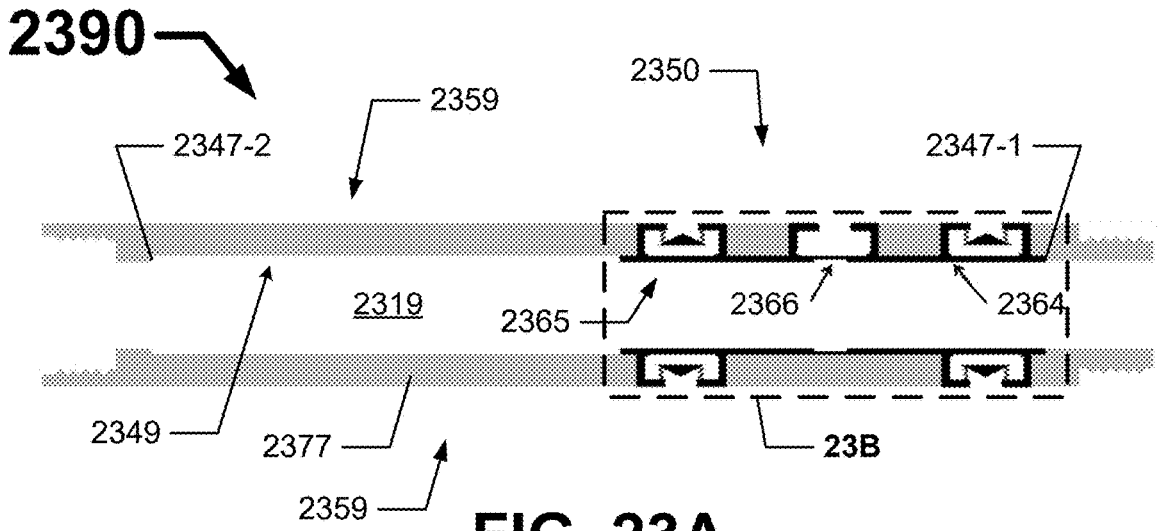
FIGS. 23A and 23B show a sectional side view of yet another sub that includes an injection regulator and an example protective sleeve according to certain example embodiments.
Figure 23B:
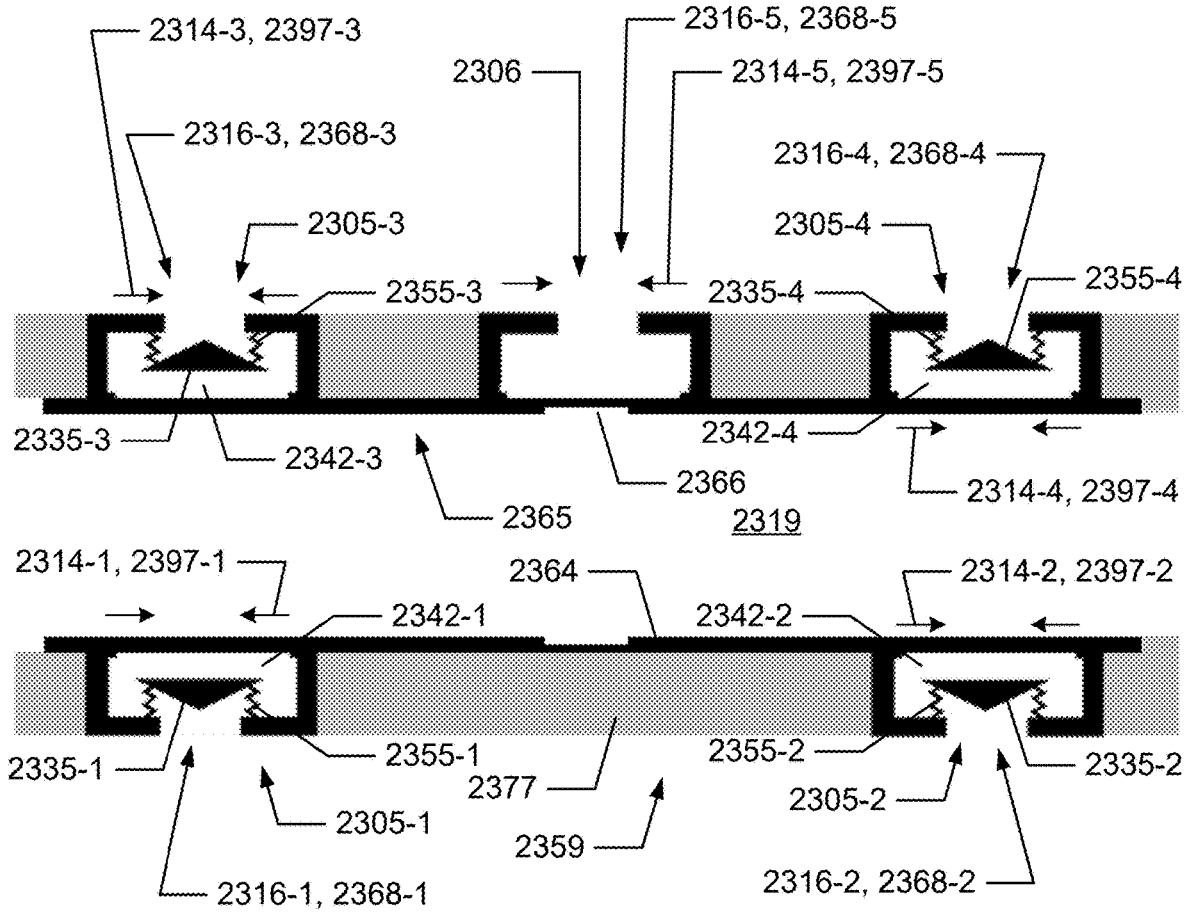
Figure 24:
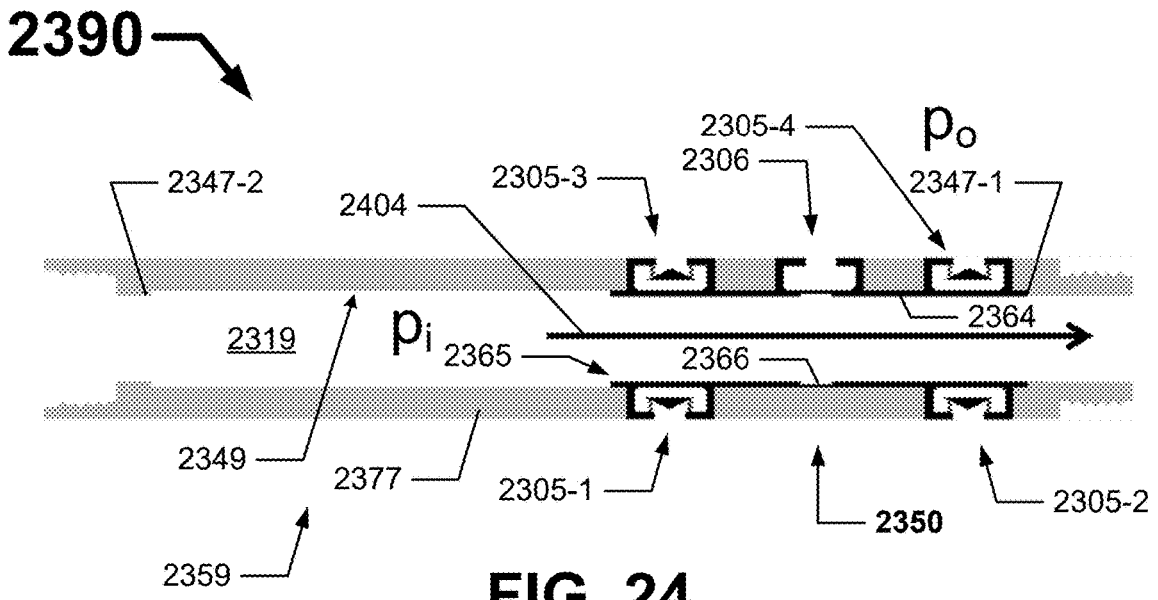
FIGS. 24 through 26 show a stimulation and injection sequence using the sub of FIGS. 23A and 23B according to certain example embodiments.
Figure 25A:
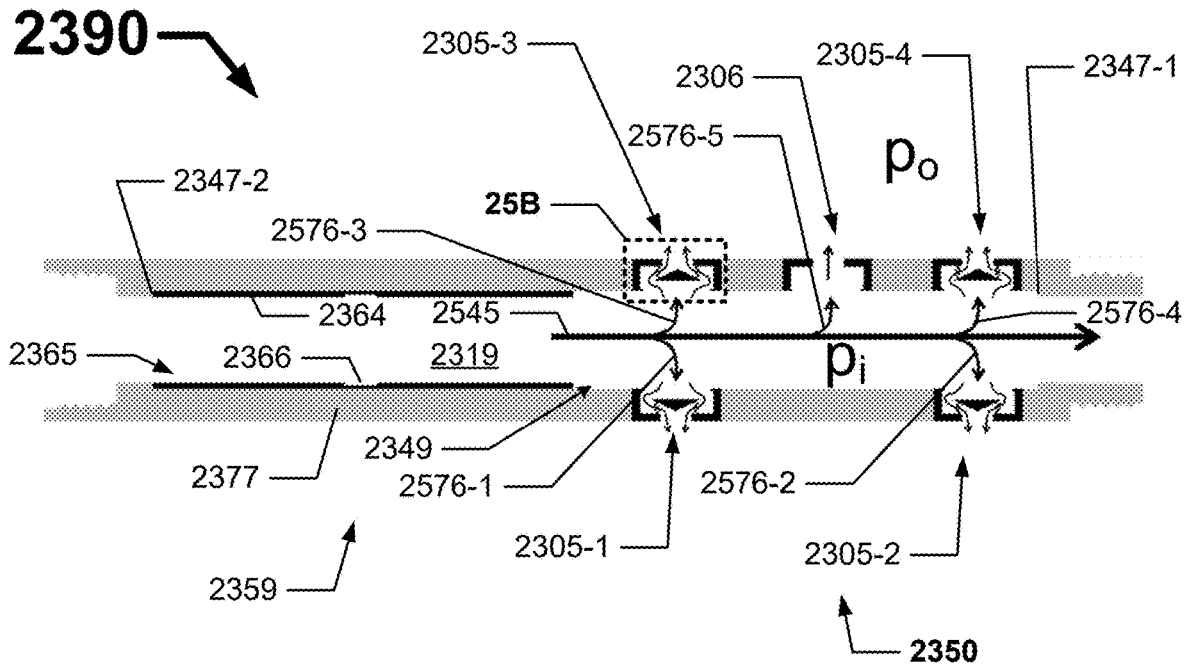
Figure 25B:
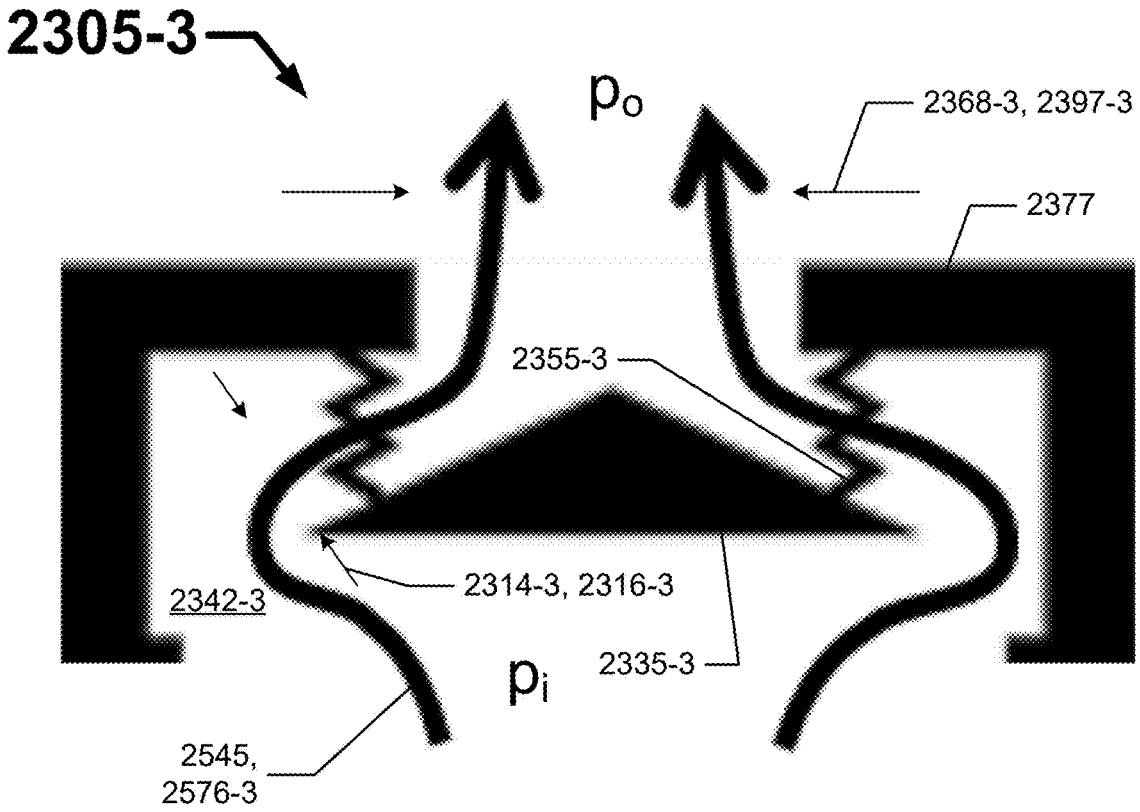
Figure 26:
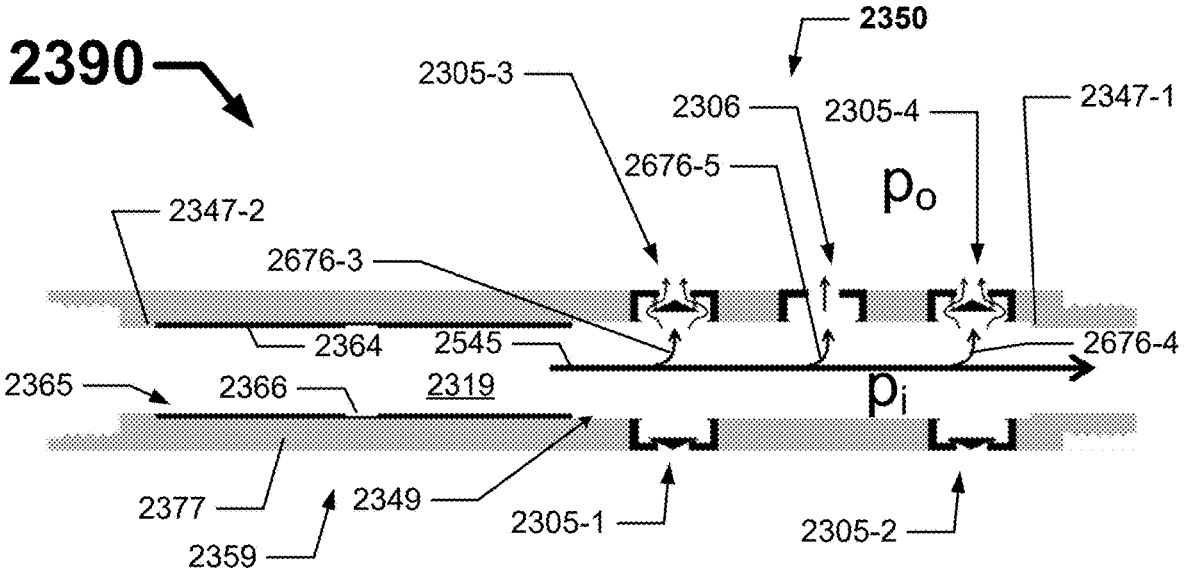

FIGS. 23A and 23B show a sectional side view of yet another sub 2390 that includes an injection regulator 2350 and an example protective sleeve 2365 according to certain example embodiments. FIGS. 24 through 26 show a stimulation and injection sequence using the sub 2390 of FIGS. 23A and 23B according to certain example embodiments. Specifically, FIG. 24 shows a sectional side view of the sub 2390 during a stimulation (e.g., fracturing) operation. FIG. 25A shows a sectional side view of the sub 2390 during the start of an injection operation. FIG. 25B shows a detailed view of spring-loaded poppet valve 2305-3, which is a component of the injection regulator 2350. FIG. 26 shows a sectional side view of the sub 2390 during the injection operation. The functionality of the injection regulator 2350 and the protective sleeve 2365 is not impacted by the flow direction of the stimulation fluid 2404 and/or the flow direction of the injection fluid 2545 through the cavity 2319 of the sub 2390.

Referring to description above with respect to FIGS. 1 through 22B, the example sub 2390 of FIGS. 23A through 26 includes a housing 2359, an example protective sleeve 2365, and an injection regulator 2350. The injection regulator 2350 in this case performs the same function as the aforementioned regulators 1450 and 1950, but it does so through the use of one or more spring-loaded poppet valves 2305 (referred to as valves, henceforward) and one or more stand-alone fixed-area orifices 2306 (sometimes referred to as stand-alone fixed-area flow orifices herein), rather than through the use of a sliding sleeve 1235 and variable-area collective orifices 1216. Irrespective of the differences in how regulator 2350 operates relative to regulator 1450 and regulator 1950, all can be described as ASRICVs based on their autonomous self-regulating nature.

The injection regulator 2350 of the example sub 2390 of FIGS. 23A through 26 includes four valves 2305 (valve 2305-1, valve 2305-2, valve 2305-3, and valve 2305-4) and one stand-alone orifice 2306. In alternative embodiments, the injection regulator 2350 may have any other number (e.g., 1, 2, 6, 9) of valves 2305 and/or any other number (e.g., 2, 3, 5, 8) of stand-alone orifices 2306. Each valve 2305 is equipped with a poppet 2335 that is loaded by an actuator 2355 in the form of a spring. Each valve 2305 has an open position (i.e., fully open) and a number of closed positions (e.g., fully closed, 25% open, 70% open, 50% closed, partially open). The use of a stand-alone orifice 2306 means that the injection regulator 2350 does not completely close, allowing some minimal amount of injection fluid 2576 to flow therethrough, even if all valves 2305 close to bring the collective footprint 2314 for valves 2305 to zero, shutting off the collective flow path 2316 through each of those valves 2305.

Each valve 2305 forms a space 2342. In this case, valve 2305-1 forms a space 2342-1, valve 2305-2 forms a space 2342-2, valve 2305-3 forms a space 2342-3, and valve 2305-4 forms a space 2342-4. The dimensions (e.g., length, width, height, shape, volume) of the space 2342 for one valve may be the same as, or different, the dimensions of the spaces 2342 for one or more of the other valves 2305 of the injection regulator 2350. The stand-alone flow orifice 2306 may also form a space, which may be the same as (as in this case), or different from, the space 2342 of one or more of the valves 2305 of the injection regulator 2350.

Each valve 2305 of the injection regulator 2350 possesses a poppet 2335 that is suspended over the flow orifice 2368 (through which a flow channel 2397 passes) that traverses the thickness of the wall 2377 of the housing 2359 by an actuator 2355 (e.g., the functional equivalent of the actuator 1955 of the injection regulator 1950 above). In this case, the actuator 2355 is a compression spring that, in the lack of sufficient differential pressure ($\Delta p = p_i - p_o$) to overcome the resistance in the spring, creates an effective flow orifice 2316 with the poppet 2335 through which an effective flow path 2314 is created.

For example, for valve 2305-1, the effective flow path 2314-1 through the effective flow orifice 2316-1 is the same as the flow path 2397-1 through the flow orifice 2368-1 when there is insufficient differential pressure (resulting from the throughput of a portion 2576-1 of the injection fluid 2545) applied to the poppet 2335-1 to force the actuator 2355-1 to compress. An example of this is shown in FIG. 25A where a portion 2576-1 of the injection fluid 2545 flows through the valve 2305-1. When there is sufficient differential pressure applied to the poppet 2335-1 to force the actuator 2355-1 to compress, the effective flow path 2314-1 through the effective flow orifice 2316-1 is reduced or completely blocked. An example of this is shown in FIG. 26, where there is no portion 2576-1 of the injection fluid 2545 flowing through the valve 2305-1 because the actuator 2355-1 is completely compressed and the poppet 2335-1 is in continuous contact with the perimeter of the flow orifice 2368-1, blocking all flow therethrough.

As another example, for valve 2305-2, the effective flow path 2314-2 through the effective flow orifice 2316-2 is the same as the flow path 2397-2 through the flow orifice 2368-2 when there is insufficient differential pressure (resulting from the throughput of a portion 2576-2 of the injection fluid 2545) applied to the poppet 2335-2 to force the actuator 2355-2 to compress. An example of this is shown in FIG. 25A where a portion 2576-2 of the injection fluid 2545 flows through the valve 2305-2. When there is sufficient differential pressure applied to the poppet 2335-2 to force the actuator 2355-2 to compress, the effective flow path 2314-2 through the effective flow orifice 2316-2 is reduced or completely blocked. An example of this is shown in FIG. 26, where there is no portion 2576-2 of the injection fluid 2545 flowing through the valve 2305-2 because the actuator 2355-2 is completely compressed and the poppet 2335-2 is in continuous contact with the perimeter of the flow orifice 2368-2, blocking all flow therethrough.

As yet another example, for valve 2305-3, the effective flow path 2314-3 through the effective flow orifice 2316-3 is the same as the flow path 2397-3 through the flow orifice 2368-3 when there is insufficient differential pressure (resulting from the throughput of a portion 2576-3 of the injection fluid 2545) applied to the poppet 2335-3 to force the actuator 2355-3 to compress. An example of this is shown in FIG. 25A where a portion 2576-3 of the injection fluid 2545 flows through the valve 2305-3. In FIG. 26, valve 2305-3 is shown to be open (e.g., fully open, partially but not fully closed), while valve 2305-1 and valve 2305-2 are blocked (fully closed), yet all of the valves 2305 are exposed to the same differential pressure ($\Delta p = p_i - p_o$). This outcome can be the result of the spring stiffness of the actuator 2355-3 of valve 2305-3 being higher than that of valve 2305-1 and valve 2305-2, the flow orifice area 2368-3 of valve 2305-3 being smaller than that of valve 2305-1 and valve 2305-2, or both. All of which can be used with the intention of designing valve 2305-3 to activate (i.e., close) at a differential activation pressure ($\Delta p_{a_3}$) higher than that of valve 2305-1 (i.e., $\Delta p_{a_1}$) and valve 2305-2 (i.e., $\Delta p_{a_2}$).

As yet another example, for valve 2305-4, the effective flow path 2314-4 through the effective flow orifice 2316-4 is the same as the flow path 2397-4 through the flow orifice 2368-4 when there is insufficient differential pressure (resulting from the throughput of a portion 2576-4 of the injection fluid 2545) applied to the poppet 2335-4 to force the actuator 2355-4 to compress. An example of this is shown in FIG. 25A where a portion 2576-4 of the injection fluid 2545 flows through the valve 2305-4. In FIG. 26, valve 2305-4 is shown to be open (e.g., fully open, partially but not fully closed), while valve 2305-1 and valve 2305-2 are blocked (fully closed), yet all of the valves 2305 are exposed to the same differential pressure ($\Delta p = p_i - p_o$). This outcome can be the result of the spring stiffness of the actuator 2355-4 of valve 2305-4 being higher than that of valve 2305-1 and valve 2305-2, the flow orifice area 2368-4 of valve 2305-4 being smaller than that of valve 2305-1 and valve 2305-2, or both. All of which can be used with the intention of designing valve 2305-4 to activate (i.e., close) at a differential activation pressure ($\Delta p_{a_4}$) higher than that of valve 2305-1 (i.e., $\Delta p_{a_1}$) and valve 2305-2 (i.e., $\Delta p_{a_2}$).

The stand-alone fixed-area orifice 2306 will always allow a portion (e.g., portion 2576-5 in FIG. 25, portion 2676-5 in FIG. 26) of the injection fluid 2545 through the flow orifice 2368-5 (always equal to the effective flow orifice 2316-5)

any time that there is injection fluid 2545 in the cavity 2319 and the internal pressure $p_i$ exceeds the external pressure $p_o$.

The protective sleeve 2365 of the sub 2390 is substantially the same as the protective sleeve 1265 discussed above. For example, the protective sleeve 2365 of FIGS. 23A through 26 is movably (e.g., slidably) disposed within the cavity 2319 formed by the housing 2359 of the sub 2390. The protective sleeve 2365 is made of a material that maintains its shape and size when exposed to extreme conditions (e.g., high pressure, high temperature, elevated amounts of fluid flow), such as the conditions that exist within the cavity 2319 during a fracture stimulation operation, as shown in FIG. 24. The protective sleeve 2365 has an engaged position (as shown in FIGS. 23A through 24) and a disengaged position (as shown in FIGS. 25A through 26).

The protective sleeve 2365 includes a body 2364 that may include one or more of a number of features. For example, as shown in FIGS. 23A through 26, the body 2364 of the protective sleeve 2365 includes an engagement feature 2366 that is configured to engage with a protective sleeve adjustment device (e.g., a wireline tool, a coiled tubing, a ball or dart pumped down the well from surface) within the cavity 2319 of the sub 2390 for moving the protective sleeve 2365 between the engaged position and the disengaged position. In this case, the engagement feature 2366 is a recess or slot along the inner surface of the protective sleeve 2365 that traverses some, but not all, of the thickness of the body 2364 and is located approximately midway along the length of the body 2364. In this example, the protective sleeve 2365 does not include a retention feature (e.g., similar to retention feature 1241).

The housing 2359 includes an outer wall 2377 that forms a cavity 2319 that is open at both ends. At least one of the walls 2377 of the housing 2359 within the cavity 2319 includes a protective sleeve receiving area 2349 within which the protective sleeve 2365 is movably disposed. The protective sleeve receiving area 2349 of the housing 2359 is configured to provide a space within which the protective sleeve 2365 may move. The protective sleeve receiving area 2349 in this case is a recess within the wall 2377 of the housing 2359 that allows the protective sleeve 2365 to slide along most of the length of the housing 2359 of the sub 2390.

To limit the range of motion of the protective sleeve 2365, the protective sleeve receiving area 2349 in this case includes a stop 2347-2 (e.g., a proximal stop 2347-2) located toward the proximal end of the protective sleeve receiving area 2349 and another stop 2347-1 (e.g., a distal stop 2347-1) located toward the distal end of the protective sleeve receiving area 2349 to limit the range of motion of the protective sleeve 2365. In this example, each stop 2347 is part of the wall 2377 of the housing 2359 that creates a boundary for the protective sleeve receiving area 2349. In this case, the protective sleeve receiving area 2349 does not include any retention features (e.g., similar to the retention feature 1231 above).

While the protective sleeve 2365 is in the engaged position, as shown in FIGS. 23A through 24, isolating the injection regulator 2350 from the cavity 2319, a fracture stimulation fluid 2404 may pass through the cavity 2319 of the sub 2390 without interacting with the injection regulator 2350. When the fracturing operation is complete, the protective sleeve 2365 may be moved (e.g., by a wireline tool, by a coiled tubing, by a ball or dart pumped down the well from surface) within the protective sleeve receiving area 2349 from the engaged position to the disengaged position, as shown in FIGS. 25A and 26, during an injection operation so that some of the injection fluid 2545 may be diverted from the cavity 2319 to a subterranean formation (e.g., subterranean formation 210) by the injection regulator 2350.

In summary, the multiple-orifice poppet valve injection regulator 2350 is isolated by the example protective sleeve 2365 protecting the injection regulator 2350 during fracture stimulation process in FIG. 24. In FIG. 25A, the injection fluid 2576 flows through all valves 2305 of the injection regulator 2350 below its lowest differential activation pressure, $\Delta p_{a_1}$ (i.e., the differential activation pressure for valve 2305-1). In FIG. 26, the injection fluid 2676 flows in a more restricted fashion through the valves 2305 of the injection regulator 2350 above an intermediate differential activation pressure, $\Delta p_{a_2}$ (i.e., the differential activation pressure for valve 2305-2), but below $\Delta p_{a_3}$ (i.e., the differential activation pressure for valve 2305-3).

Figure 27:
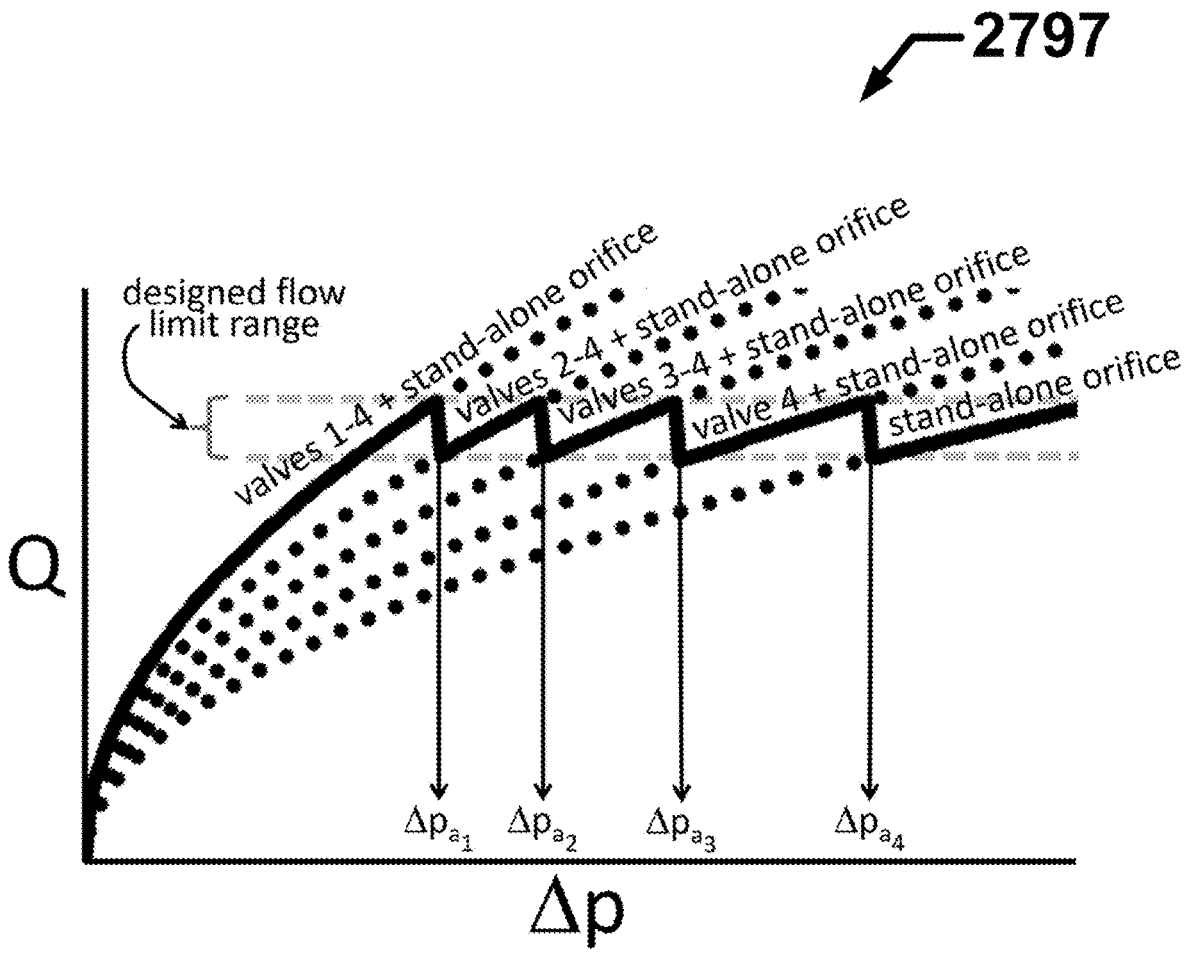
FIG. 27 shows a graph of a flow performance curve for the injection regulator of the sub of FIGS. 23A and 23B during the injection sequence of FIGS. 25A through 26 according to certain example embodiments.

FIG. 27 shows a graph 2797 of a flow performance curve for the injection regulator 2350 of the sub of FIGS. 23A and 23B during the injection sequence of FIGS. 25A and 26 and through to the closure activation of all valves 2305 according to certain example embodiments. Referring to the description above with respect to FIGS. 1 through 26, the graph 2797 shows plots of $\Delta p$ along the horizontal axis against Q (e.g., regulator injection fluid throughput shown by the portions 2576 and the portions 2676 of the injection fluid 2545) along the vertical axis. As discussed above, the four valves 2305 (valve 2305-1 through valve 2305-4) with the poppets 2335 are designed to fully close (e.g., reduce their effective footprints 2314 to zero and cause their effective flow orifices 2316 to shut) at different $\Delta p_a$ values. As $\Delta p$ increases, the poppets 2335 of the valves 2305 fully close in succession to restrict the injection rate (Q) to a predetermined limit range, as shown in FIG. 27.

The magnitude of that limit and the range of $\Delta p$ over which it spans can be designed based on the selection of, for example, (1) the number of valves 2305 used, (2) the cross-sectional area of the flow orifice 2368 of each valve 2305, (3) the differential activation pressure ($\Delta p_a$) of each valve 2305, (4) the number of stand-alone orifices 2306 used, and (5) the cross-sectional area of each stand-alone orifice 2306. In this way, multiple valves 2305 of varying cross-sectional areas and/or associated poppets 2335 and actuators 2355 (sometimes collectively referred to as poppet valves) of varying differential activation pressures ($\Delta p_a$) and multiple stand-alone orifices 2306 of varying cross-sectional areas can be used to construct an autonomous injection regulator 2350 that can operate in any flowrate range. Irrespective of the operating envelope, the general design of the injection regulator 2350 using one or more spring-loaded poppet valves 2305 and one or more stand-alone fixed-area orifices 2306 results in restricting runaway injection into intervals where fracture conductivities are sufficiently high to rob injection fluid 2545 from competing injection intervals. Thus, an upper limit is maintained as to how much injection any one interval will be allowed.

Figure 28A:
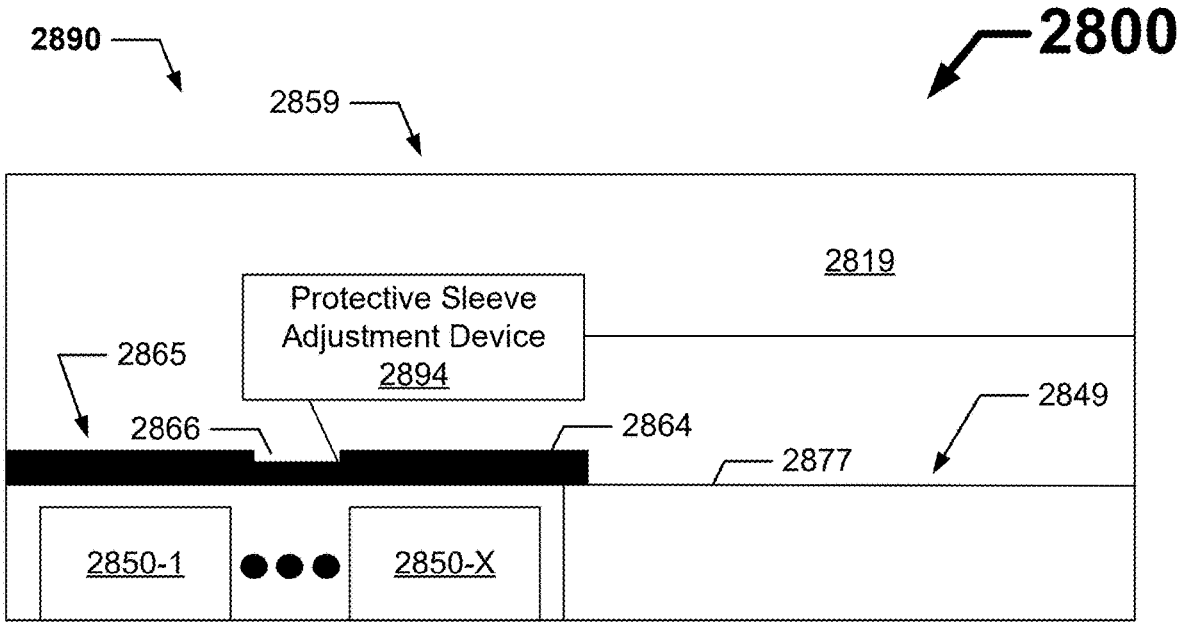
FIGS. 28A and 28B show a field system in which a protective sleeve is moved within a sub according to certain example embodiments.
Figure 28B:
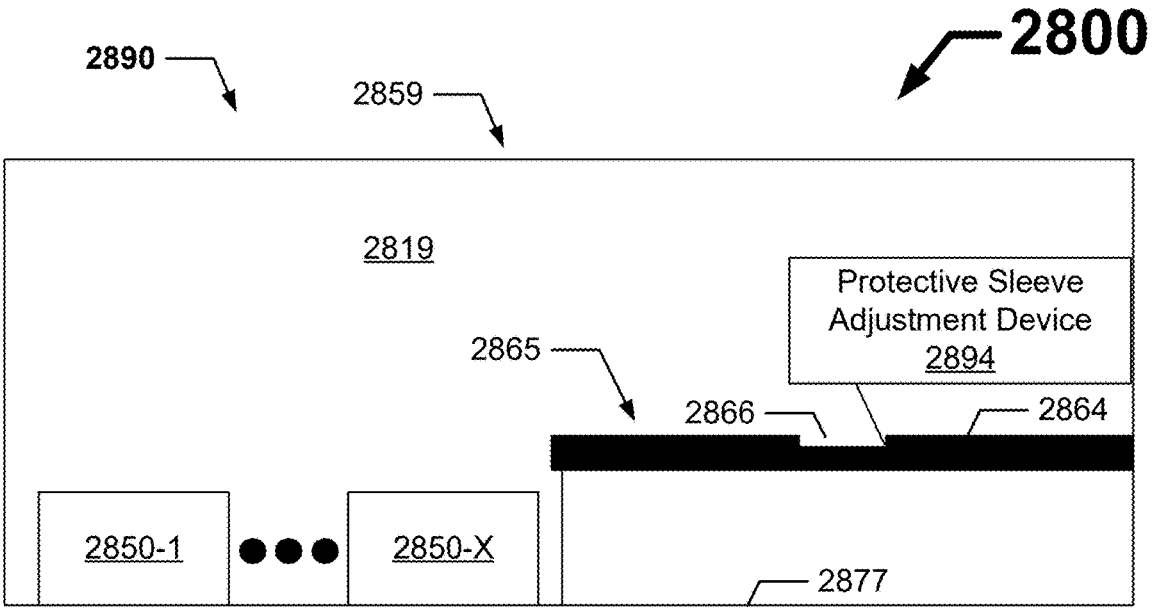

FIGS. 28A and 28B show part of a field system 2800 in which a protective sleeve 2865 is moved within a sub 2890 according to certain example embodiments. Specifically, FIG. 28A shows the protective sleeve 2865 in the engaged position, and FIG. 28B shows the protective sleeve 2865 in the disengaged position. Referring to the description above with respect to FIGS. 1 through 27, the sub 2890 includes a housing 2859 that includes one or more housing walls 2877, inside of which are disposed multiple (e.g., 2, 3, 5, 8, X) injection regulators 2850 (injection regulator 2850-1 through injection regulator 2850-X). Each injection regulator 2850 may be in the form of an ASRICV. Alternatively, an injection regulator 2850 may be some other type of valve.

The protective sleeve 2865 is movably (e.g., slidably) disposed within the cavity 2819. The protective sleeve 2865 is made of a material that maintains its shape and size when exposed to extreme conditions (e.g., high pressure, high temperature, elevated amounts of fluid flow), such as the conditions that exist within the cavity 2819 during a fracture stimulation operation. In other words, the protective sleeve 2865 may be configured to withstand direct exposure to a fracturing operation without substantial deformation. The protective sleeve 2865 has an engaged position (as shown in FIG. 28A), in which all of the injection regulators 2850 are isolated from the cavity 2819, and a disengaged position (as shown in FIG. 28B), in which all of the injection regulators 2850 are exposed to the cavity 2819.

The protective sleeve 2865 includes a body 2864 that may have any characteristics (e.g., shape, size, material) suitable for moving within the housing 2859 between the engaged position and the disengaged position and suitable for protecting the multiple injection regulators 2850 when in the engaged position. For example, the body 2864 of the protective sleeve 2865 may be tubular in shape and have a length that is less than half the length of the housing 2859 of the sub 2890.

The body 2864 of the protective sleeve 2865 includes an engagement feature 2866 that is configured to engage with the protective sleeve adjustment device 2994 (e.g., part of a wireline tool, part of a coiled tubing, part of a ball or dart pumped down the well from surface) within the cavity 2819 of the sub 2890 for moving the protective sleeve 2865 between the engaged position and the disengaged position. In this case, the engagement feature 2866 is a recess or slot along the inner surface of the protective sleeve 2865 that traverses some, but not all, of the thickness of the body 2864 and is located slightly toward the distal end of the body 2864. In this example, the body 2864 of the protective sleeve 2865 has no retention features (e.g., similar to the retention features 1241 discussed above).

The sub 2890 is substantially similar to the subs discussed above. For example, the housing 2859 of the sub 2890 includes one or more walls 2877 that form a cavity 2819 that is open at both ends. At least one of the walls 2877 of the housing 2859 within the cavity 2819 includes a protective sleeve receiving area 2849 within which the protective sleeve 2865 is movably disposed. The protective sleeve receiving area 2849 of the housing 2859 is configured to provide a space within which the protective sleeve 2865 may move. In this case, the protective sleeve receiving area 2849 is a recess within an interior wall 2877 of the housing 2859 that allows the protective sleeve 2865 to slide along most of the length of the housing 2859 of the sub 2890. To simplify the drawings, certain other features of the protective sleeve receiving area 2849 and the rest of the sub 2890 such as the stops (e.g., similar to the stops 1247 above), a retention feature (e.g., similar to a retention feature 1241 above), and the flow orifices (e.g., similar to the flow orifices 1268 above) in the wall 2877 of the housing 2859 are omitted in FIGS. 28A and 28B.

Figure 29A:
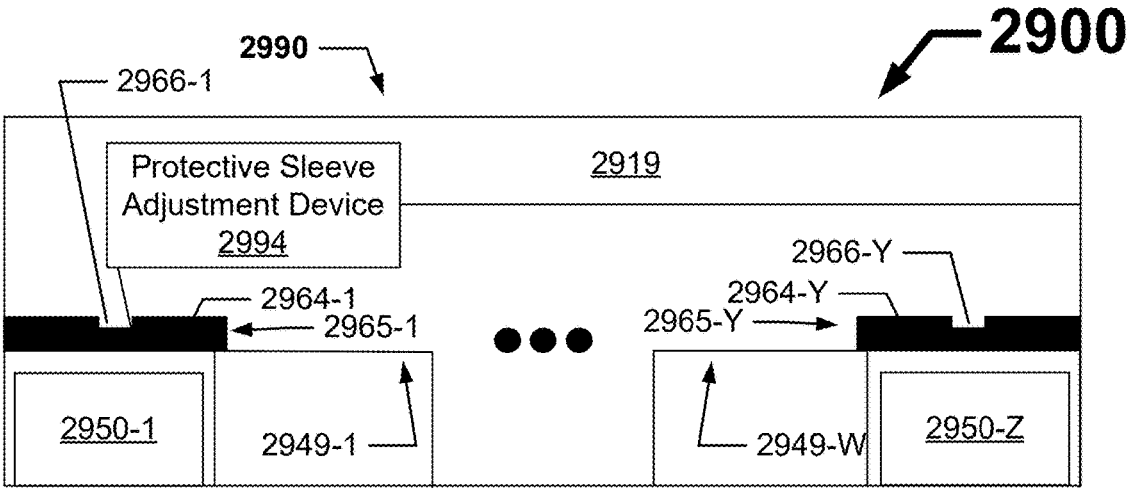
FIGS. 29A through 29C show a field system in which multiple protective sleeves are moved within a sub according to certain example embodiments.
Figure 29B:
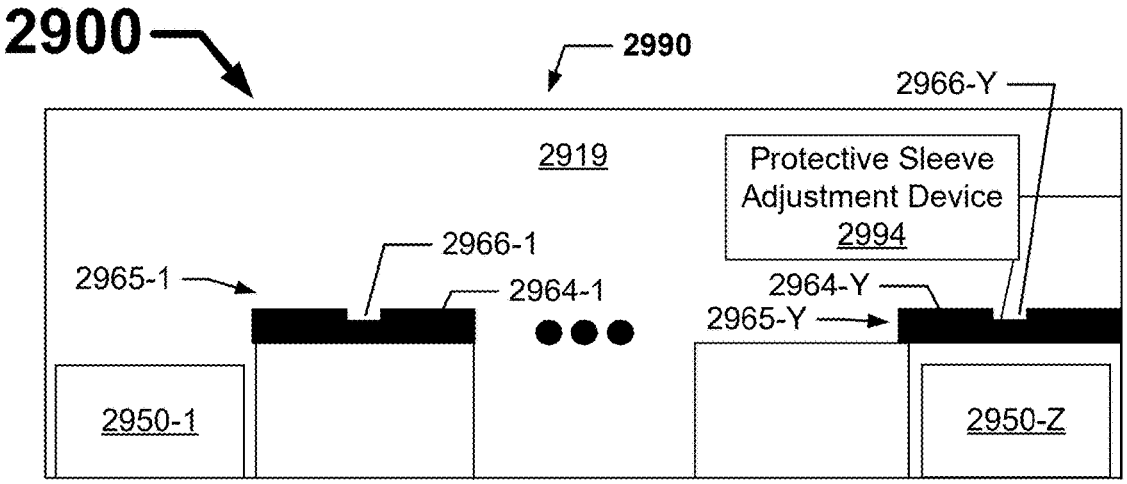
Figure 29C:
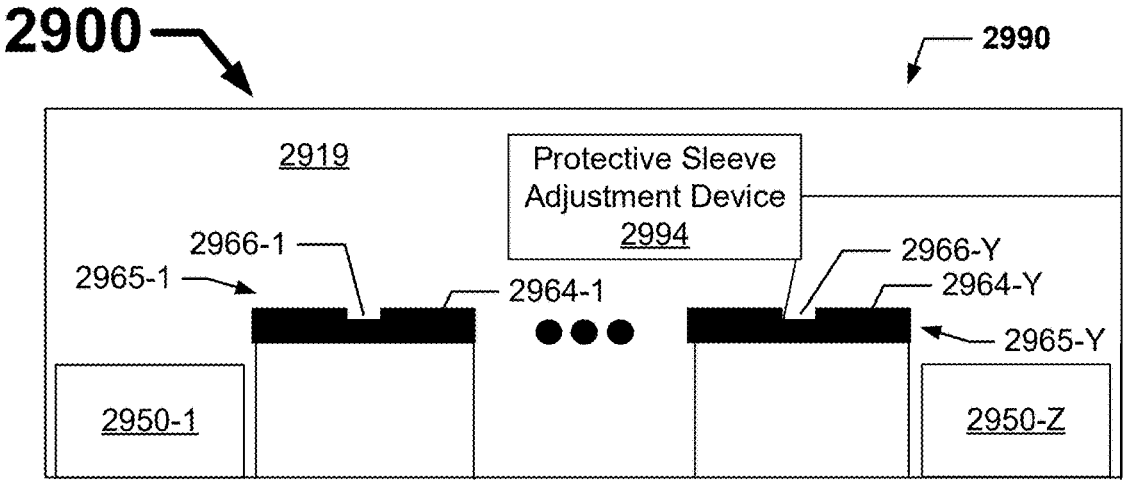

FIGS. 29A through 29C show part of a field system 2900 in which multiple protective sleeves 2965 are moved within a sub 2990 according to certain example embodiments. Specifically, FIG. 29A shows all of the protection sleeves 2965 in the engaged position. FIG. 29B shows one of the protection sleeves 2965-1 in the disengaged position while the remainder of the protection sleeves 2965 (e.g., protective sleeve 2965-Y) is in the engaged position. FIG. 29C shows all of the protection sleeves 2965 in the disengaged position. Referring to the description above with respect to FIGS. 1 through 28B, the sub 2990 includes a housing 2959 that includes one or more housing walls 2977, inside of which are disposed multiple (e.g., 2, 3, 5, 8, Z) injection regulators 2950 (injection regulator 2950-1 through injection regulator 2950-Z). An injection regulator 2950 may be in the form of an ASRICV. Alternatively, an injection regulator 2950 may be some other type of valve.

Also, the sub 2990 includes multiple (e.g., 2, 3, 5, 7, Y) protective sleeves 2965 (protective sleeve 2965-1 through protective sleeve 2965-Y). Each protective sleeve 2965 is movably (e.g., slidably) disposed within the cavity 2919. Each protective sleeve 2965 is made of a material that maintains its shape and size when exposed to extreme conditions (e.g., high pressure, high temperature, elevated amounts of fluid flow), such as the conditions that exist within the cavity 2919 during a fracture stimulation operation. In other words, each protective sleeve 2965 may be configured to withstand direct exposure to a fracturing operation without substantial deformation. Each protective sleeve 2965 has an engaged position (as shown in FIG. 29A), in which all of the injection regulators 2950 associated with the protective sleeve 2965 are isolated from the cavity 2919, and a disengaged position (as shown in FIG. 29C), in which all of the injection regulators 2950 associated with the protective sleeves 2965 are exposed to the cavity 2919.

Each protective sleeve 2965 includes a body 2964 (e.g., body 2964-1 for protective sleeve 2965-1, body 2964-Y for protective sleeve 2965-Y) that may have any characteristics (e.g., shape, size, material) suitable for moving within the housing 2959 between the engaged position and the disengaged position and suitable for protecting the multiple injection regulators 2950 when in the engaged position. For example, the body 2964 of a protective sleeve 2965 may be tubular in shape and have a length that is less than half (e.g., no more than $1\div(Y+1)$) the length of the housing 2959 of the sub 2990.

The body 2964 of each protective sleeve 2965 may include an engagement feature 2966 (engagement feature 2966-1 for protective sleeve 2965-1, engagement feature 2966-Y for protective sleeve 2965-Y) that is configured to engage with the protective sleeve adjustment device 2994 (e.g., part of a wireline tool, part of a coiled tubing, part of a ball or dart pumped down the well from surface) within the cavity 2919 of the sub 2990 for moving a protective sleeve 2965 between the engaged position and the disengaged position. In this example, the protective sleeve adjustment device 2994 moves in one direction to move the protection sleeve 2965-1 from the engaged position to the disengaged position, while the protective sleeve adjustment device 2994 moves in the opposite direction to move the protection sleeve 2965-Y from the engaged position to the disengaged position. In this case, the engagement feature 2966 is a recess or slot along the inner surface of the protective sleeve 2965 that traverses some, but not all, of the thickness of the body 2964 and is located slightly toward the distal end of the body 2964.

In this example, the body 2964 of each protective sleeve 2965 has no retention features (e.g., similar to the retention features 1241 discussed above). When there are multiple protective sleeves 2965 within a sub 2990, as in this case, the configuration of one protective sleeve 2965 may be the same as, or different than, the configuration of one or more of the other protective sleeves 2965 of the sub 2990. When a sub 2990 has multiple protective sleeves 2965 and multiple injection regulators 2950, the number of multiple protective sleeves 2965 may be the same as, or different than, the number of multiple injection regulators 2950. A protective sleeve 2965 may be configured to isolate any number (e.g., 0, 1, 2, 3, 6) of injection regulators 2950.

The sub 2990 is substantially similar to the subs discussed above. For example, the housing 2959 of the sub 2990 includes one or more walls 2977 that form a cavity 2919 that is open at both ends. At least one of the walls 2977 of the housing 2959 within the cavity 2919 includes one or more (e.g., (e.g., 1, 2, 3, 5, 7, W) protective sleeve receiving areas 2949 within which one or more protective sleeves 2965 are movably disposed. In this case, there are W protective sleeve receiving areas 2949 (protective sleeve receiving area 2949-1 through protective sleeve receiving area 2949-W). Each protective sleeve receiving area 2949 of the housing 2959 is configured to provide a space within which one or more protective sleeves 2965 may move.

In this case, each protective sleeve receiving area 2949 is a recess within an interior wall 2977 of the housing 2959 that allows a protective sleeve 2965 to slide along some of the length of the housing 2959 of the sub 2990. In alternative embodiments, the configuration of one protective sleeve receiving area 2949 may be different than the configuration of one or more of the other protective sleeve receiving areas 2949. To simplify the drawings, certain other features of the protective sleeve receiving areas 2949 and the rest of the sub 2990 such as the stops (e.g., similar to the stops 1247 above), a retention feature (e.g., similar to a retention feature 1241 above), and the flow orifices (e.g., similar to the flow orifices 1268 above) in the wall 2977 of the housing 2959 are omitted in FIGS. 29A through 29C.

Figure 30:
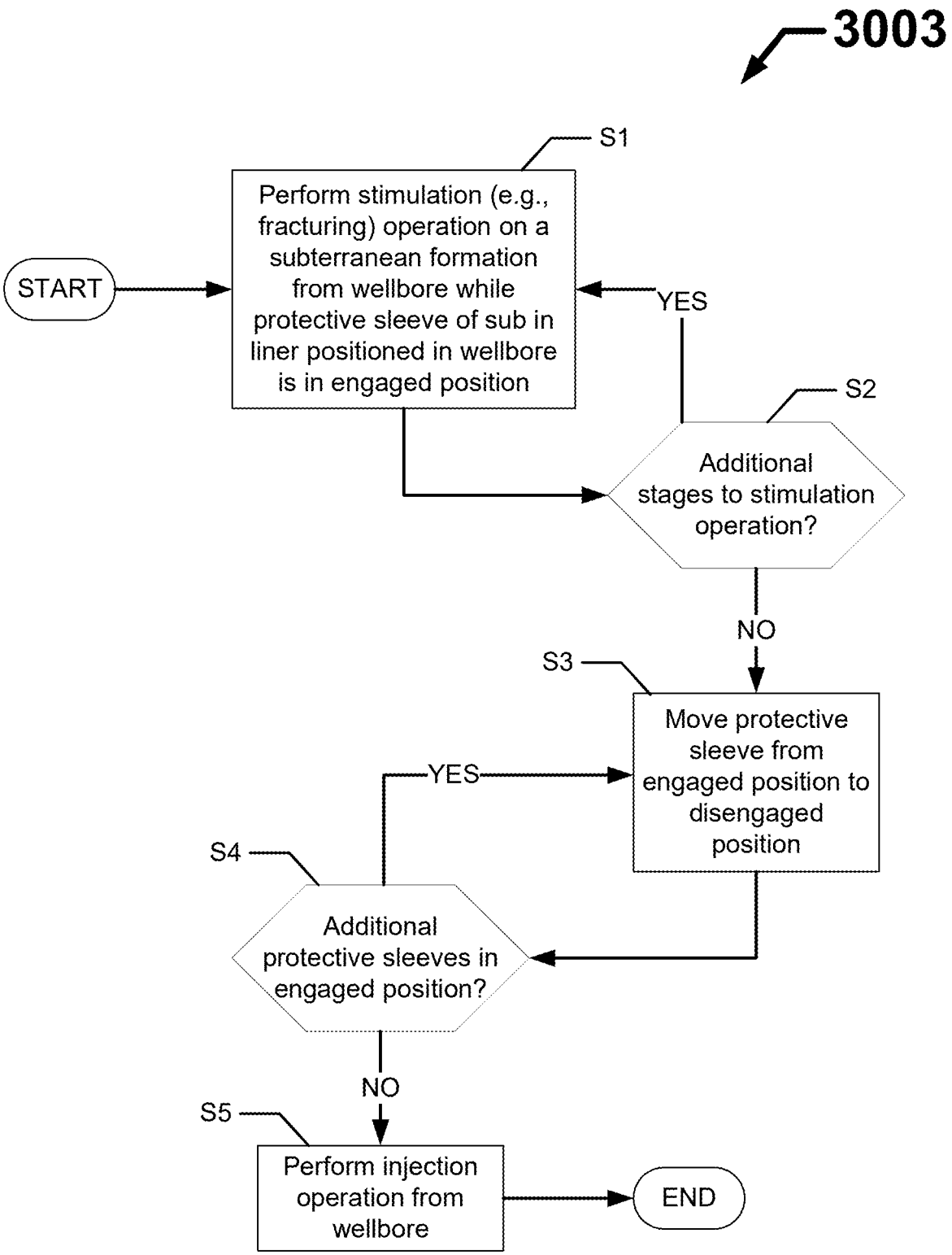
FIG. 30 shows a flowchart 3003 of a method for implementing a stimulation and injection sequence from a wellbore according to certain example embodiments.

FIG. 30 shows a flowchart 3003 of a method for implementing a stimulation and injection sequence from a wellbore according to certain example embodiments. While the various steps in this flowchart 3003 are presented sequentially, one of ordinary skill will appreciate that some or all of the steps may be executed in different orders, may be combined or omitted, and some or all of the steps may be executed in parallel. Further, in one or more of the example embodiments, one or more of the steps shown in this example method may be omitted, repeated, and/or performed in a different order.

In addition, a person of ordinary skill in the art will appreciate that additional steps not shown in FIG. 30 may be included in performing this method shown in the flowchart 3003. Accordingly, the specific arrangement of steps should not be construed as limiting the scope. Further, a controller or other type of computing device with a non-transitory computer readable medium can be used to perform or facilitate performance of one or more of the steps for the method shown in FIG. 30 in certain example embodiments. Any of the functions performed or facilitated by a controller can involve the use of one or more protocols, one or more algorithms, measurements from one or more sensor devices, and/or stored data stored in a storage repository. In addition, or in the alternative, any of the functions in the method can be performed by a user.

The method shown in FIG. 30 is merely an example that can be performed by using an example protection sleeve described herein. In other words, systems for manipulating protection sleeves can perform other functions using other methods in addition to and/or aside from those shown in FIG. 30. Referring to the description above with respect to FIGS. 1 through 29C, the method shown in the flowchart 3003 of FIG. 30 begins at the START step and proceeds to step S1, where a stimulation operation (e.g., a fracturing operation) is performed on a subterranean formation 210 from a wellbore while a protective sleeve 1265 of a sub 1290 in a liner 211 positioned in the wellbore 220 is in an engaged position. When the protective sleeve 1265 is in the engaged position, the protective sleeve 1265 isolates an injection regulator 1250 of the sub 1290 from the cavity 1219 of the sub 1290 during the stimulation operation.

For example, the protective sleeve 1265, when in the engaged position, isolates and protects one or more associated injection regulators 1250 from the impacts (e.g., high pressure, high temperature, high flow rates) in the cavity 1219 of the sub 1290 when an adjacent stimulation sleeve 275 is activated (i.e., opened) and stimulation (e.g., fracturing) fluid is pumped into the annulus 229 in order to propagate fractures in the adjacent subterranean formation 210. In such a case, the stimulation sleeve 275 can operate on a timer, based on some condition (e.g., lack of movement in the liner 211, the flow of a fluid in the cavity 1219, a minimum pressure reached in the cavity 1219), and/or under the control of a user at the surface. In some cases, the injection regulator 1250 is or includes an ASRICV.

In step S2, a determination is made as to whether there are additional stages to the stimulation operation. For example, a determination is made as to whether other stimulation sleeves 275 in the liner 211 still need to be operated before fracture stimulation operations are completed on the subterranean formation 210 from the wellbore 220. For instance, the fracturing operation may involve fracturing multiple locations sequentially within the wellbore 220. If there are additional stages to the fracturing operation, then the process reverts to step S1. If there are no additional stages to the fracturing operation, then the process proceeds to step S3.

In step S3, the protective sleeve 1265 is moved from the engaged position to the disengaged position. The protective sleeve 1265 may be moved from the engaged position to the disengaged position by a protective sleeve adjustment device 2894 (e.g., a wireline tool, a coiled tubing, a ball or dart pumped down the well from surface). In such a case, the protective sleeve adjustment device 2894 may engage an engagement feature 1266 in the body 1264 of the protective sleeve 1265 to move (e.g., slide) the protective sleeve within a protective sleeve receiving area 1249 in a recess within an interior wall 1277 of the housing 1259. When the protective sleeve 1265 is moved from the engaged position to the disengaged position, the one or more associated injection regulators 1250 become exposed to the cavity 1219 of the sub 1290.

In step S4, a determination is made as to whether there are additional protective sleeves 1265 that remain in the engaged position. For example, a determination is made as to whether other protective sleeves 1265 in the liner 211 still need to be moved to the disengaged position before an injection operation can begin. If there are additional protective sleeves 1265 that remain in the engaged position, then the process reverts to step S3. If there are no additional protective sleeves 1265 that remain in the engaged position, then the process proceeds to step S5.

In step S5, an injection operation is performed from the wellbore 220. The injection operation may involve the use of a fluid injection apparatus 192 that injects an injection fluid 645 into the wellbore 220. When this occurs, each injection regulator 1250 in the liner 211, now exposed to the cavity 1219 in the sub 1290, is configured to regulate how much of the injection fluid 645 flows therethrough and into the subterranean formation to help ensure that a substantially equal amount of the injection fluid 645 flows into the subterranean formation along the length of the liner 211. When step S5 is complete, the process can proceed to the END step.

Regardless of the configuration of an injection regulator when in the form of an ASRICV, the operating envelope of an example ASRICV (e.g., regulators 1450 and 1950) can be uniquely designed for any flowrate range using, for example, the size of the effective footprint of the collective flow orifice (also called the variable-area orifice), the size and shape of the variable-area orifice in relation to Δx, the compression stiffness of an actuator in the form of a spring or bellows (or other form of gas receptacle), and the preload force of the spring or bellows. As an example, ASRICVs that rely on spring-loaded poppet valves and stand-alone fixed-area orifices (e.g. regulator 2350) can be uniquely designed for any flowrate range using, for example, the size of poppet-valves flow orifice, the compression stiffness of an actuator spring, the number poppet-valves used, the number of stand-alone orifices used, and the size of the stand-alone orifice.

Irrespective of the operating envelope, however, the general design of an ASRICV results in restricting runaway injection into intervals where permeabilities or fracture conductivities are sufficiently high to become thief zones, thereby robbing injection fluid from competing intervals. Optimal design and deployment of an ASRICV may start with determining the maximum flowrate acceptable for each injection interval. Regulators for each interval can then be designed, given the design parameters above, to distribute the desired flowrate to each injection interval, while setting an upper limit as how much injection any one interval will be allowed.

Example embodiments may be used to provide systems and methods for subs that include one or more regulators (e.g., autonomous self-regulating injection control regulators) for injecting fluid into a subterranean formation. Example embodiments are used to isolate these regulators during other types of operations (e.g., fracture stimulation operations), protecting the regulators while the sub is positioned in a wellbore. In this way, a sub with example protection sleeves and regulators can be part of a single-installation tubing string or liner that also includes stimulation sleeves and/or other subs that are employed before and/or after an injection operation in which the regulators are used. In this way, the regulators operate properly due to the protection provided by the example protection sleeves during times outside of the injection operations. Example embodiments may provide a number of benefits. Such benefits may include, but are not limited to, more reliable field operations, ease of installation and use, reduced downtime, increased flexibility, configurability, and compliance with applicable industry standards and regulations.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A sub used for subterranean injections, the sub comprising:

a housing comprising a housing wall forming a cavity, wherein the housing is configured to be placed in line with a liner, and wherein the housing wall has a first flow orifice that traverses therethrough;

an injection regulator disposed within the cavity; and a protective sleeve movably disposed within the cavity, wherein the protective sleeve has an engaged position and a disengaged position, wherein the protective sleeve is configured to cover and isolate the injection regulator from the cavity to prevent the injection regulator from operating when the protective sleeve is in the engaged position, and wherein the injection regulator is uncovered and exposed to the cavity so that the injection regulator is free to operate when the protective sleeve is in the disengaged position.

2. The sub of claim 1, wherein the housing wall comprises a protective sleeve receiving area within which the protective sleeve is movably disposed.

3. The sub of claim 2, wherein the protective sleeve receiving area comprises a recess within the housing wall.

4. The sub of claim 3, wherein the protective sleeve is configured to slide within the recess.

5. The sub of claim 1, wherein the protective sleeve receiving area comprises a proximal stop and a distal stop to limit a range of motion of the protective sleeve.

6. The sub of claim 1, wherein the protective sleeve receiving area comprises a retention feature to maintain a position of the protective sleeve within the protective sleeve receiving area.

7. The sub of claim 6, wherein the retention feature is configured to complement a complementary retention feature on an outer surface of the protective sleeve.

8. The sub of claim 7, wherein the retention feature comprises a detent.

9. The sub of claim 1, wherein the protective sleeve comprises an engagement feature that is configured to engage with a protective sleeve adjustment device for moving the protective sleeve between the engaged position and the disengaged position.

10. The sub of claim 9, wherein the engagement feature comprises a recess along an inner surface of the protective sleeve.

11. The sub of claim 1, wherein the protective sleeve is configured to withstand direct exposure to a stimulation operation without substantial deformation.

12. The sub of claim 1, further comprising:

a second injection regulator disposed within the cavity; and a second protective sleeve movably disposed within cavity, wherein the second protective sleeve has the engaged position and the disengaged position, wherein the second protective sleeve is configured to cover and isolate the second injection regulator from the cavity when the second protective sleeve is in the engaged position to prevent the second injection regulator from operating, and wherein the second injection regulator is uncovered and exposed to the cavity so that the second injection regulator is free to operate when the second protective sleeve is in the disengaged position.

13. The sub of claim 1, further comprising:

a second injection regulator disposed within the cavity, wherein the protective sleeve is further configured to cover and isolate the second injection regulator from the cavity when the protective sleeve is in the engaged position to prevent the second injection regulator from operating, and wherein the second injection regulator is uncovered and exposed to the cavity so that the second injection regulator is free to operate when the protective sleeve is in the disengaged position.

14. The sub of claim 1, wherein the injection regulator comprises an autonomous self-regulating injection control valve (ASRICV).

15. The sub of claim 14, wherein the ASRICV comprises:

a chamber disposed within the cavity, wherein the chamber is bounded by a chamber wall, wherein the chamber wall has a second flow orifice that traverses therethrough, and wherein the first flow orifice and the second flow orifice are aligned with each other;

a valve sleeve movably disposed within the chamber, wherein the valve sleeve has an open position and a plurality of closed positions, and wherein the valve sleeve partially covers the first flow orifice and the second flow orifice when in one of the plurality of closed positions; and an actuator disposed within the chamber and in communication with the valve sleeve, wherein the actuator is configured to move the valve sleeve between the open position and the plurality of closed positions, and wherein the actuator is configured to operate automatically based on conditions in the wellbore.

16. The sub of claim 14, wherein the ASRICV comprises:

one or more poppet valves comprising a poppet loaded by an actuator, wherein each of the one or more poppet valves is bounded by the housing wall, wherein each of the one or more poppet valves has a second flow orifice that traverses therethrough, wherein the first flow orifice and the second flow orifice are aligned with each other, wherein each of the one or more poppet valves has an open position and a plurality of closed positions, wherein the poppet of each of the one or more poppet valves at least partially covers the first flow orifice and the second flow orifice when in one of the plurality of closed positions, wherein the actuator of each of the one or more poppet valves is configured to move the poppet between the open position and the plurality of closed positions, and wherein the actuator of each of the one or more poppet valves is configured to operate automatically based on conditions in the wellbore; and one or more stand-alone fixed-area flow orifices, wherein each of the one or more stand-alone fixed-area flow orifices is bounded by the housing wall, wherein each of the one or more stand-alone fixed-area flow orifices is configured to have only a second open position.

* * * * *